US011659887B2

(12) United States Patent
Dupre et al.

(10) Patent No.: US 11,659,887 B2
(45) **Date of Patent: *May 30, 2023**

(54) PLATE WITH FOAM FOR FOOTWEAR

(71) Applicant: NIKE, Inc., Beaverton, OR (US)

(72) Inventors: Risha Dupre, Tigard, OR (US); Emily Farina, Beaverton, OR (US); Lysandre Follet, Portland, OR (US); Stefan E. Guest, Portland, OR (US); Helene Hutchinson, Portland, OR (US); Geng Luo, Portland, OR (US); Rachel M. Savage, Beaverton, OR (US); Krissy Yetman, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 20 days.

This patent is subject to a terminal disclaimer.

(21) Appl. No.: 17/231,220

(22) Filed: Apr. 15, 2021

(65) Prior Publication Data

US 2021/0227930 A1 Jul. 29, 2021

Related U.S. Application Data

(63) Continuation of application No. 16/548,170, filed on Aug. 22, 2019, now Pat. No. 11,357,286, which is a (Continued)

(51) Int. Cl.
*A43B 13/12* (2006.01)
*A43B 13/18* (2006.01)
(Continued)

(52) U.S. Cl.
CPC ..... *A43B 13/186* (2013.01); *A43B 7/145* (2013.01); *A43B 7/148* (2013.01); *A43B 7/1445* (2013.01);
(Continued)

(58) Field of Classification Search
CPC ... A43B 13/143; A43B 13/145; A43B 13/146; A43B 13/12
(Continued)

(56) References Cited

U.S. PATENT DOCUMENTS 859,382 A 7/1907 Hansen
1,548,806 A 8/1925 Perry
(Continued)

FOREIGN PATENT DOCUMENTS

CN 2633059 Y 8/2004
CN 101090649 A 12/2007
(Continued)

OTHER PUBLICATIONS

China Patent Office, Office Action dated May 21, 2021 for Application No. 201980007331.9.
(Continued)

*Primary Examiner* — Marie D Bays
(74) *Attorney, Agent, or Firm* — Honigman LLP; Matthew H. Szalach; Jonathan P. O'Brien

(57) ABSTRACT

A sole structure for an article of footwear having an upper includes an outsole, a plate disposed between the outsole and the upper, and a first cushioning layer. The plate includes an anterior-most point disposed in a forefoot region of the sole structure, a posterior-most point disposed closer to a heel region of the sole structure than the anterior-most point, and a concave portion extending between the anterior-most point and the posterior-most point. The concave portion includes a constant radius of curvature from the anterior-most point to a metarsophalangeal (MTP) point of the sole structure. The MTP point opposes the MTP joint of a foot during use. The first cushioning layer is disposed between the concave portion and the upper.

17 Claims, 36 Drawing Sheets

Related U.S. Application Data continuation of application No. 15/248,059, filed on Aug. 26, 2016, now Pat. No. 10,448,704.

(60) Provisional application No. 62/308,626, filed on Mar. 15, 2016, provisional application No. 62/236,649, filed on Oct. 2, 2015.

(51) Int. Cl.

| | |
|---|---|
| ***A43B 13/14*** | (2006.01) |
| ***A43B 13/20*** | (2006.01) |
| ***A43B 7/1445*** | (2022.01) |
| ***A43B 7/145*** | (2022.01) |
| ***A43B 7/148*** | (2022.01) |
| ***A43B 7/18*** | (2006.01) |
| ***A43B 13/04*** | (2006.01) |
| ***A43B 13/22*** | (2006.01) |

(52) U.S. Cl.
CPC ..... *A43B 7/18* (2013.01); *A43B 13/04* (2013.01); *A43B 13/12* (2013.01); *A43B 13/127* (2013.01); *A43B 13/141* (2013.01); *A43B 13/143* (2013.01); *A43B 13/188* (2013.01); *A43B 13/189* (2013.01); *A43B 13/20* (2013.01); *A43B 13/22* (2013.01)

(58) Field of Classification Search
USPC ..... 36/25 R, 107, 30 R, 31
See application file for complete search history.

(56) References Cited

U.S. PATENT DOCUMENTS

| | | | | |
|---|---|---|---|---|
| 2,124,819 | A * | 7/1938 | Halloran | A43B 13/42 36/76 R |
| 2,203,929 | A | 6/1940 | Shapiro | |
| 2,333,303 | A | 11/1943 | Enos | |
| 2,391,564 | A | 12/1945 | Gregg | |
| 2,408,736 | A | 10/1946 | Codish | |
| 2,412,808 | A | 12/1946 | Goldstein | |
| 2,421,932 | A | 6/1947 | Goldstein | |
| 2,430,497 | A | 11/1947 | Enright | |
| 2,730,819 | A | 1/1956 | Foust | |
| 2,808,663 | A | 10/1957 | Frieder | |
| 3,328,901 | A | 7/1967 | Strickland | |
| 3,442,032 | A | 5/1969 | Jonas | |
| 3,738,026 | A | 6/1973 | Granger | |
| 4,079,568 | A | 3/1978 | Wortman | |
| 4,271,608 | A | 6/1981 | Tomuro | |
| 4,318,231 | A | 3/1982 | Simoneau | |
| 4,439,934 | A | 4/1984 | Brown | |
| 4,439,937 | A * | 4/1984 | Daswick | A43B 13/10 36/72 A |
| 4,454,664 | A | 6/1984 | MacNeil | |
| 4,561,195 | A * | 12/1985 | Onoda | A43B 5/00 36/31 |
| 4,612,713 | A | 9/1986 | Brown | |
| 4,651,445 | A | 3/1987 | Hannibal | |
| 4,651,448 | A | 3/1987 | Chen | |
| 4,654,984 | A | 4/1987 | Brown | |
| 4,689,899 | A | 9/1987 | Larson et al. | |
| 4,729,179 | A | 3/1988 | Quist, Jr. | |
| 4,774,954 | A | 10/1988 | Ibrahim | |
| 4,813,090 | A | 3/1989 | Ibrahim | |
| 4,815,221 | A | 3/1989 | Diaz | |
| 4,821,430 | A | 4/1989 | Flemming et al. | |
| 4,908,961 | A | 3/1990 | Purslow et al. | |
| 4,922,636 | A | 5/1990 | Chen | |
| 4,955,148 | A | 9/1990 | Padilla | |
| 5,022,168 | A | 6/1991 | Jeppson, III et al. | |
| 5,025,573 | A | 6/1991 | Giese et al. | |
| 5,052,130 | A | 10/1991 | Barry et al. | |
| 5,123,180 | A | 6/1992 | Nannig et al. | |
| 5,142,797 | A | 9/1992 | Cole, III | |
| 5,345,638 | A | 9/1994 | Nishida | |
| 5,401,564 | A | 3/1995 | Lee et al. | |
| 5,406,723 | A | 4/1995 | Okajima | |
| 5,529,826 | A | 6/1996 | Tailor et al. | |
| 5,543,194 | A | 8/1996 | Rudy | |
| 5,706,590 | A | 1/1998 | Candela et al. | |
| 5,720,118 | A * | 2/1998 | Mayer | A43B 13/38 36/107 |
| 5,733,647 | A | 3/1998 | Moore, III et al. | |
| 5,918,338 | A | 7/1999 | Wong | |
| 5,932,336 | A | 8/1999 | Allen et al. | |
| 6,038,790 | A | 3/2000 | Pyle et al. | |
| 6,199,303 | B1 | 3/2001 | Luthi et al. | |
| 6,231,946 | B1 | 5/2001 | Brown, Jr. et al. | |
| 6,318,002 | B1 | 11/2001 | Ou | |
| 6,389,713 | B1 * | 5/2002 | Kita | A43B 13/18 36/31 |
| 6,502,331 | B2 | 1/2003 | Hines | |
| 6,594,922 | B1 | 7/2003 | Mansfield et al. | |
| 6,675,500 | B1 | 1/2004 | Cadamuro et al. | |
| 6,684,532 | B2 | 2/2004 | Greene et al. | |
| 6,782,642 | B2 | 8/2004 | Knoche et al. | |
| 7,013,581 | B2 | 3/2006 | Greene et al. | |
| 7,013,583 | B2 | 3/2006 | Greene et al. | |
| 7,062,865 | B1 | 6/2006 | Nordt, III | |
| 7,107,703 | B1 | 9/2006 | Wang | |
| 7,401,422 | B1 | 7/2008 | Scholz et al. | |
| 7,421,808 | B2 | 9/2008 | Baier et al. | |
| 7,437,838 | B2 | 10/2008 | Nau | |
| 7,832,117 | B2 | 11/2010 | Auger et al. | |
| 7,886,460 | B2 | 2/2011 | Teteriatnikov et al. | |
| 7,934,327 | B2 | 5/2011 | Gebhard | |
| 7,941,940 | B2 | 5/2011 | Teteriatnikov et al. | |
| 8,256,145 | B2 | 9/2012 | Baucom et al. | |
| 8,312,827 | B1 | 11/2012 | Free | |
| 8,381,416 | B2 | 2/2013 | Geer et al. | |
| 8,850,718 | B2 | 10/2014 | Lubart | |
| 9,326,563 | B2 | 5/2016 | Svensson | |
| 9,610,746 | B2 | 4/2017 | Wardlaw et al. | |
| 9,622,542 | B2 | 4/2017 | Greene | |
| 9,655,407 | B2 | 5/2017 | Reinhardt et al. | |
| 9,930,934 | B2 | 4/2018 | Cook et al. | |
| 10,743,606 | B2 | 8/2020 | Bartel et al. | |
| 10,758,005 | B2 | 9/2020 | Bartel et al. | |
| 10,952,498 | B2 | 3/2021 | Bruce et al. | |
| 11,089,834 | B2 | 8/2021 | Chambers et al. | |
| 2002/0011146 | A1 | 1/2002 | Vaz | |
| 2002/0064640 | A1 | 5/2002 | Renard et al. | |
| 2002/0066209 | A1 | 6/2002 | Steed et al. | |
| 2002/0152642 | A1 * | 10/2002 | Chu | A43B 13/12 36/25 R |
| 2002/0178615 | A1 | 12/2002 | Saillet et al. | |
| 2003/0051372 | A1 | 3/2003 | Lyden | |
| 2003/0069807 | A1 | 4/2003 | Lyden | |
| 2003/0121179 | A1 | 7/2003 | Chen | |
| 2003/0221337 | A1 | 12/2003 | Farys et al. | |
| 2004/0123495 | A1 | 7/2004 | Greene et al. | |
| 2004/0163280 | A1 | 8/2004 | Morris et al. | |
| 2004/0168355 | A1 | 9/2004 | Biwand et al. | |
| 2004/0197529 | A1 | 10/2004 | Cadamuro et al. | |
| 2004/0205983 | A1 | 10/2004 | Talbott | |
| 2004/0226191 | A1 | 11/2004 | Hsieh | |
| 2005/0022425 | A1 | 2/2005 | Brown | |
| 2005/0108897 | A1 | 5/2005 | Aveni | |
| 2005/0132614 | A1 | 6/2005 | Brennan | |
| 2005/0248749 | A1 | 11/2005 | Kiehn et al. | |
| 2005/0262737 | A1 | 12/2005 | Vattes | |
| 2006/0021257 | A1 | 2/2006 | Hung | |
| 2006/0211318 | A1 | 9/2006 | Fenzi et al. | |
| 2007/0017124 | A1 | 1/2007 | Koo et al. | |
| 2007/0043630 | A1 | 2/2007 | Lyden | |
| 2007/0105471 | A1 | 5/2007 | Wang et al. | |
| 2007/0119077 | A1 | 5/2007 | Yoo | |
| 2008/0134546 | A1 | 6/2008 | Righetto et al. | |
| 2009/0090031 | A1 | 4/2009 | Jung | |
| 2009/0094858 | A1 | 4/2009 | Ungari et al. | |
| 2009/0133287 | A1 | 5/2009 | Meschter | |
| 2009/0288312 | A1 | 11/2009 | Dua | |
| 2010/0205828 | A1 | 8/2010 | DiGangi | |

(56) References Cited

U.S. PATENT DOCUMENTS

| | | | | |
|---|---|---|---|---|
| 2010/0251564 | A1 | 10/2010 | Meschter | |
| 2010/0263234 | A1 | 10/2010 | Teteriatnikov et al. | |
| 2010/0263239 | A1* | 10/2010 | Biancucci | A43B 7/34 36/43 |
| 2010/0275471 | A1* | 11/2010 | Teteriatnikov | A43B 13/145 36/30 R |
| 2010/0281716 | A1 | 11/2010 | Luthi et al. | |
| 2010/0307028 | A1* | 12/2010 | Teteriatnikov | A43B 13/145 36/108 |
| 2011/0038904 | A1 | 2/2011 | Matteliano et al. | |
| 2011/0041359 | A1 | 2/2011 | Dojan et al. | |
| 2011/0078923 | A1 | 4/2011 | Bartholet et al. | |
| 2011/0113649 | A1 | 5/2011 | Merritt et al. | |
| 2011/0119959 | A1 | 5/2011 | Bodner | |
| 2011/0131831 | A1 | 6/2011 | Peyton et al. | |
| 2012/0011748 | A1 | 1/2012 | Frey | |
| 2012/0137544 | A1 | 6/2012 | Rosa et al. | |
| 2012/0174432 | A1 | 7/2012 | Peyton | |
| 2012/0198723 | A1 | 8/2012 | Borisov | |
| 2012/0255101 | A1 | 10/2012 | Pizzo | |
| 2012/0266500 | A1* | 10/2012 | Cobb | A43B 13/145 36/25 R |
| 2012/0297641 | A1 | 11/2012 | Pfister | |
| 2013/0074369 | A1 | 3/2013 | Thomson | |
| 2013/0125421 | A1 | 5/2013 | Stegmaier et al. | |
| 2014/0026444 | A1 | 1/2014 | Howley et al. | |
| 2014/0059895 | A1 | 3/2014 | Arciuolo | |
| 2014/0134378 | A1 | 5/2014 | Downs et al. | |
| 2014/0223673 | A1 | 8/2014 | Wardlaw et al. | |
| 2014/0245546 | A1 | 9/2014 | Huffa | |
| 2014/0259462 | A1 | 9/2014 | Taylor et al. | |
| 2015/0040428 | A1 | 2/2015 | Davis et al. | |
| 2015/0107133 | A1 | 4/2015 | Ganuza et al. | |
| 2015/0113829 | A1 | 4/2015 | Kodad | |
| 2015/0196082 | A1 | 7/2015 | Van Atta | |
| 2015/0196087 | A1 | 7/2015 | Meschter et al. | |
| 2015/0359290 | A1 | 12/2015 | Podhajny et al. | |
| 2015/0359295 | A1 | 12/2015 | Wildeman | |
| 2016/0007678 | A1 | 1/2016 | Silverman | |
| 2016/0029741 | A1* | 2/2016 | Foxen | A43B 13/42 36/103 |
| 2016/0031164 | A1 | 2/2016 | Downs et al. | |
| 2016/0058100 | A1 | 3/2016 | Dealey et al. | |
| 2016/0058107 | A1 | 3/2016 | Walker et al. | |
| 2016/0114546 | A1 | 4/2016 | Yang | |
| 2016/0135543 | A1 | 5/2016 | Anceresi et al. | |
| 2016/0152825 | A1 | 6/2016 | Lomoelder et al. | |
| 2016/0192741 | A1 | 7/2016 | Mark | |
| 2016/0206042 | A1 | 7/2016 | Cross et al. | |
| 2016/0206046 | A1 | 7/2016 | Cross | |
| 2016/0242506 | A1 | 8/2016 | Kim | |
| 2016/0286898 | A1 | 10/2016 | Manz et al. | |
| 2016/0295956 | A1 | 10/2016 | Wang et al. | |
| 2016/0302517 | A1 | 10/2016 | Jessiman et al. | |
| 2017/0006962 | A1 | 1/2017 | Tanabe et al. | |
| 2017/0006965 | A1 | 1/2017 | Musho et al. | |
| 2017/0049183 | A1 | 2/2017 | Foxen | |
| 2017/0071291 | A1 | 3/2017 | Follet et al. | |
| 2017/0095033 | A1 | 4/2017 | Farina et al. | |
| 2017/0095034 | A1 | 4/2017 | Dupre et al. | |
| 2017/0157893 | A1 | 6/2017 | Simmons et al. | |
| 2017/0196305 | A1 | 7/2017 | Barnes et al. | |
| 2017/0196306 | A1 | 7/2017 | Arciuolo | |
| 2017/0202309 | A1 | 7/2017 | Sterman et al. | |
| 2017/0368722 | A1 | 12/2017 | Jacobsen | |
| 2018/0020762 | A1 | 1/2018 | Jamison | |
| 2018/0116337 | A1 | 5/2018 | Montross et al. | |
| 2018/0177261 | A1 | 6/2018 | Amis et al. | |
| 2018/0192736 | A1 | 7/2018 | Luedecke | |
| 2018/0360156 | A1 | 12/2018 | Whiteman et al. | |
| 2019/0008234 | A1 | 1/2019 | Christensen et al. | |
| 2019/0082787 | A1 | 3/2019 | Tanabe et al. | |
| 2019/0223546 | A1 | 7/2019 | Bartel et al. | |
| 2019/0225784 | A1 | 7/2019 | Farr et al. | |
| 2019/0313733 | A1 | 10/2019 | Bartel et al. | |

FOREIGN PATENT DOCUMENTS

| | | | |
|---|---|---|---|
| CN | 101166435 | A | 4/2008 |
| CN | 101516222 | A | 8/2009 |
| CN | 102711543 | A | 10/2012 |
| CN | 202950081 | U | 5/2013 |
| CN | 103813730 | A | 5/2014 |
| CN | 105120700 | A | 12/2015 |
| CN | 105239261 | A | 1/2016 |
| CN | 105361343 | A | 3/2016 |
| CN | 105682500 | A | 6/2016 |
| CN | 106102501 | A | 11/2016 |
| DE | 2108204 | A1 | 8/1972 |
| DE | 2736974 | A1 | 3/1979 |
| DE | 4210292 | A1 | 9/1993 |
| EP | 0931470 | A2 | 7/1999 |
| EP | 1249184 | A1 | 10/2002 |
| EP | 1405577 | A2 | 4/2004 |
| EP | 1857005 | A1 | 11/2007 |
| EP | 1869989 | A1 | 12/2007 |
| EP | 2105058 | A1 | 9/2009 |
| EP | 2462827 | A2 | 6/2012 |
| EP | 3075277 | A2 | 10/2016 |
| EP | 3349608 | A1 | 7/2018 |
| JP | 2000106905 | A | 4/2000 |
| JP | 2007268025 | A | 10/2007 |
| JP | 5649151 | B1 | 1/2015 |
| KR | 100912386 | B1 | 8/2009 |
| KR | 10-2011-0004572 | A | 1/2011 |
| KR | 20130000467 | U | 1/2013 |
| WO | WO-1991/01660 | A1 | 2/1991 |
| WO | WO-1994/21454 | A1 | 9/1994 |
| WO | WO-2000/41544 | A2 | 7/2000 |
| WO | WO-2009069871 | A1 | 6/2009 |
| WO | WO-2011043507 | A1 | 4/2011 |
| WO | WO-2016004360 | A1 | 1/2016 |
| WO | WO-2016179265 | A1 | 11/2016 |
| WO | WO-2017058419 | A1 | 4/2017 |
| WO | WO-2018017890 | A1 | 1/2018 |
| WO | WO-2018017893 | A1 | 1/2018 |

OTHER PUBLICATIONS

United States Patent and Trademark Office Non-Final Office Action for U.S. Appl. No. 17/231,349 dated Jun. 15, 2021.

European Patent Office as the International Searching Authority, International Search Report and Written Opinion for Application No. PCT/US2016/030759, dated Jul. 12, 2016.

Stefanyshyn, D.J. et al., "Energy Aspects Associated with Sports Shoes," Sportverl Sportschad, vol. 14, pp. 82-89, Georg Thieme Verlag, Stuttgart, DE, 2000.

Stefanyshyn, D.J. et al., "Influence of a midsole bending stiffness on joint energy and jump height performance," Medicine & Science in Sports & Exercise, vol. 32, No. 2, pp. 471-476, American College of Sports Medicine, 2000.

Stefanyshyn, D.J. et al., "Mechanical Energy Contribution of the Metatarsophalangeal Join to Running and Sprinting," J. Biomechanics, vol. 30, Nos. 11-12, pp. 1081-1085, Elsevier Science Ltd, 1997.

Nigg, Benno M. et al., "Shoes Inserts and Orthotics for Sport and Physical Activities," Medicine & Science in Sports & Exercise, vol. 31, Issue 7, pp. S421-S428, Jul. 1999.

Roy, Jean-Pierre R. et al., "Shoes Midsole Longitudinal Bending Stiffness and Running Economy, Joint Energy, and EMG," Medicine & Science in Sports & Exercise, vol. 38, No. 3, pp. 562-569, American College of Sports Medicine, 2006.

European Patent Office as the International Searching Authority, International Search Report and Written Opinion for Application No. PCT/US2016/048859, dated Nov. 7, 2016.

European Patent Office as the International Searching Authority, International Search Report and Written Opinion for Application No. PCT/US2016/048854, dated Nov. 25, 2016.

(56) References Cited

OTHER PUBLICATIONS

European Patent Office as the International Searching Authority, International Search Report and Written Opinion for Application No. PCT/US2017/043170, dated Oct. 27, 2017.
European Patent Office as the International Searching Authority, International Search Report and Written Opinion for Application No. PCT/US2017/043164, dated Oct. 24, 2017.
European Patent Office as the International Searching Authority, International Search Report and Written Opinion for Application No. PCT/US2017/043160, dated Oct. 24, 2017.
European Patent Office as the International Searching Authority, International Search Report and Written Opinion for Application No. PCT/US2017/043167, dated Oct. 27, 2017.
European Patent Office (ISA), International Preliminary Report on Patentabilty for Application No. PCT/2017/043160, dated Jul. 24, 2018.
European Patent Office (ISA), International Preliminary Report on Patentabilty for Application No. PCT/2017/043164, dated Jul. 24, 2018.
European Patent Office (ISA), International Preliminary Report on Patentabilty for Application No. PCT/2017/043170, dated Jul. 24, 2018.
European Patent Office (ISA), International Preliminary Report on Patentabilty for Application No. PCT/2017/043167, dated Jul. 24, 2018.
United States Patent and Trademark Office, Office Action for U.S. Appl. No. 15/248,051, dated Dec. 10, 2018.
European Patent Office (ISA), International Preliminary Report on Patentability for International Application No. PCT/US2016/048854, dated Apr. 12, 2018.
European Patent Office (ISA), International Preliminary Report on Patentability for International Application No. PCT/US2016/048859, dated Apr. 12, 2018.
United States Patent and Trademark Office, Notice of Allowance for U.S. Appl. No. 15/574,933, dated Mar. 4, 2019.
United States Patent and Trademark Office, Non-Final Office Action for U.S. Appl. No. 15/574,912, dated Jun. 6, 2019.
Japan Patent Office, Notice of Reasons for Rejection for JP Application No. 2018-516734, dated Jun. 3, 2019.
Korean Intellectual Property Office, Office Action for KR Application No. 10-2018-7012450, dated Jun. 19, 2019.
Korean Intellectual Property Office, Office Action for KR Application No. 10-2018-7012449, dated Jun. 19, 2019.
European Patent Office (ISA), International Search Report and Written Opinion for PCT Application No. PCT/US2019/027470, dated Jul. 25, 2019.
European Patent Office (ISA), International Search Report and Written Opinion for PCT Application No. PCT/US2019/027480, dated Aug. 9, 2019.
Japan Patent Office, Notice of Reasons for Rejection for JP Application No. 2018-516733, dated Jun. 17, 2019.
United States Patent and Trademark Office, Office Action for U.S. Appl. No. 15/248,059, dated Jun. 6, 2018.
United States Patent and Trademark Office, Office Action for U.S. Appl. No. 16/318,735, dated Jul. 9, 2019.
Japan Patent Office, Notice of Reasons for Rejection for JP Application No. 2018-516734, dated Dec. 10, 2019.
United States Patent and Trademark Office, Notice of Allowance and Fee(s) Due for U.S. Appl. No. 16/384,154, dated Jan. 21, 2020.
United States Patent and Trademark Office, Non-Final Office Action for U.S. Appl. No. 15/904,664, dated Jan. 2, 2020.
United States Patent and Trademark Office, Non-Final Office Action for U.S. Appl. No. 15/248,051, dated Jan. 2, 2020.
United States Patent and Trademark Office, Notice of Allowance and Fee(s) Due for U.S. Appl. No. 15/904,568, dated Dec. 10, 2019.
Korean Intellectual Property Office, Office Action for Application No. 10-2019-7004900, dated Feb. 17, 2020.
Korean Intellectual Property Office, Office Action for Application No. 10-2018-7012450, dated Jan. 30, 2020.
United States Patent and Trademark Office, Non-Final Office Action for U.S. Appl. No. 15/248,051, dated May 15, 2018.
"Youngs Modulus is a Measure of Stiffness". ChristineDeMerchant.com. URL=https://www.christinedemerchant.com/youngsmodulus.html. Accessed Dec. 4, 2018. (Year: 2012).
United States Patent and Trademark Office, Non-Final Office Action for U.S. Appl. No. 15/248,059, dated Jun. 6, 2018.
Japan Patent Office, Notice of Reasons for Rejection for JP Application No. 2018-516733, dated Feb. 28, 2020.
European Patent Office, Communication pursuant to Article 94(3) EPC for EP Application No. 16760309.1, dated Mar. 5, 2020.
Korean Intellectual Property Office, Office Action for Application No. 10-2019-7004898, dated Feb. 17, 2020.
Korean Intellectual Property Office, Office Action for Application No. 10-2019-7004899, dated Feb. 17, 2020.
Korean Intellectual Property Office, Office Action for Application No. 10-2018-7012449, dated Feb. 24, 2020.
China National Intellectual Property Administration, Notification of the First Office Action and Search Report for No. 201680064966.9, dated Mar. 27, 2020.
China National Intellectual Property Administration, Notification of the First Office Action and Search Report for No. 201680064951.2, dated Mar. 27, 2020.
CompositesWord. "Composites 101: Fibers and resins". URL=https://www.compositesworld.com/articles/composites-101-fibers-and-resins. Accessed Jun. 5, 2020. Published Mar. 14, 2016. (Year 2016).
United States Patent and Trademark Office, Non-Final Office Action for U.S. Appl. No. 15/905,036, dated Jun. 10, 2020.
Japan Patent Office, Notice of Reasons for Rejection for JP Application No. 2018-516734, dated Aug. 4, 2020.
China National Intellectual Property Administration, Notification of First Office Action for CN Application No. 201780044388.7, dated Jun. 30, 2020.
China National Intellectual Property Administration, Notification of First Office Action for CN Application No. 201780044468.2, dated Jul. 1, 2020.
United States Patent and Trademark Office, Non-Final Office Action for U.S. Appl. No. 17/231,617 dated Oct. 4, 2021.
Japanese Patent Office, Office Action for Application No. 2020-180295 dated Nov. 16, 2021.
China National Intellectual Property Administration, Second Office Action for application No. 201980007331.9 dated Nov. 25, 2021.
United States Patent and Trademark Office, Non-Final Office Action for U.S. Appl. No. 16/383,116, dated Sep. 18, 2020.
United States Patent and Trademark Office, Final Office Action for U.S. Appl. No. 16/383,116, dated Jan. 27, 2021.
United States Patent and Trademark Office, Non-Final Office Action for U.S. Appl. No. 16/383,116, dated Jun. 16, 2021.
Mexico Patent Office, Office Action for application No. MX/a/2018/004048 dated Jul. 27, 2021.
Japan Patent Office, Office Action for application No. 2020-180295 dated Nov. 16, 2021.
Jeff Sloan, "Composites 101: Fibers and Resins". Composites World, Available at: URL=https://www.connpositesworld.conn/articles/connposites-101-fibers-and-resins, Accessed Jun. 5, 2020, Published Mar. 14, 2016.
United States Patent and Trademark Office, Non-Final Office Action for U.S. Appl. No. 16/718,340 dated Jun. 6, 2022.
China Patent Office, Second Office Action for CN Application No. 202110225763.6 dated Jun. 15, 2022.
China National Intellectual Property Administration, First Office Action for application No. 202110857378.3 dated May 6, 2022.
China National Intellectual Property Administration, First Office Action for application No. 202110857946.X dated May 7, 2022.
China National Intellectual Property Administration, Second Office Action for Application No. 202110533408.5 dated Jul. 12, 2022.
European Patent Office, Extended European Patent Search Report for 21200615.9 dated Feb. 14, 2022.
United States Patent and Trademark Office, Non-Final Office Action for U.S. Appl. No. 17/231,274 dated Jul. 5, 2022.

(56) References Cited

OTHER PUBLICATIONS

United States Patent and Trademark Office, Non-Final Office Action for U.S. Appl. No. 16/992,063, dated Jul. 25, 2022.

* cited by examiner

PLATE WITH FOAM FOR FOOTWEAR

CROSS REFERENCE TO RELATED APPLICATIONS

This application is a continuation of U.S. Non-provisional application Ser. No. 16/548,170, filed Aug. 22, 2019, which is a continuation of U.S. Non-provisional application Ser. No. 15/248,059, filed Aug. 26, 2016, which claims priority to U.S. Provisional Application Ser. No. 62/236,649, filed Oct. 2, 2015, and to U.S. Provisional Application Ser. No. 62/308,626, filed Mar. 15, 2016, the contents of which are hereby incorporated by reference in their entirety.

TECHNICAL FIELD

The present disclosure relates to articles of footwear including sole structures with footwear plates and foam for improving efficiency in the performance of the footwear during running motions.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhancing traction with the ground surface. Another layer of the sole structure includes a midsole disposed between the outsole and the upper. The midsole provides cushioning for the foot and is generally at least partially formed from a polymer foam material that compresses resiliently under an applied load to cushion the foot by attenuating ground-reaction forces. The midsole may define a bottom surface on one side that opposes the outsole and a footbed on the opposite side that may be contoured to conform to a profile of the bottom surface of the foot. Sole structures may also include a comfort-enhancing insole or a sockliner located within a void proximate to the bottom portion of the upper.

The metatarsophalangeal (MTP) joint of the foot is known to absorb energy as it flexes through dorsiflexion during running movements. As the foot does not move through plantarflexion until the foot is pushing off of a ground surface, the MTP joint returns little of the energy it absorbs to the running movement and, thus, is known to be the source of an energy drain during running movements. Embedding flat and rigid plates having longitudinal stiffness within a sole structure is known to increase the overall stiffness thereof. While the use of flat plates stiffens the sole structure for reducing energy loss at the MTP joint by preventing the MTP joint from absorbing energy through dorsiflexion, the use of flat plates also adversely increases a mechanical demand on ankle plantarflexors of the foot, thereby reducing the efficiency of the foot during running movements, especially over longer distances.

DRAWINGS

The drawings described herein are for illustrative purposes only of selected configurations and are not intended to limit the scope of the present disclosure.

Figure 10:
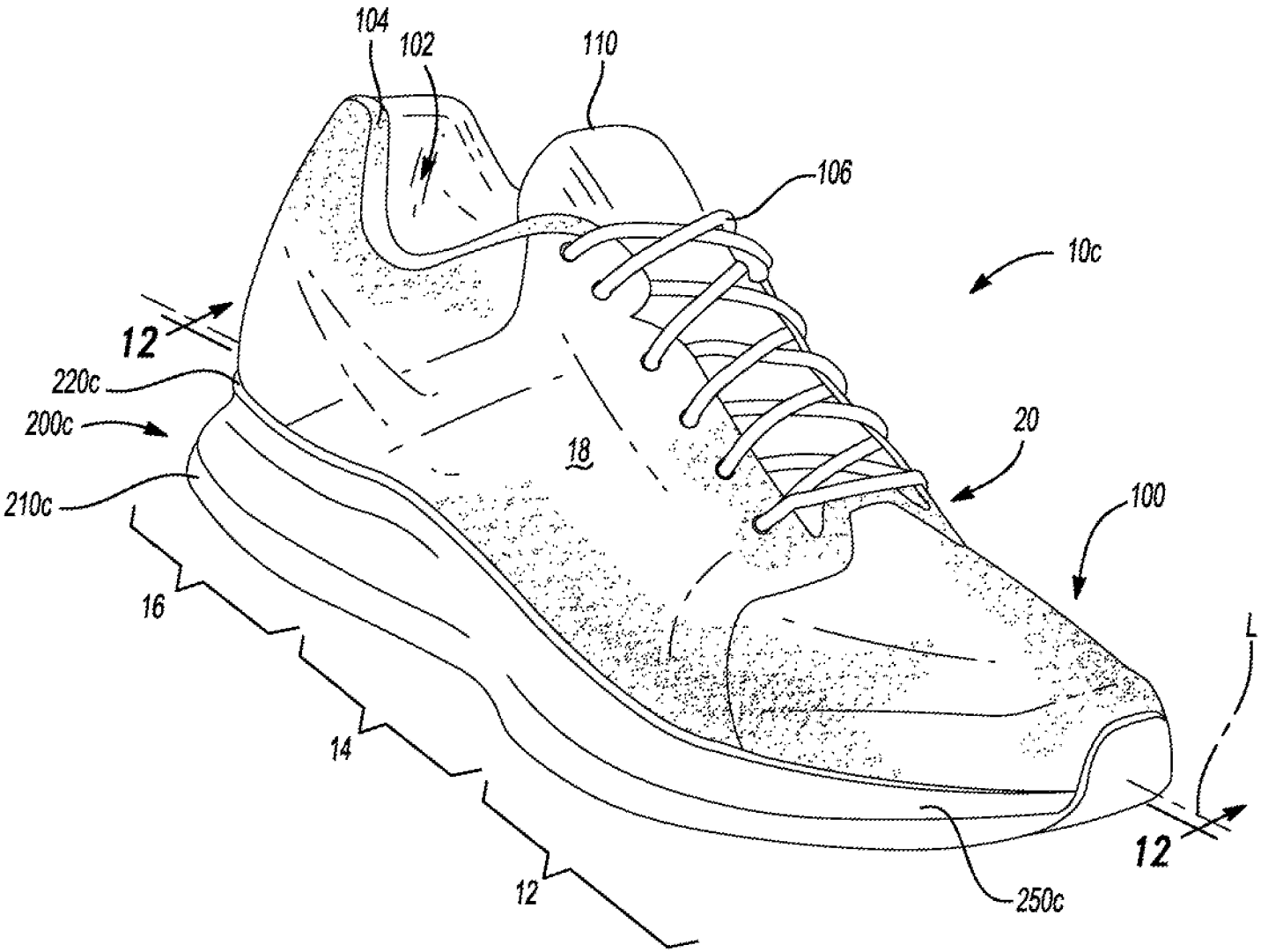
FIG. 10 is a top perspective view of an article of footwear in accordance with principles of the present disclosure.
Figure 12:
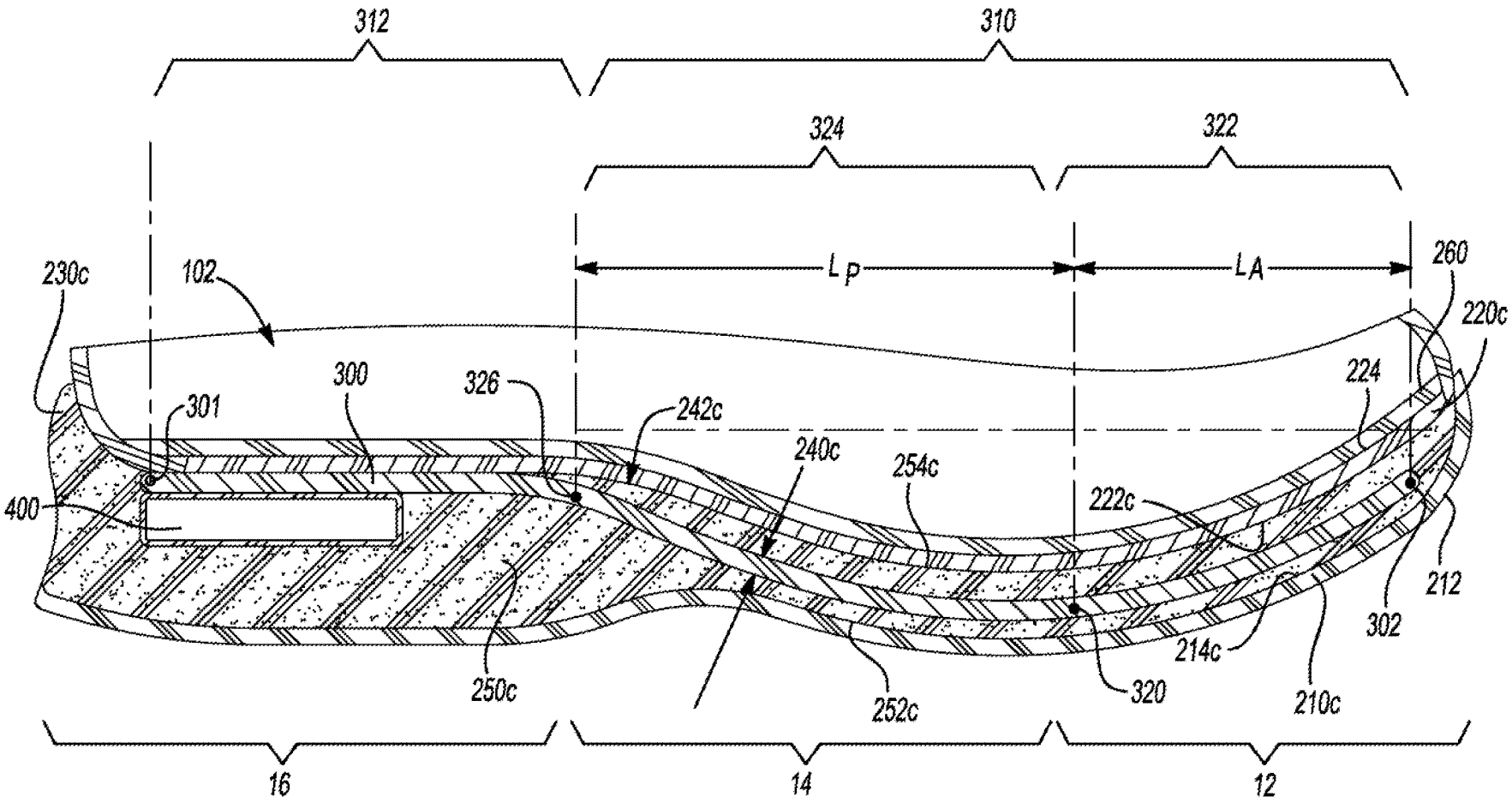
Figure 13:
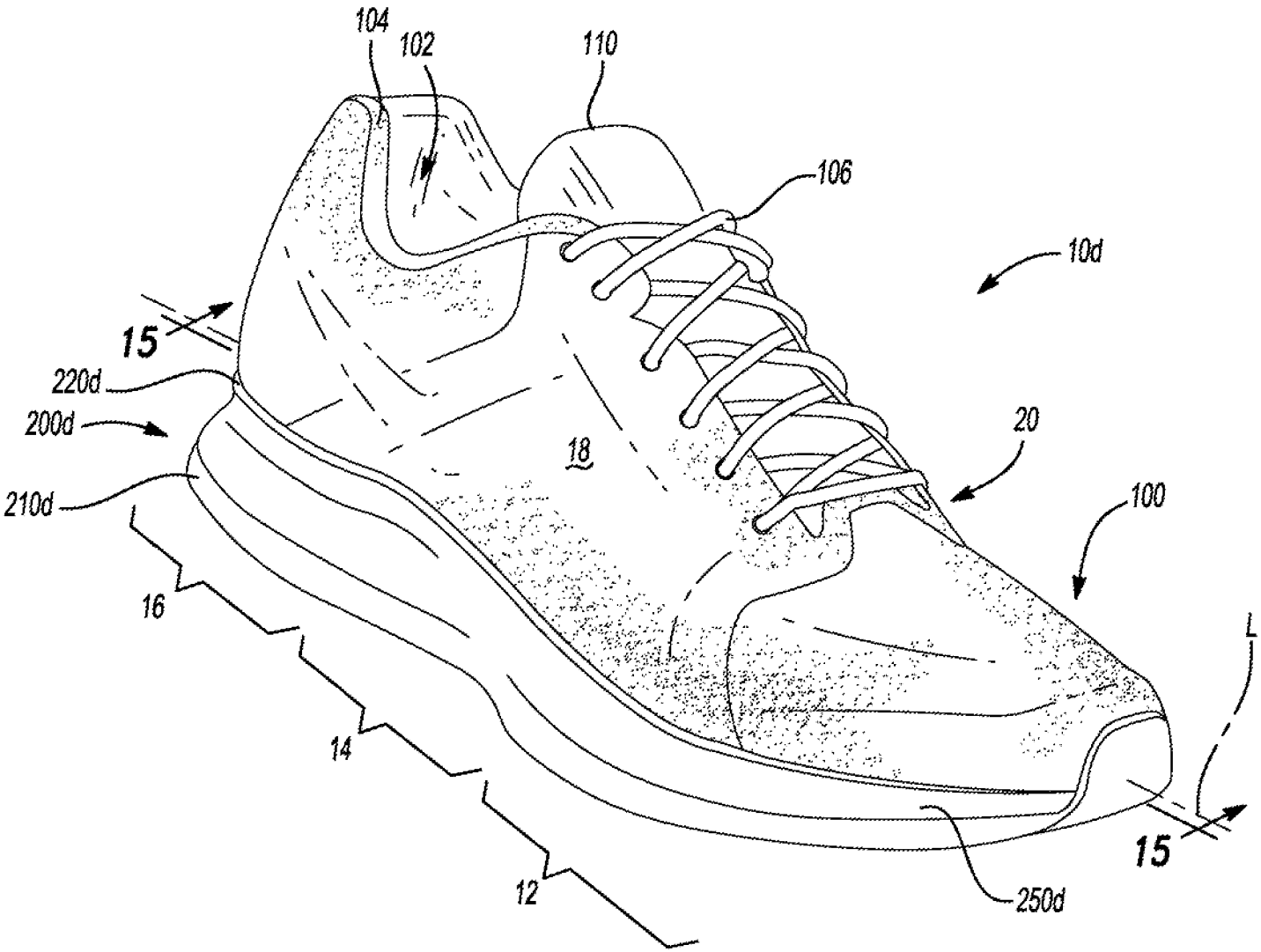
Figure 14:
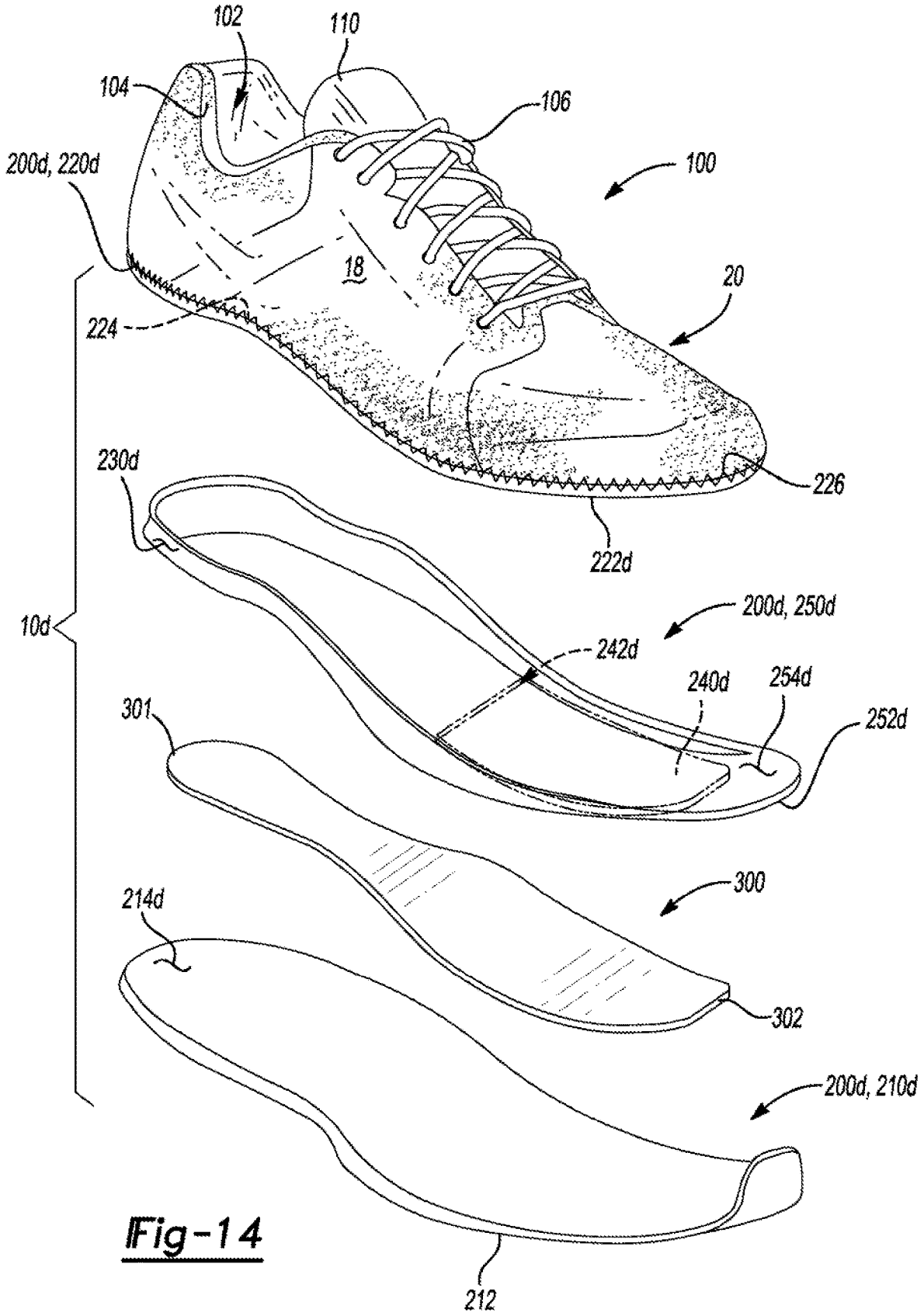
Figure 15:
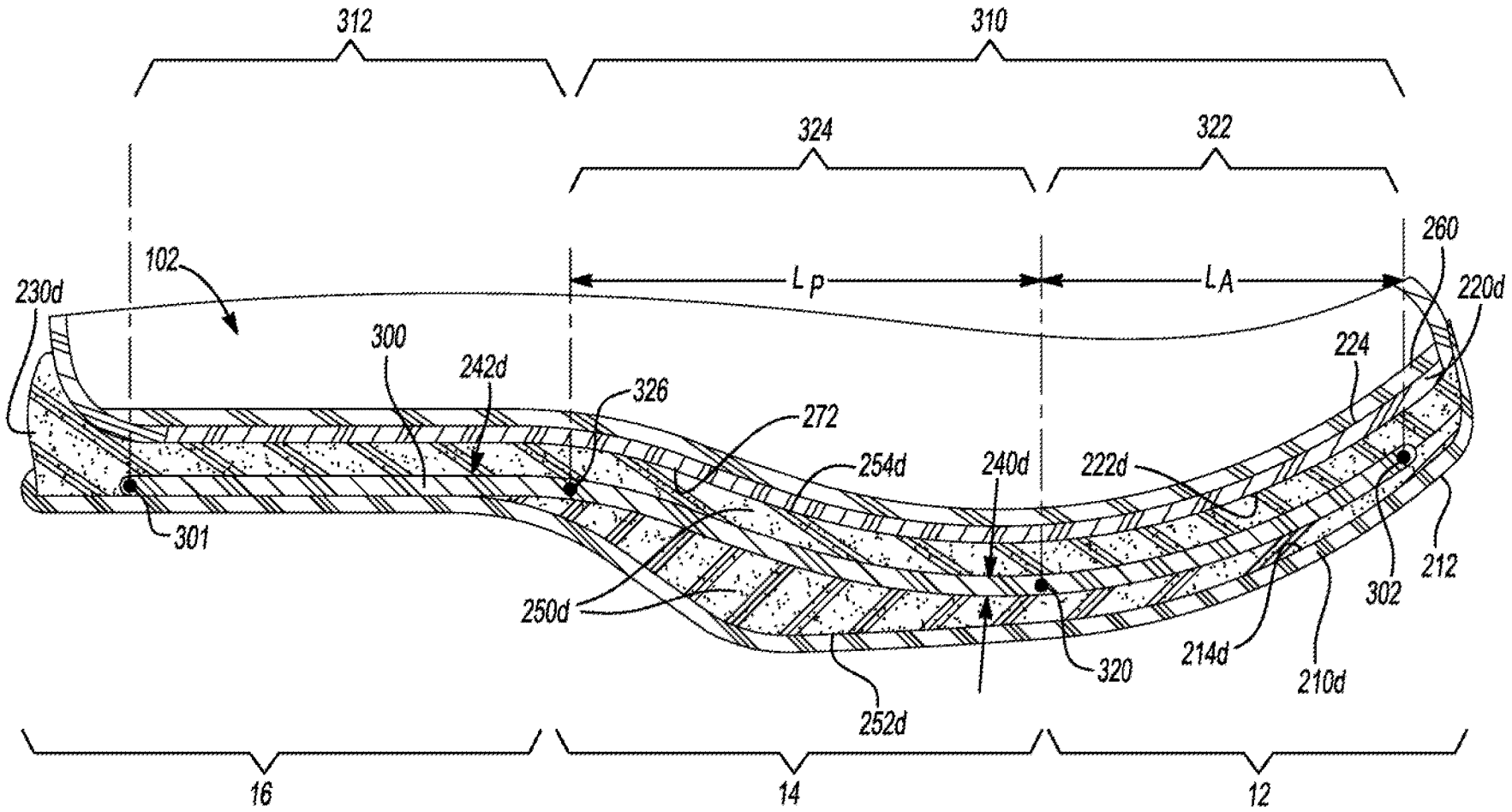
Figure 16:
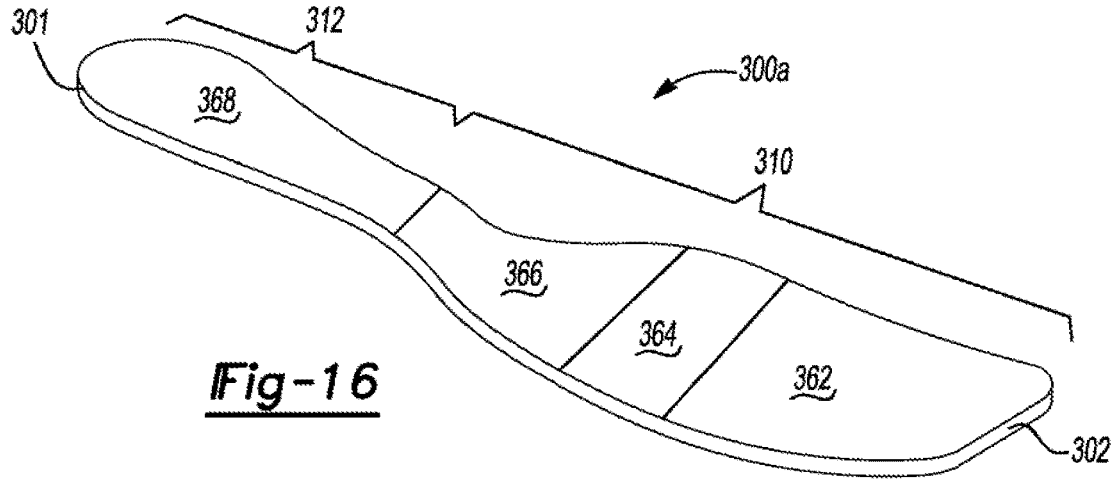
Figure 17:
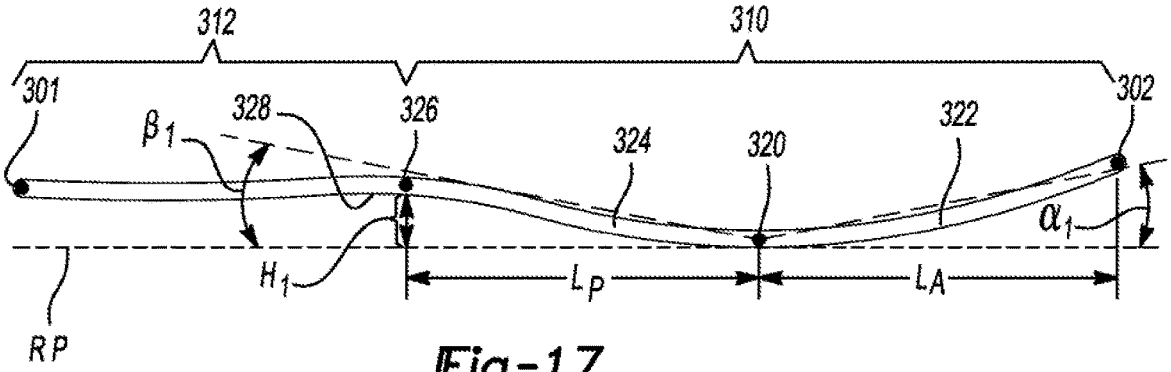
Figure 18:
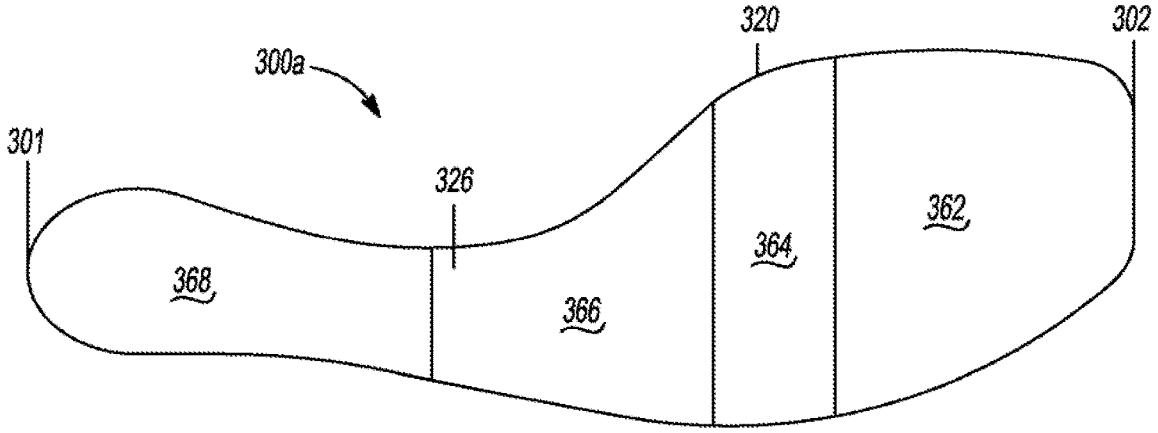
Figure 19:
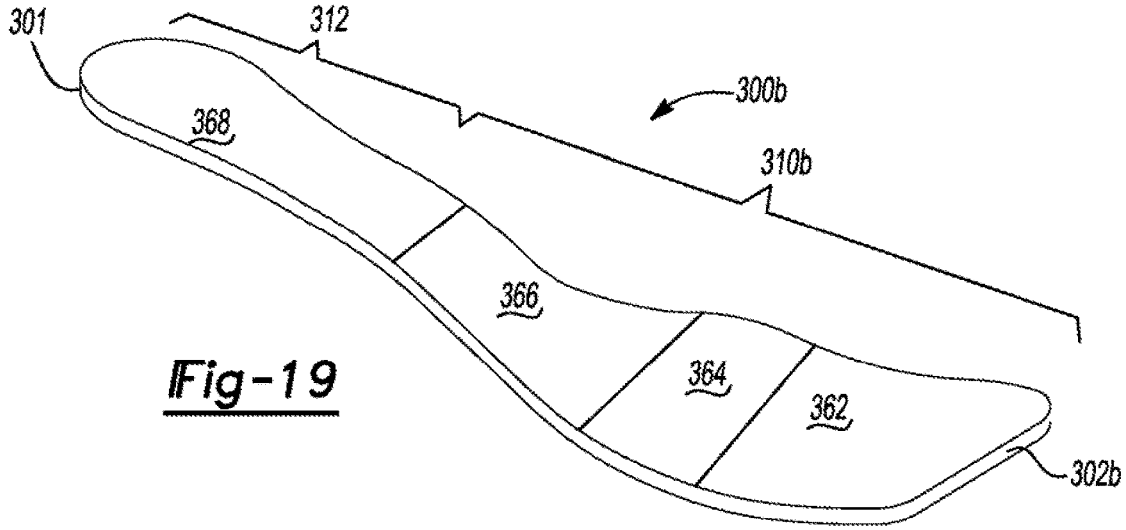
Figure 20:
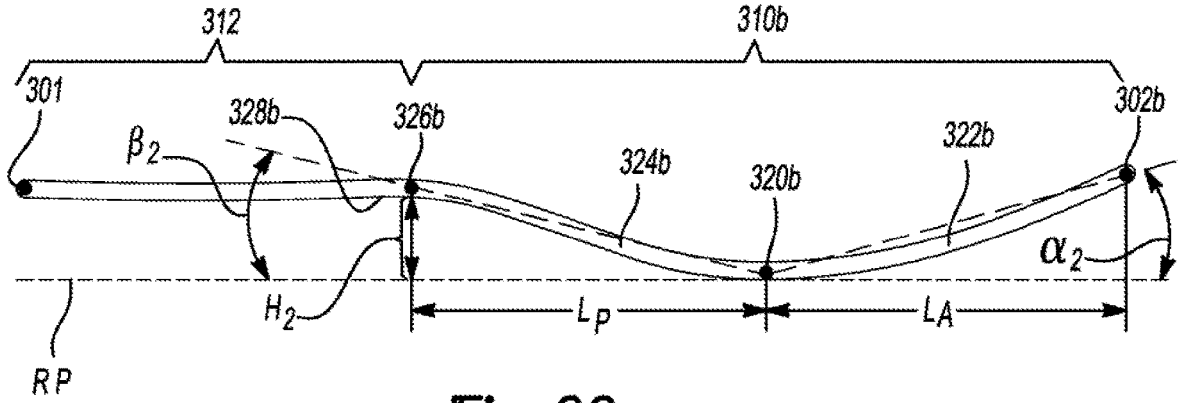
Figure 21:
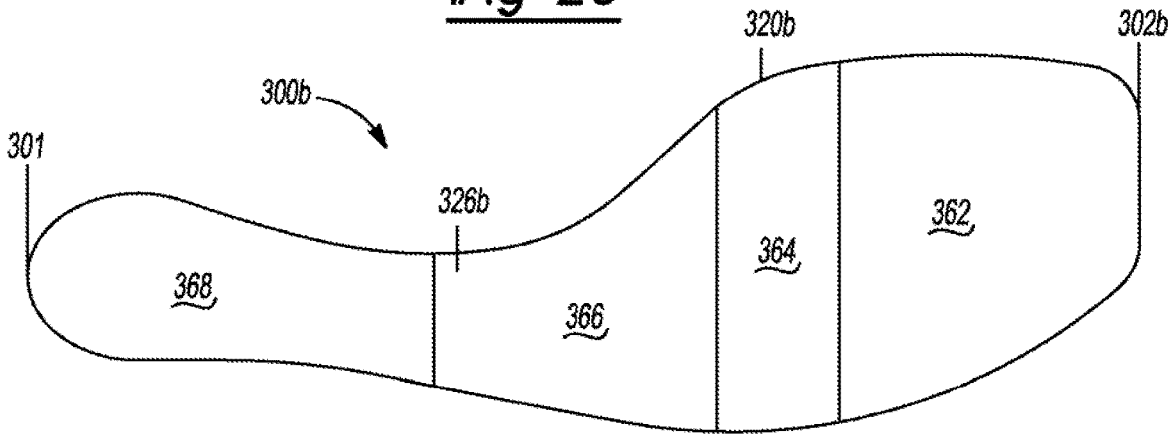
Figure 22:
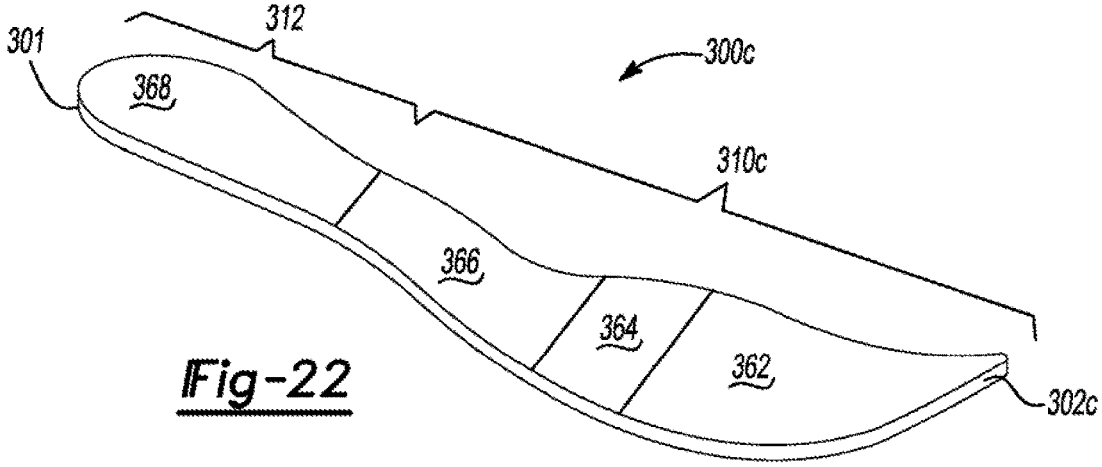
Figure 23:
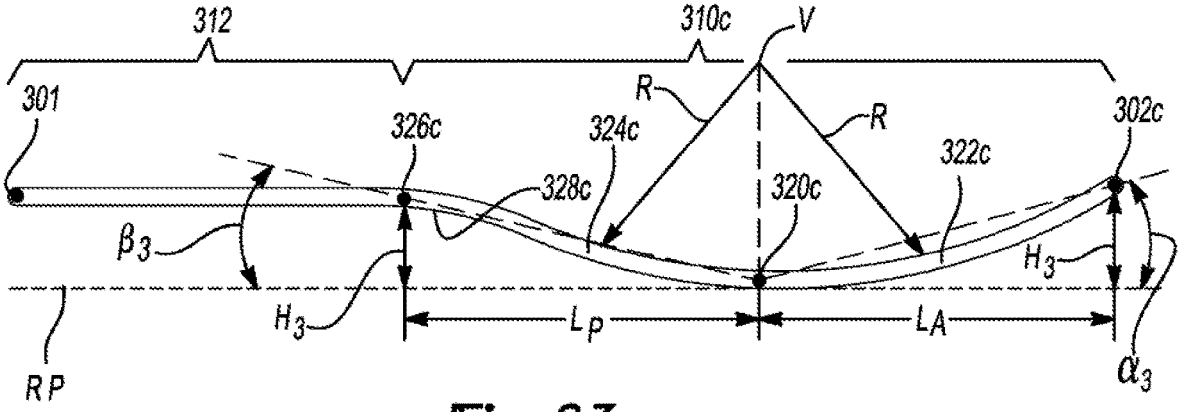
Figure 24:
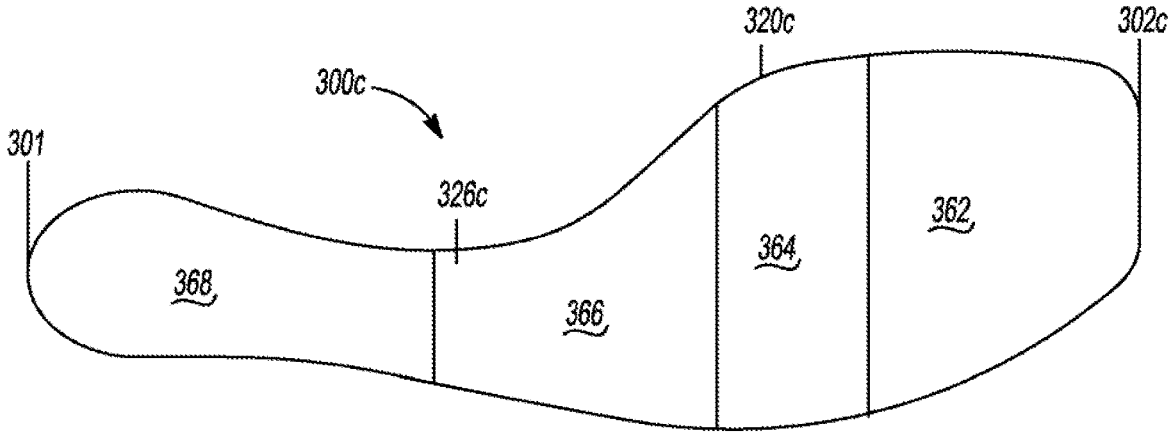
Figure 25:
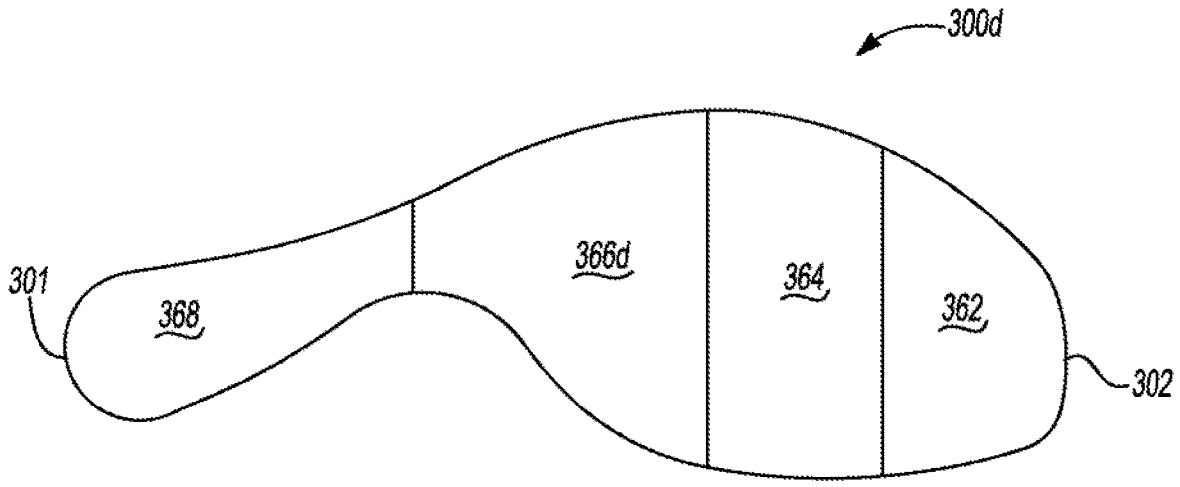
Figure 26:
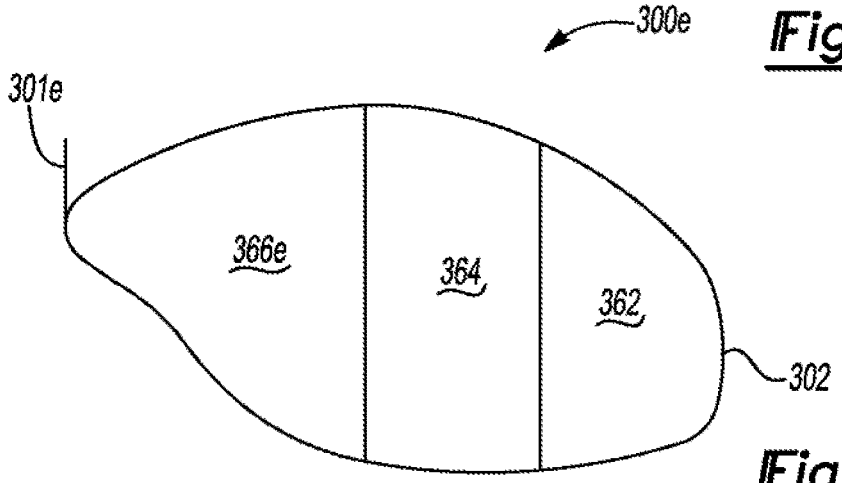
Figure 27:
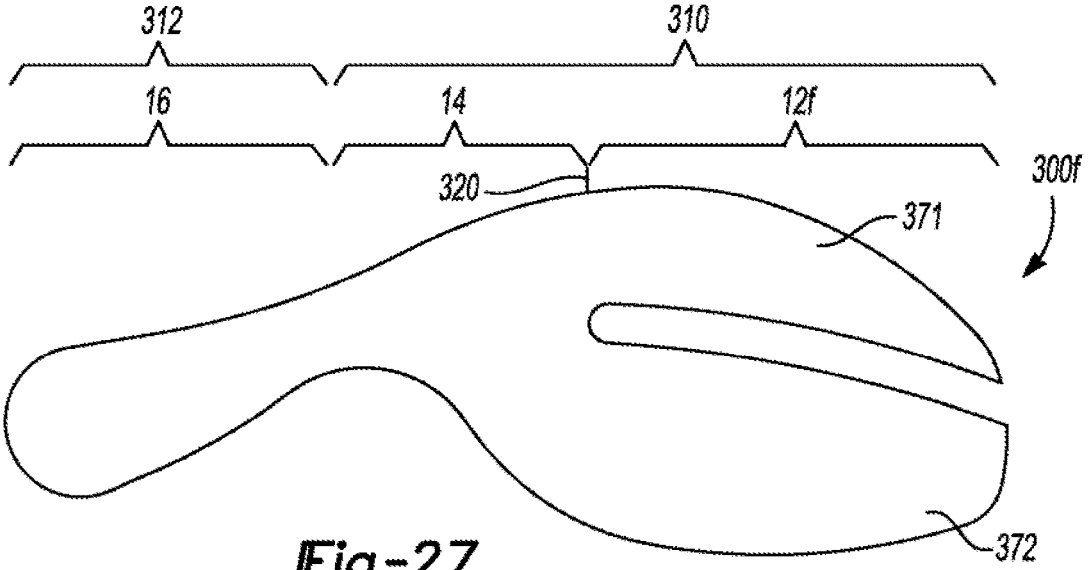
Figure 28:
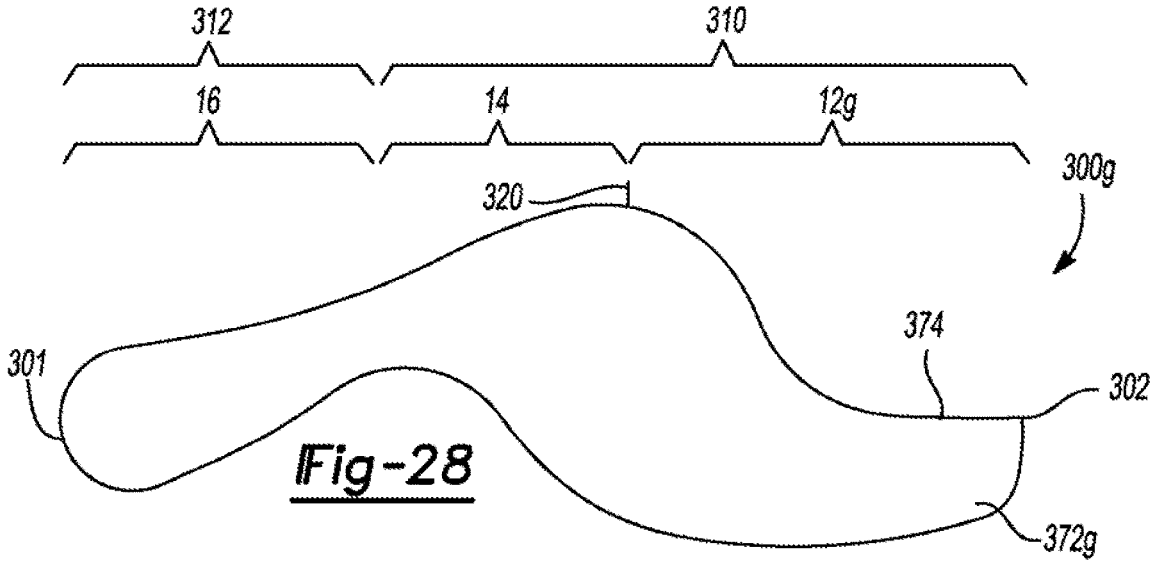
Figure 29:
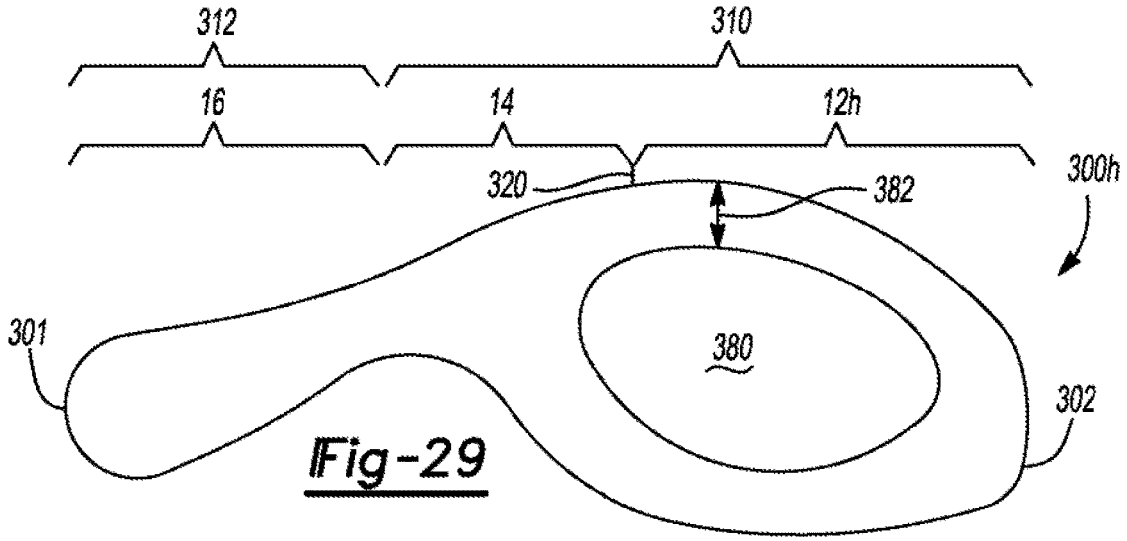
Figure 30:
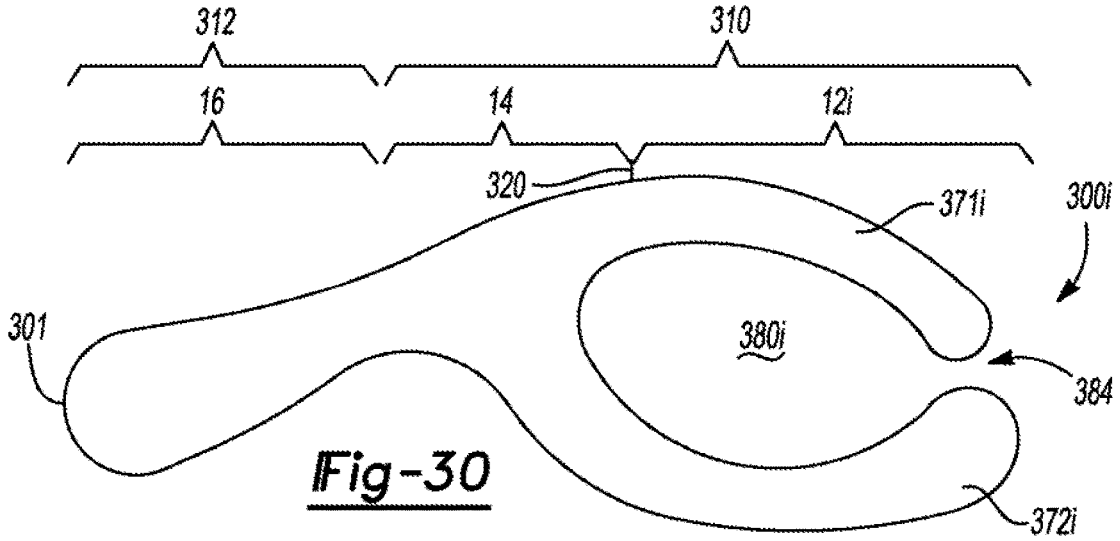
Figure 31:
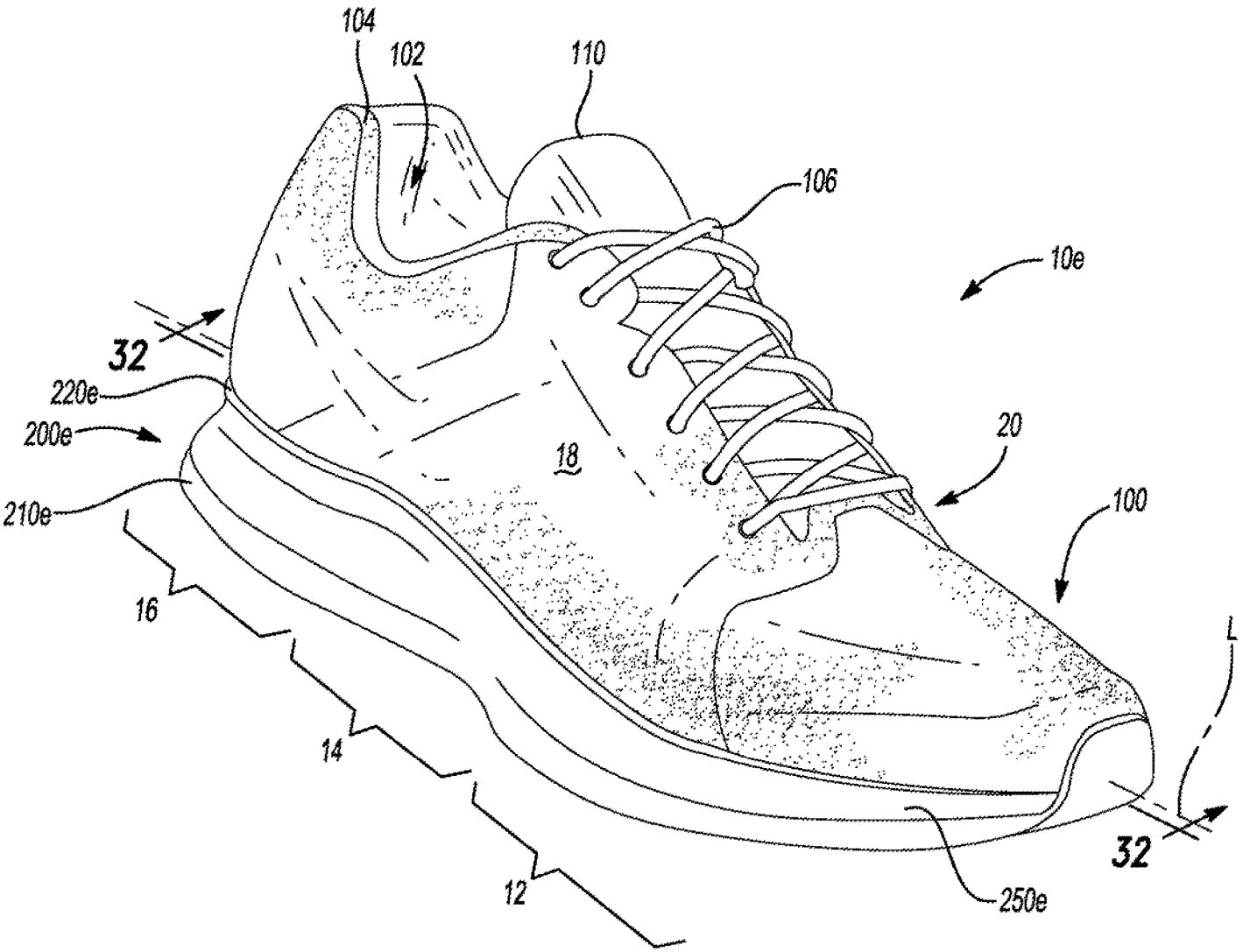
Figure 32:
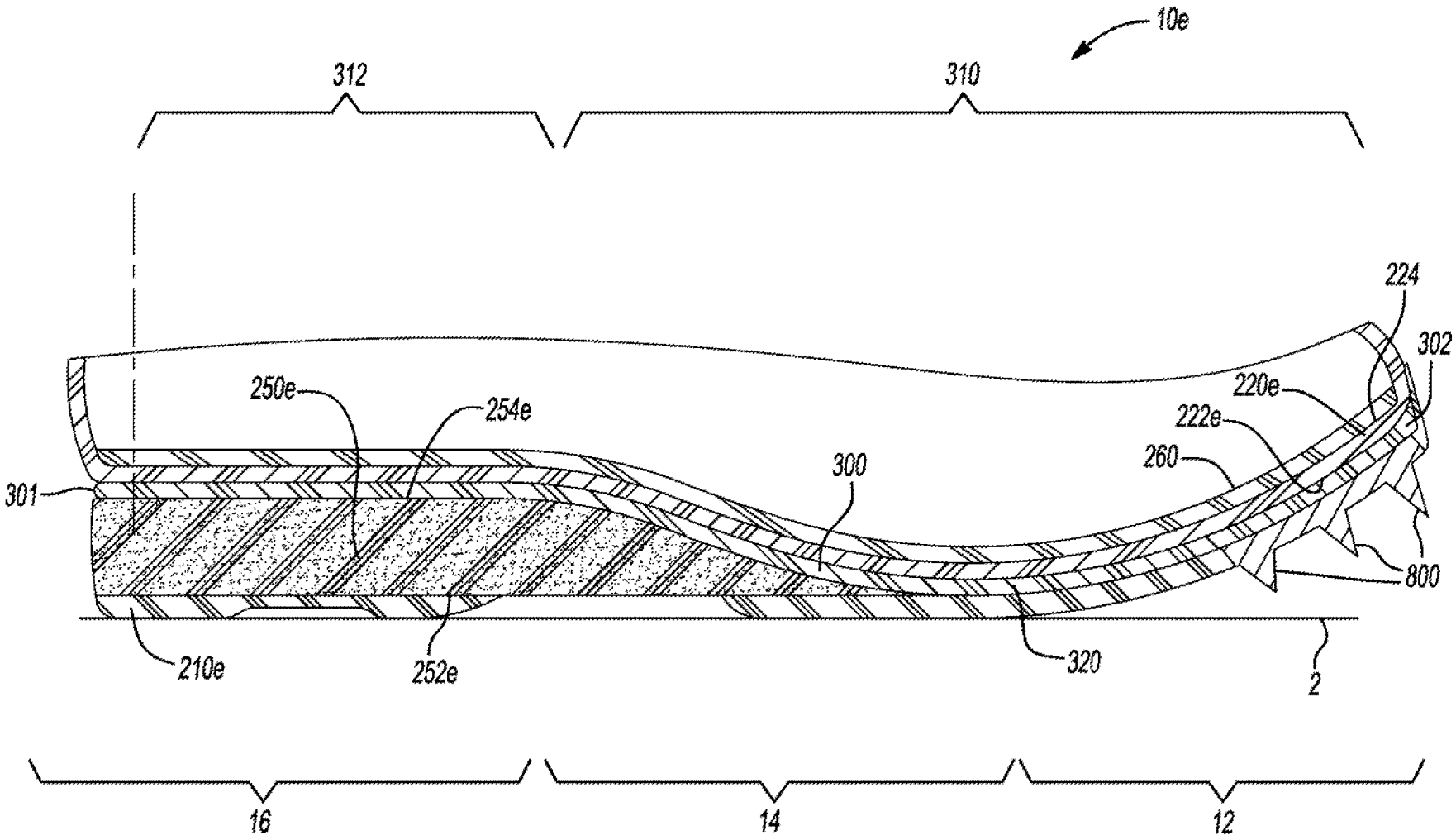
Figure 33:
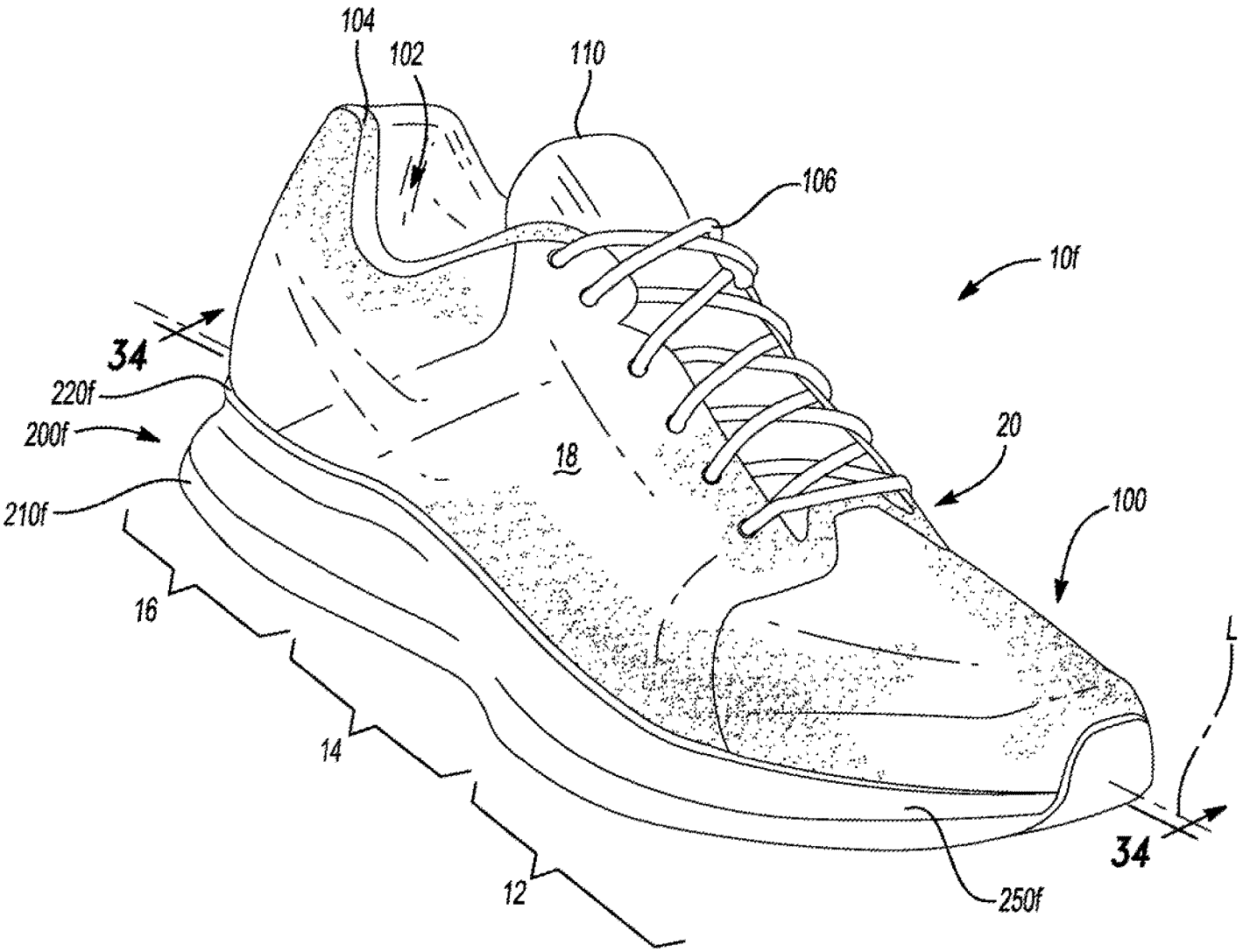
Figure 34:
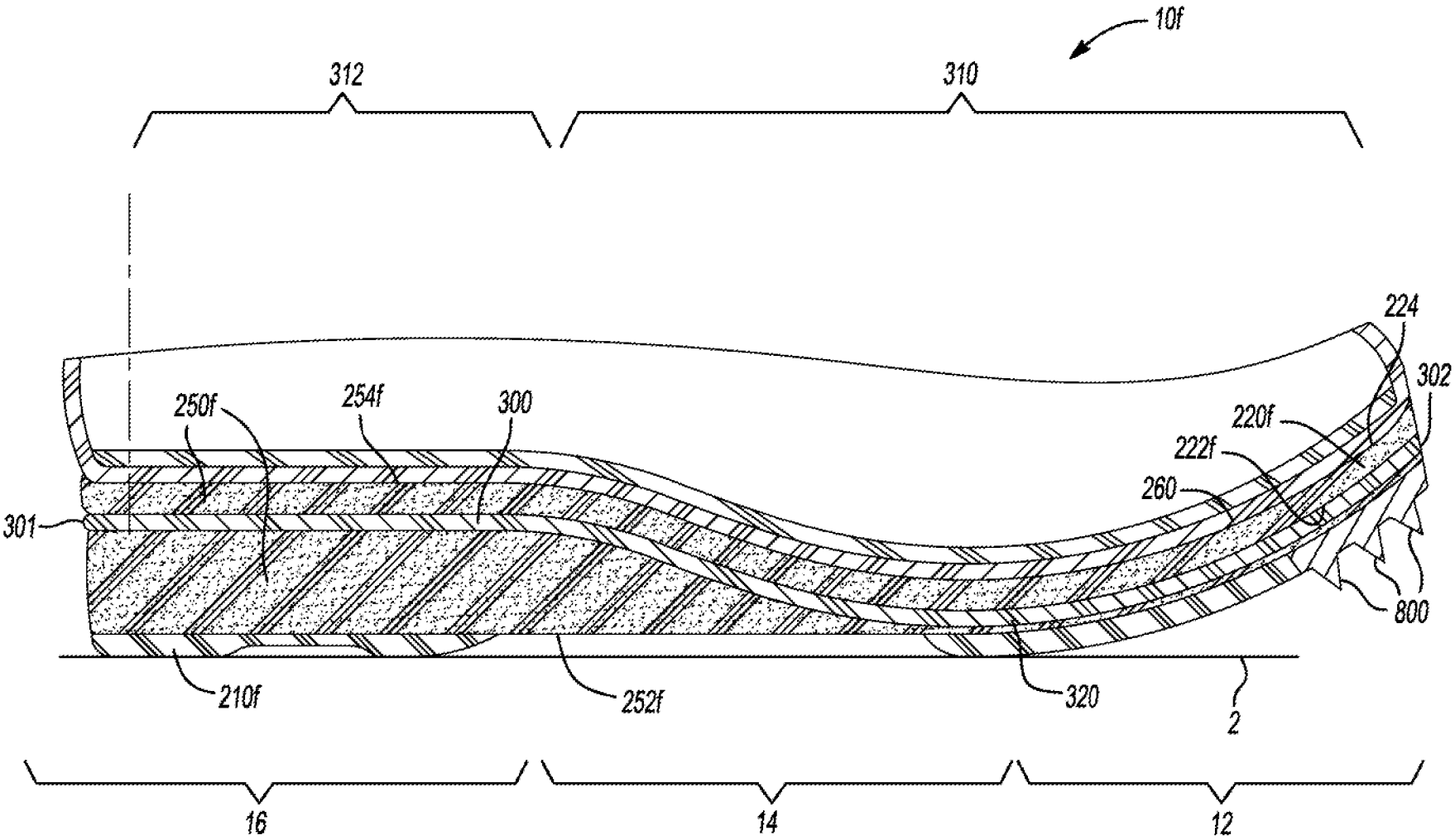
Figure 35:
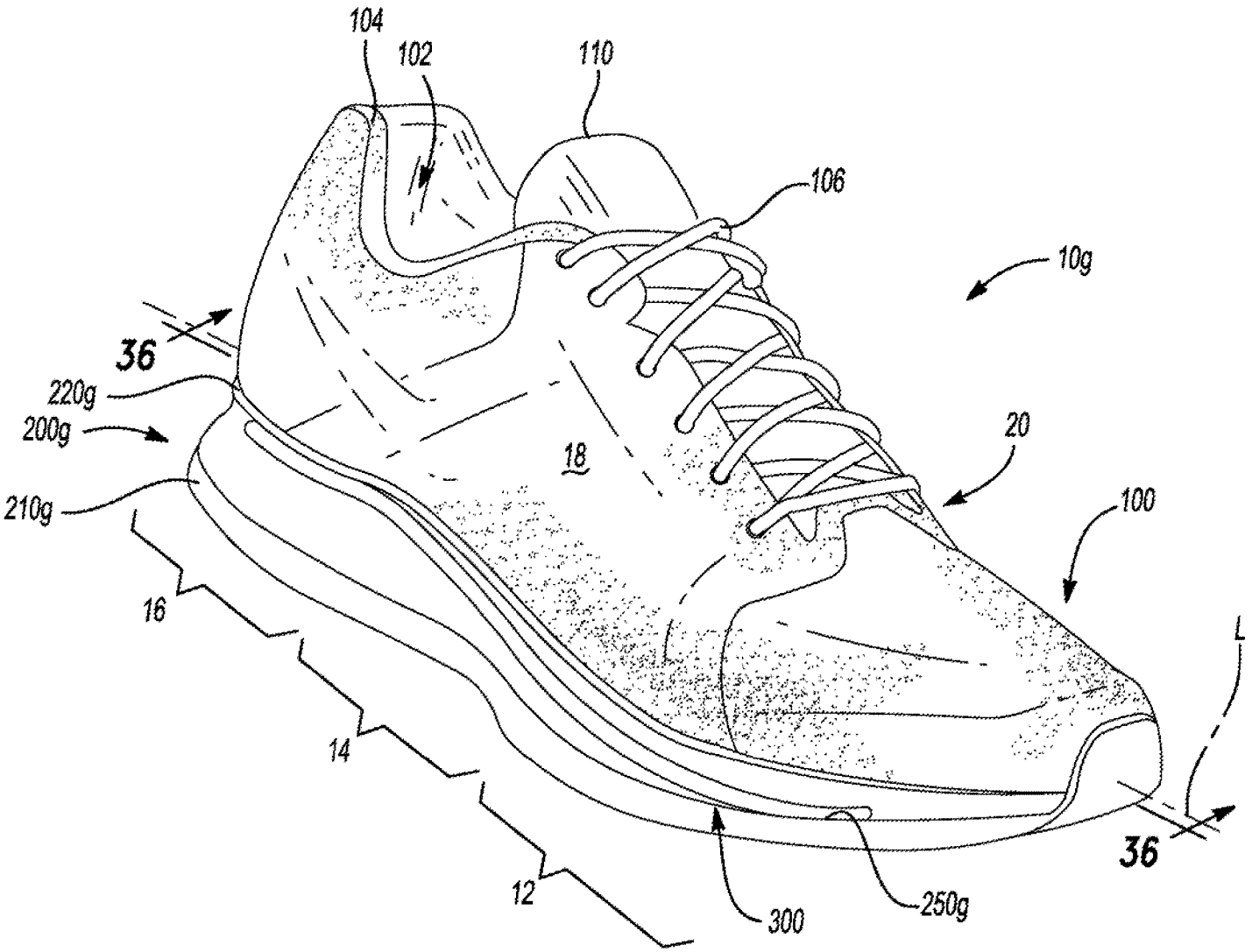
Figure 36:
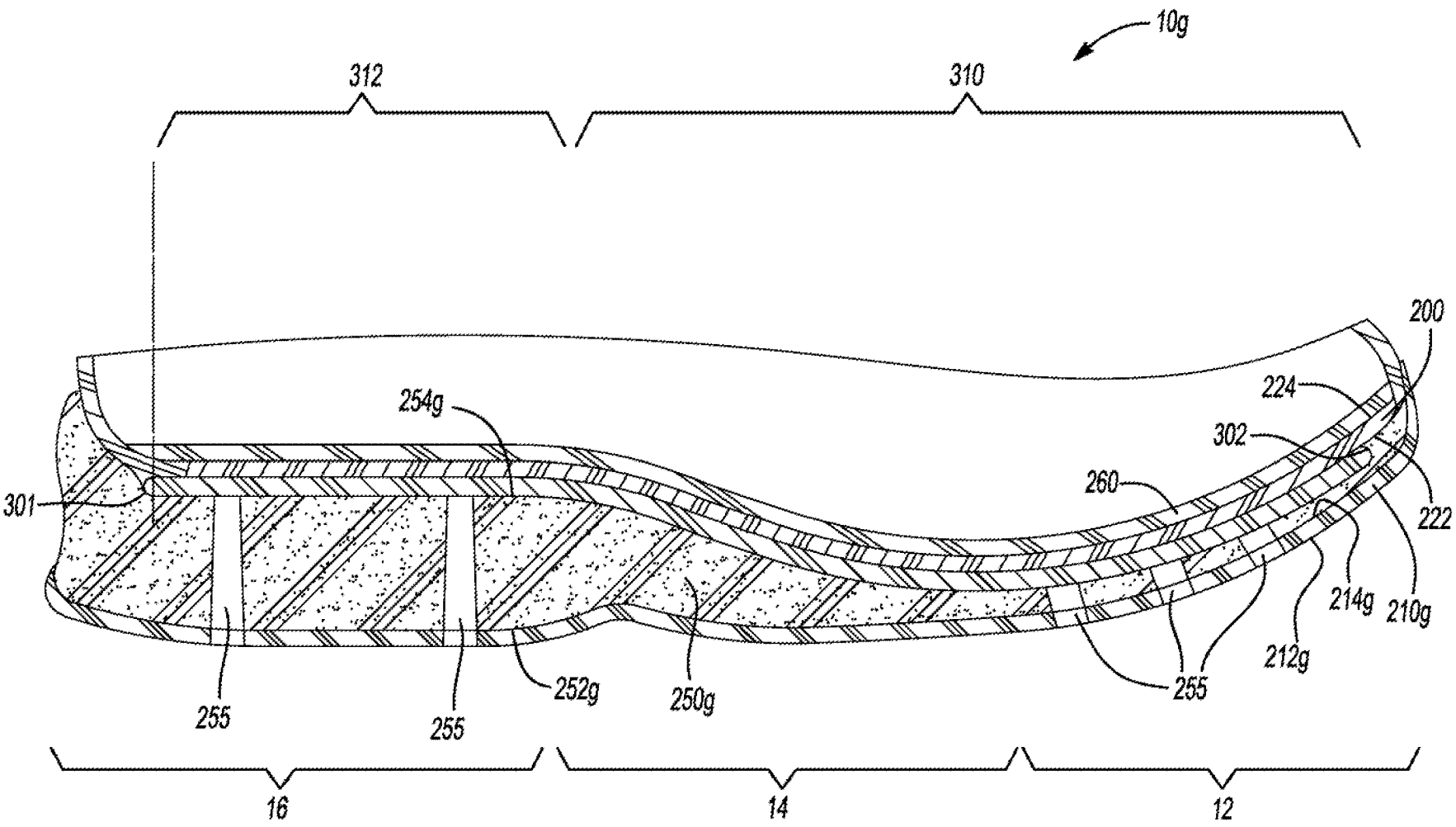
Figure 37:
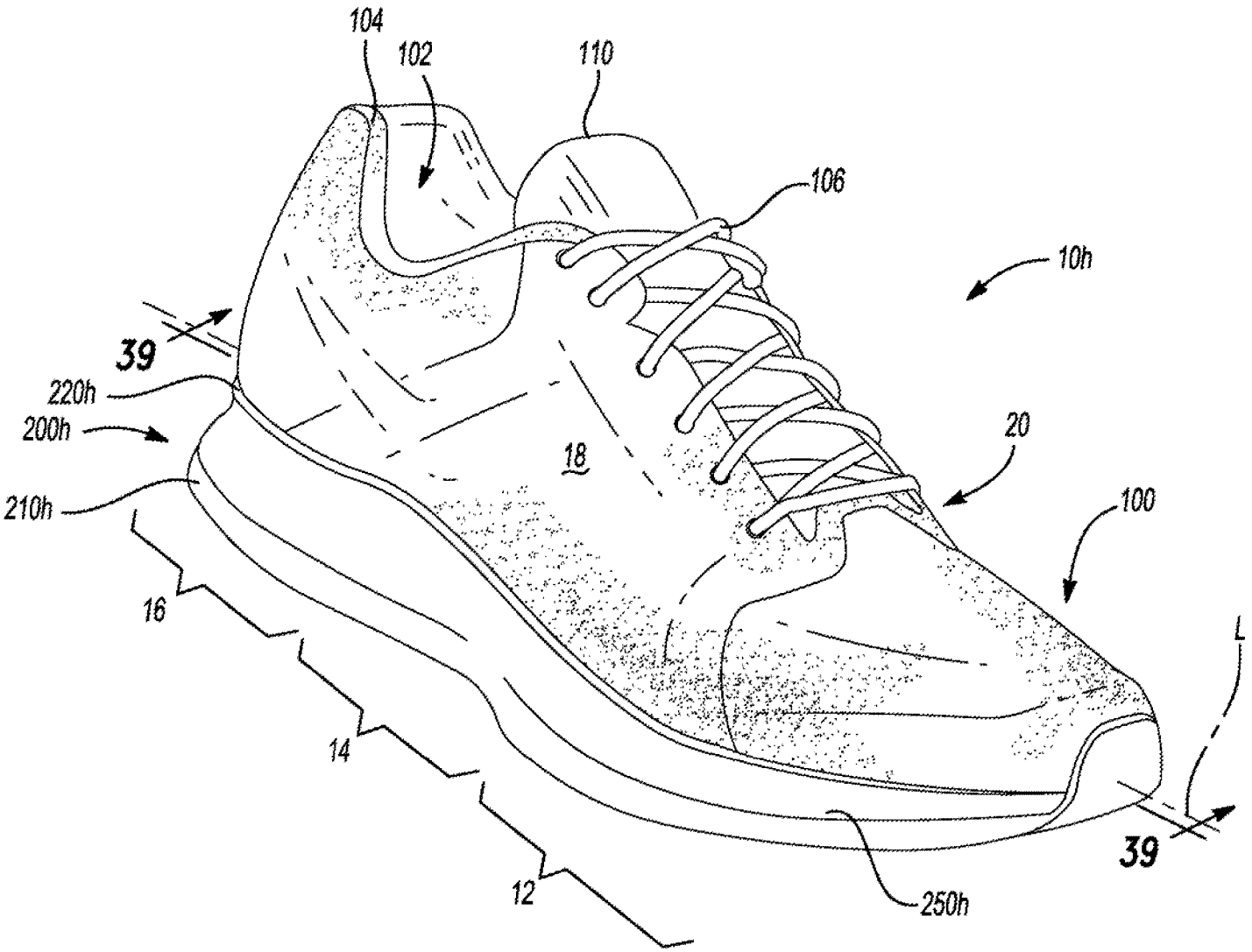
Figure 38:
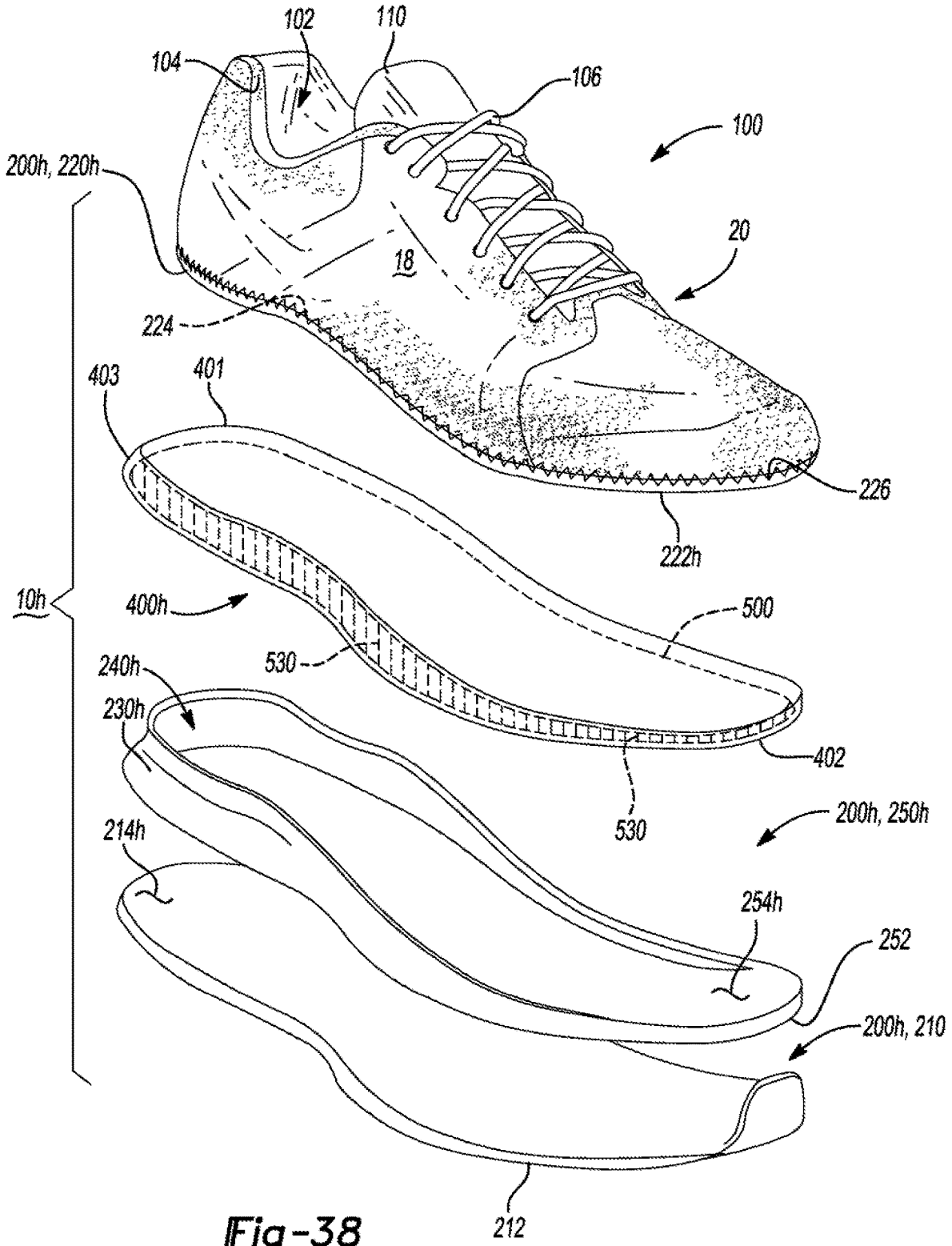
Figure 39:
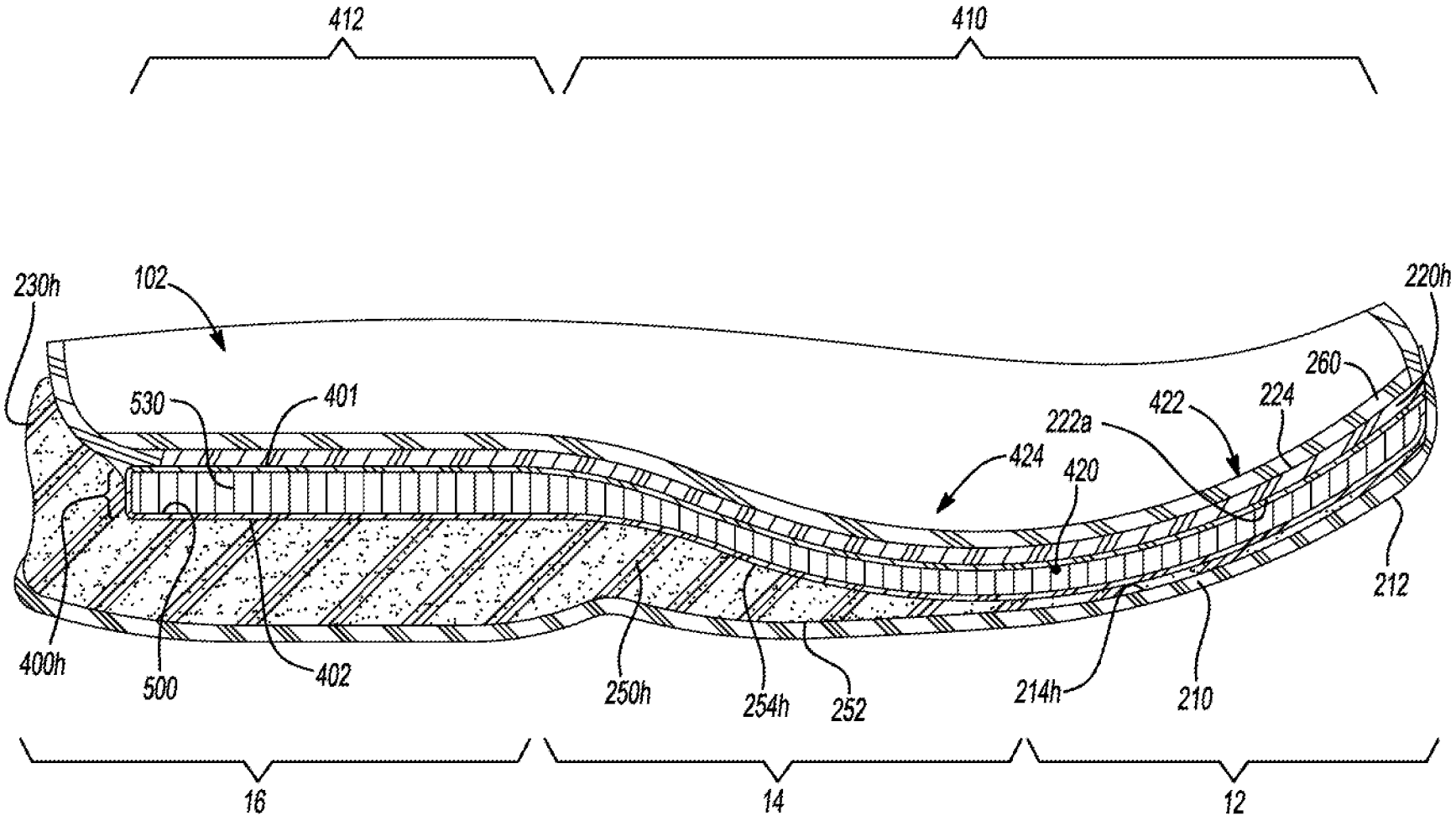
Figure 41:
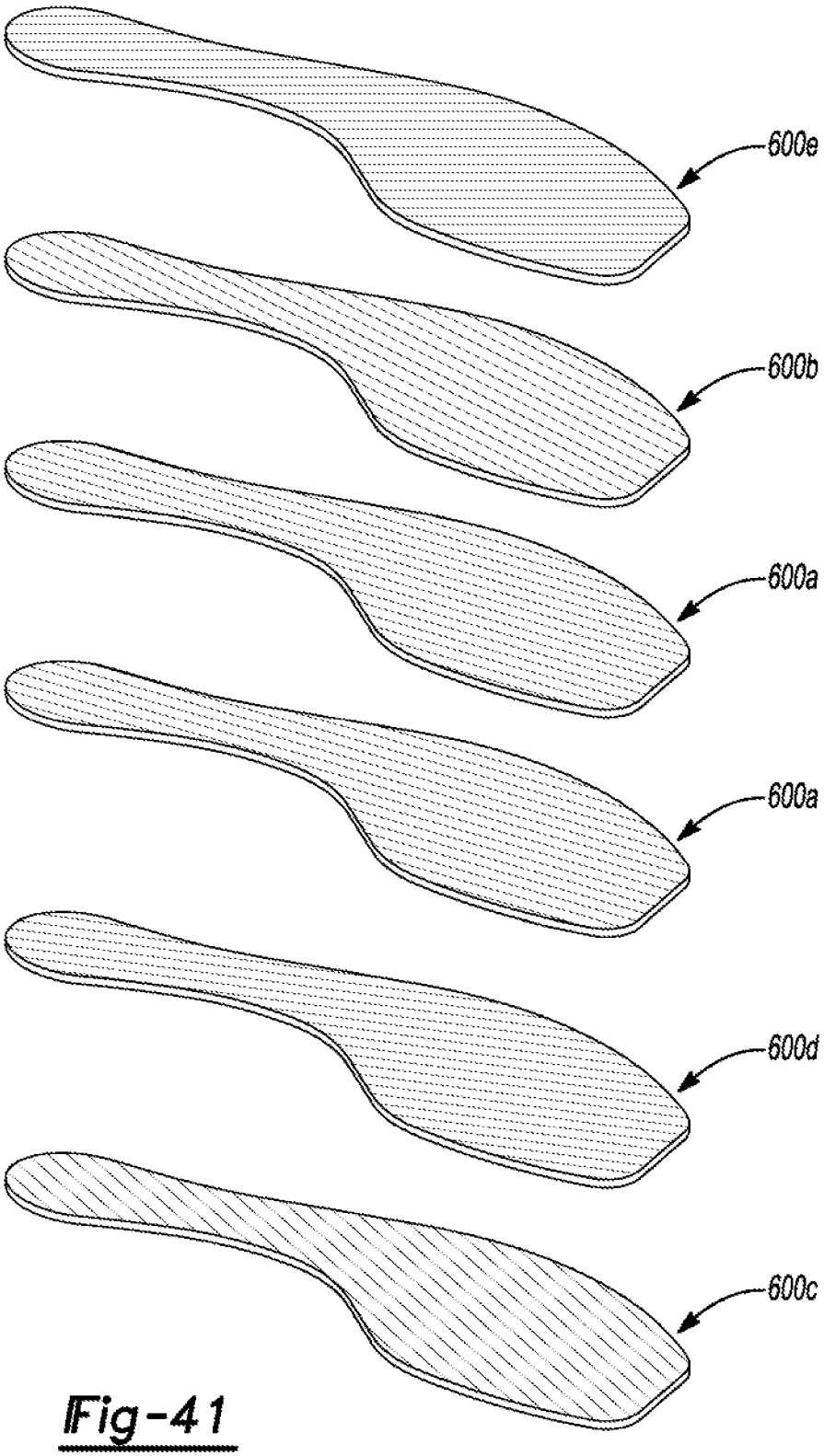
Figure 42C:
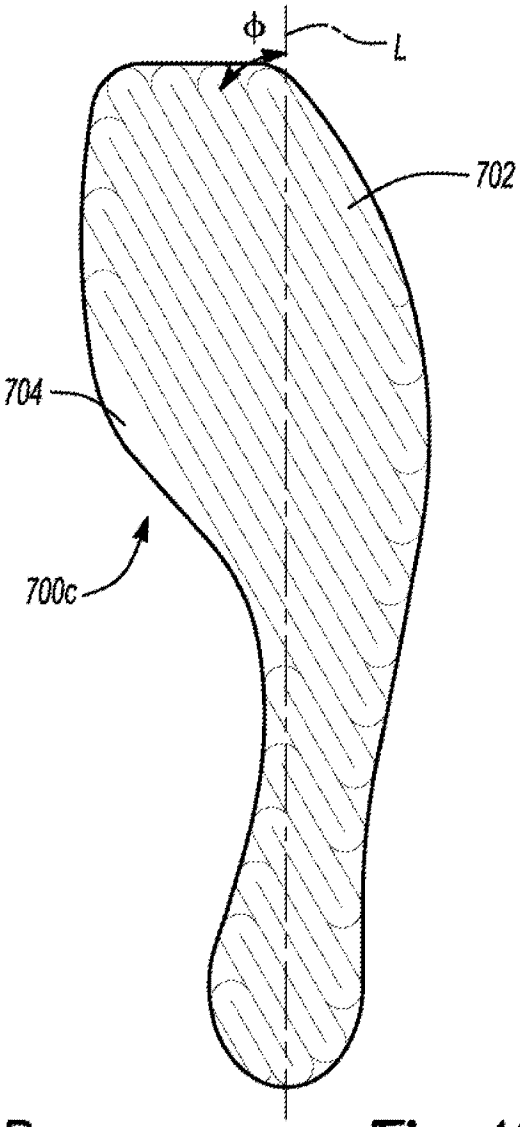
Figure 42B:
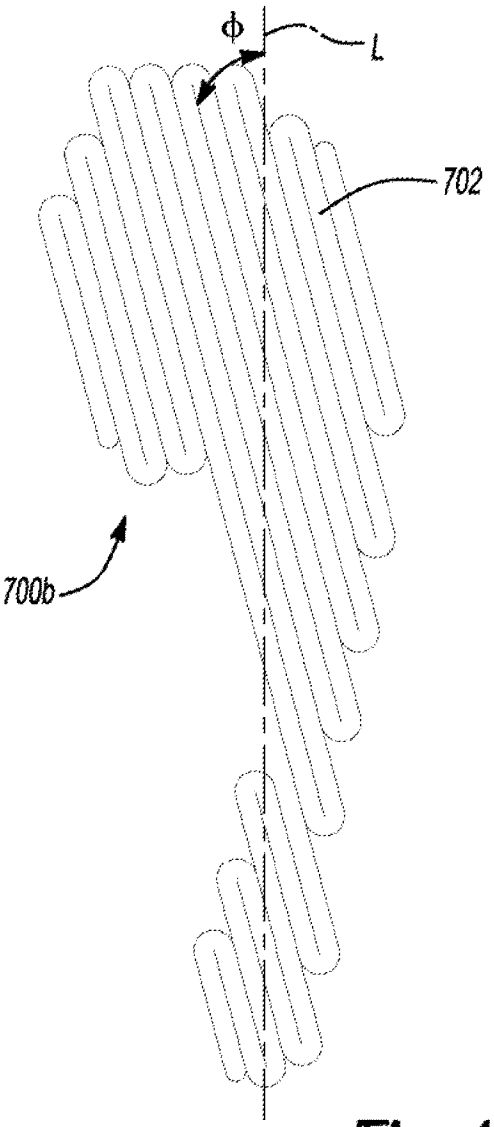
Figure 42A:
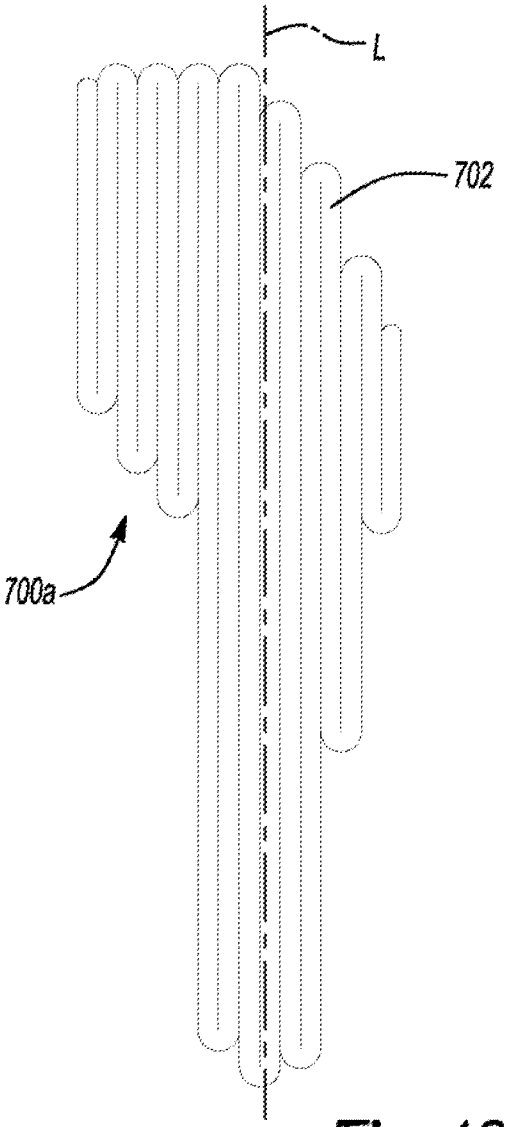
Figure 42E:
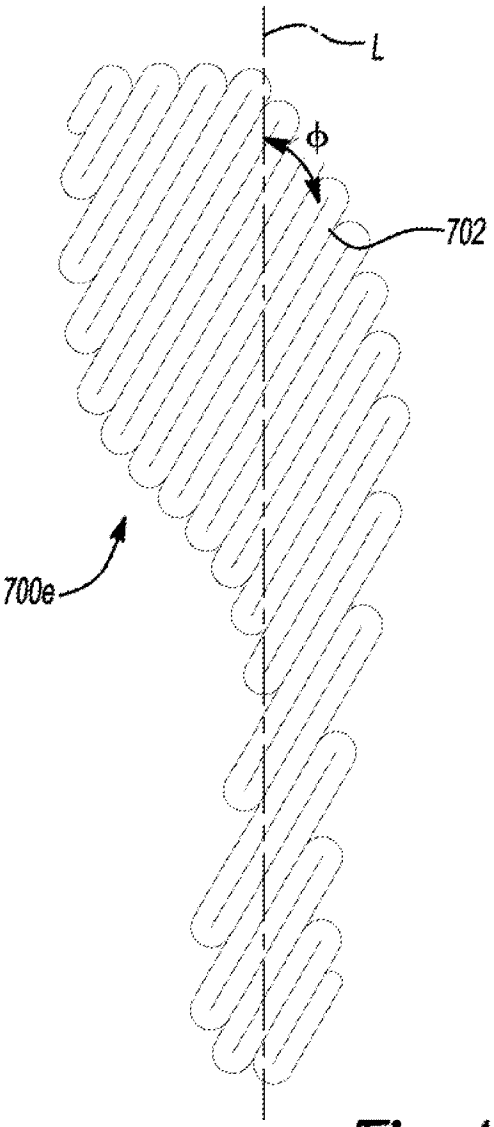
Figure 42D:
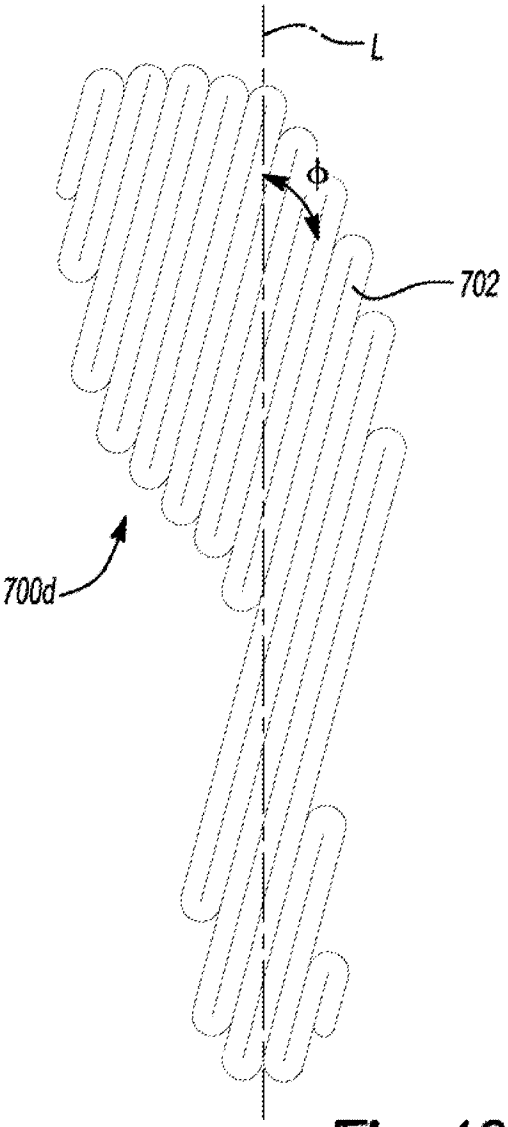
Figure 43:
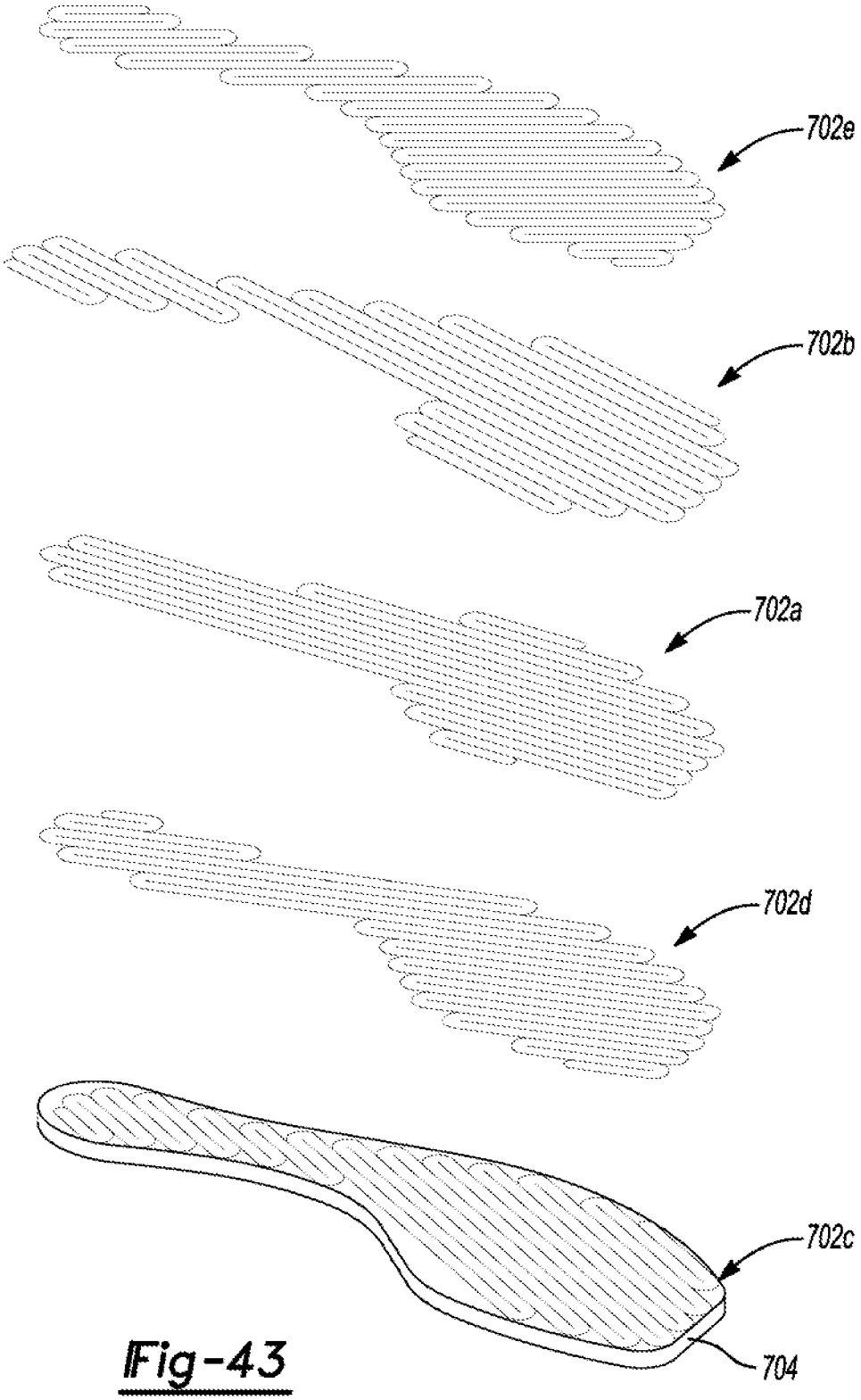
Figure 45:
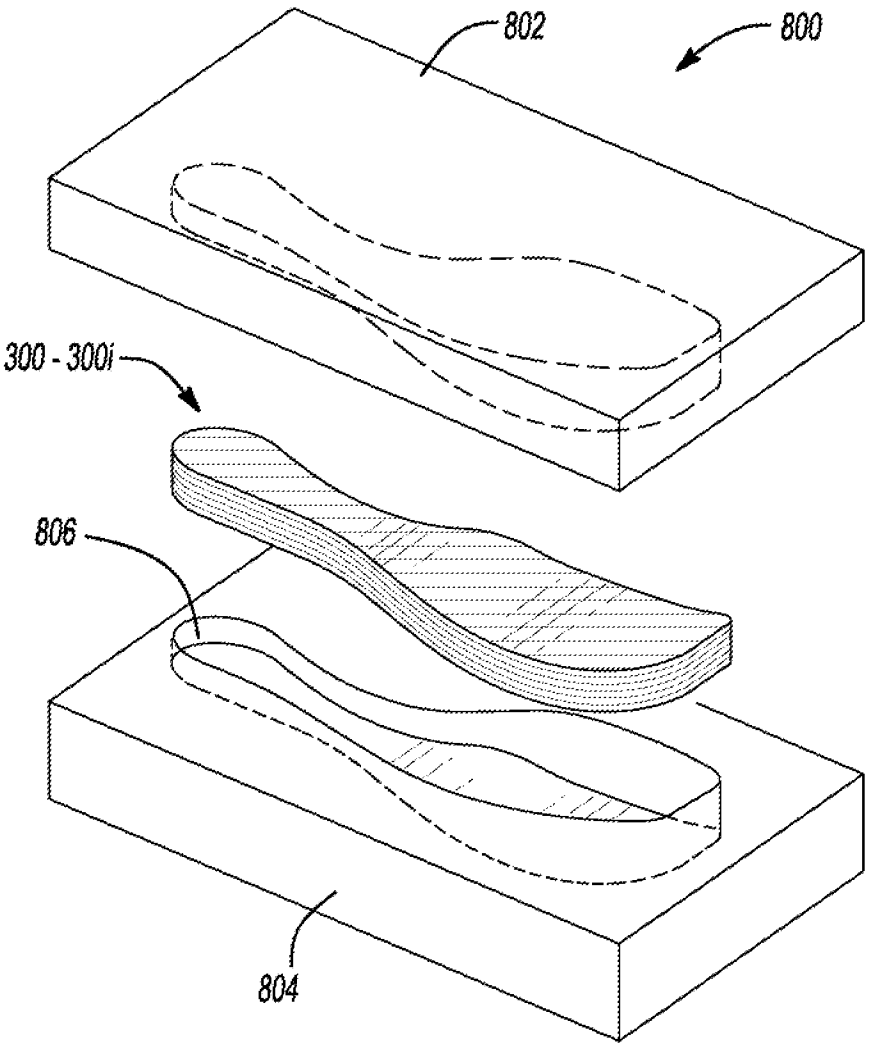
Figure 44:
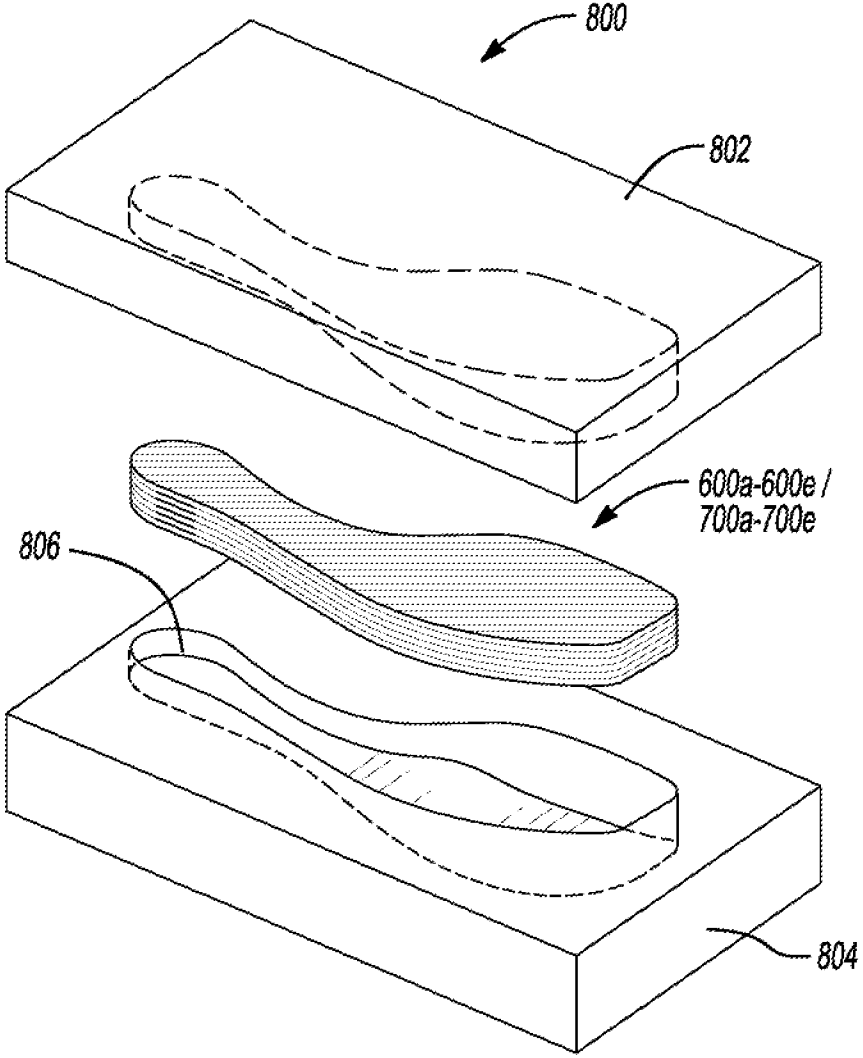

FIG. 12 is a cross-sectional view taken along line 12-12 of FIG. 10 showing a cushioning member received within a cavity between an inner surface of an outsole and a bottom surface of a midsole, and a footwear plate embedded within the cushioning member in a forefoot region of the footwear and disposed between the cushioning member and the bottom surface of midsole in a heel region of the footwear;

FIG. 13 is a top perspective view of an article of footwear in accordance with principles of the present disclosure;

FIG. 14 is an exploded view of the article of footwear of FIG. 13 showing a cushioning member received within a cavity between an inner surface of an outsole and a bottom surface of a midsole, and a footwear plate embedded within the cushioning member in a forefoot region of the footwear and disposed between the cushioning member and the inner surface of the outsole in a heel region of the footwear;

FIG. 15 is a cross-sectional view taken along line 15-15 of FIG. 13 showing a cushioning member received within a cavity between an inner surface of an outsole and a bottom surface of a midsole, and a footwear plate embedded within the cushioning member in a forefoot region of the footwear and disposed between the cushioning member and the inner surface of the outsole in a heel region of the footwear;

FIG. 16 is a top perspective view of a footwear plate for use in an article of footwear in accordance with principles of the present disclosure;

FIG. 17 is a side view of the footwear plate of FIG. 16;

FIG. 18 is a top view of the footwear plate of FIG. 16;

FIG. 19 is a top perspective view of a footwear plate for use in an article of footwear in accordance with principles of the present disclosure;

FIG. 20 is a side view of the footwear plate of FIG. 19;

FIG. 21 is a top view of the footwear plate of FIG. 19;

FIG. 22 is a top perspective view of a footwear plate for use in an article of footwear in accordance with principles of the present disclosure;

FIG. 23 is a side view of the footwear plate of FIG. 22;

FIG. 24 is a top view of the footwear plate of FIG. 22;

FIG. 25 is a top view of a footwear plate for use in an article of footwear in accordance with principles of the present disclosure;

FIG. 26 is a top view of a footwear plate for use in an forefoot region of an article of footwear in accordance with principles of the present disclosure;

FIG. 27 is a top view of a footwear plate for use in an article of footwear in accordance with principles of the present disclosure;

FIG. 28 is a top view of a footwear plate for use in an article of footwear in accordance with principles of the present disclosure;

FIG. 29 is a top view of a footwear plate for use in an article of footwear in accordance with principles of the present disclosure;

FIG. 30 is a top view of a footwear plate for use in an article of footwear in accordance with principles of the present disclosure;

FIG. 31 provides a top perspective view of an article of footwear in accordance with principles of the present disclosure;

FIG. 32 is a cross-sectional view taken along line 32-32 of FIG. 31 showing a footwear plate disposed between an outsole and a midsole in a forefoot region of the footwear and disposed between a cushioning member and the midsole in a heel region of the footwear;

FIG. 33 provides a top perspective view of an article of footwear in accordance with principles of the present disclosure;

FIG. 34 is a cross-sectional view taken along line 34-34 of FIG. 33 showing a footwear plate disposed between an outsole and a cushioning member;

FIG. 35 provides a top perspective view of an article of footwear in accordance with principles of the present disclosure;

FIG. 36 is a cross-sectional view taken along line 36-36 of FIG. 35 showing a plurality of apertures formed through an outsole and a cushioning member to expose a footwear plate disposed between the cushioning member and a midsole;

FIG. 37 is a top perspective view of an article of footwear in accordance with principles of the present disclosure;

FIG. 38 is an exploded view of the article of footwear of FIG. 37 showing a fluid-filled bladder disposed upon a cushioning member within a cavity between an inner surface of an outsole and a bottom surface of a midsole;

FIG. 39 is a cross-sectional view taken along line 39-39 of FIG. 37 showing a fluid-filled bladder disposed upon a cushioning member within a cavity between an inner surface of an outsole and a bottom surface of a midsole;

FIGS. 40A-40E show various prepreg fiber sheets used in forming a footwear plate in accordance with the principles of the present disclosure;

FIG. 41 is an exploded view of a stack of prepreg fiber sheets used to form a footwear plate in accordance with the principles of the present disclosure;

FIGS. 42A-42E show various layers of fiber strands used in forming a footwear plate in accordance with the principles of the present disclosure;

FIG. 43 is an exploded view of layers of fiber strands used to form a footwear plate in accordance with the principles of the present disclosure;

FIG. 44 is a perspective view of a mold for use in forming a footwear plate in accordance with the principles of the present disclosure, the mold shown in conjunction with a stack of fibers prior to being formed into a footwear plate; and FIG. 45 is a perspective view of a mold for use in forming a footwear plate in accordance with the principles of the present disclosure, the mold shown in conjunction with a formed footwear plate.

Corresponding reference numerals indicate corresponding parts throughout the drawings.

DETAILED DESCRIPTION

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a sole structure for an article of footwear having an upper portion. The sole structure includes an outsole, a plate disposed between the outsole and the upper, and a first cushioning layer disposed between the concave portion and the upper. The plate includes an anterior-most portion disposed in a forefoot region of the sole structure and a posterior-most point disposed closer to a heel region of the sole structure than the anterior-most point. The plate also includes a concave portion extending between the anterior-most point and the posterior-most point and including a constant radius of curvature from the anterior-most point to a metatarsophalangeal (MTP) point of the sole structure. The MTP point opposes the MTP joint of a foot during use.

Implementations of the disclosure may include one or more of the following optional features. In some implementations, the anterior-most point and the posterior-most point are co-planar. The plate may also include a substantially flat portion disposed within the heel region of the sole structure. The posterior-most point may be located within the substantially flat portion.

In some examples, the sole structure includes a blend portion disposed between and connecting the concave portion and the substantially flat portion. The blend portion may include a substantially constant curvature. The anterior-most point and the posterior-most point may be co-planar at a junction of the blend portion and the substantially flat portion.

The sole structure may include a second cushioning layer disposed between the substantially flat portion and the upper. A third cushioning layer may be disposed between the outsole and the plate. In some examples, the third cushioning layer is disposed within the heel region. The third cushioning layer may extend from the heel region to the forefoot region.

The sole structure may also include at least one fluid-filled chamber disposed between the plate and the upper and/or between the outsole and the plate. The at least one fluid-filled chamber may be disposed within at least one of the second cushioning layer and the third cushioning layer.

In some examples, the MTP point is located approximately thirty percent (30%) of the total length of the plate from the anterior-most point. A center of the radius of curvature may be located at the MTP point. The constant radius of curvature may extend from the anterior-most point past the MTP point. The constant radius of curvature may extend from the anterior-most point past the MTP point at least forty percent (40%) of the total length of the plate from the anterior-most point.

In some examples, the outsole includes a ground-contacting surface and an inner surface formed on an opposite side of the outsole than the ground-contact surface. The inner surface may be directly attached to the plate. The inner surface may be attached to the plate proximate to the concave portion.

Another aspect of the disclosure provides a sole structure for an article of footwear having an upper. The sole structure includes an outsole, a plate disposed between the outsole and the upper, and a first cushioning layer disposed between the curved portion and the upper. The plate includes an anterior-most point disposed in a forefoot region of the sole structure, and a posterior-most point disposed closer to a heel region of the sole structure than the anterior-most point. The plate also includes a curved portion extending between and connecting the anterior-most point and the posterior-most point and including a constant radius of curvature from the anterior-most point to a metatarsophalangeal (MTP) point of the sole structure. The MTP point opposes the MTP joint of a foot during use.

This aspect may include one or more of the following optional features. In some implementations, the anterior-most point and the posterior-most point are co-planar. The plate may include a substantially flat portion disposed within the heel region of the sole structure, the posterior-most point being located within the substantially flat portion.

In some examples, the sole structure includes a blend portion disposed between and connecting the curved portion and the substantially flat portion. The blend portion may include a substantially constant curvature. The anterior-most point and the posterior-most point may be co-planar at a junction of the blend portion and the substantially flat portion.

The sole structure may include a second cushioning layer disposed between the substantially flat portion and the upper. A third cushioning layer may be disposed between the outsole and the plate. The third cushioning layer may be disposed within the heel region. The third cushioning layer may extend from the heel region to the forefoot region.

In some examples, the sole structure includes at least one fluid-filled chamber disposed between the plate and the upper and/or between the outsole and the plate. At least one fluid-filled chamber may be disposed within at least one of the second cushioning layer and the third cushioning layer.

In some examples, the MTP point is located approximately thirty percent (30%) of the total length of the plate from the anterior-most point. A center of the radius of curvature may be located at the MTP point. The constant radius of curvature may extend from the anterior-most point past the MTP point. The constant radius of curvature may extend from the anterior-most point past the MTP point at least forty percent (40%) of the total length of the plate from the anterior-most point.

The outsole may include a ground-contacting surface and an inner surface formed on an opposite side of the outsole than the ground-contact surface. The inner surface may be directly attached to the plate. The inner surface may be attached to the plate proximate to the curved portion.

Yet another aspect of the disclosure provides a sole structure for an article of footwear having an upper. The sole structure includes an outsole, a plate disposed between the outsole, and the upper and a first cushioning layer disposed between the curved portion and the upper. The plate includes an anterior-most point disposed in a forefoot region of the sole structure and a posterior-most point disposed closer to a heel region of the sole structure than the anterior-most point. The plate also includes a curved portion extending between and connecting the anterior-most point and the posterior-most point and including a circular curvature from the anterior-most point to a metatarsophalangeal (MTP) point of the sole structure. The MTP point opposes the MTP joint of a foot during use.

This aspect may include one or more of the following optional features. In some implementations, the anterior-most point and the posterior-most point are co-planar. The plate may include a substantially flat portion disposed within the heel region of the sole structure. The posterior-most point may be located within the substantially flat portion. The plate may also include a substantially flat portion disposed within the heel region of the sole structure. The posterior-most point may be located within the substantially flat portion.

In some examples, the sole structure includes a blend portion disposed between and connecting the curved portion and the substantially flat portion. The blend portion includes a substantially constant curvature. The anterior-most point and the posterior-most point may be co-planar at a junction of the blend portion and the substantially flat portion.

The sole structure may include a second cushioning layer disposed between the substantially flat portion and the upper. A third cushioning layer may be disposed between the outsole and the plate. The third cushioning layer may be disposed within the heel region. In some examples, the third cushioning layer extends from the heel region to the forefoot region.

The sole structure may include at least one fluid-filled chamber disposed between the plate and the upper and/or between the outsole and the plate. The at least one fluid-filled chamber may be disposed within at least one of the second cushioning layer and the third cushioning layer.

In some examples, the MTP point is located approximately thirty percent (30%) of the total length of the plate from the anterior-most point. A center of the circular curvature may be located at the MTP point. The circular curvature may extend from the anterior-most point past the MTP point. The circular curvature may extend from the anterior-most point past the MTP point at least forty percent (40%) of the total length of the plate from the anterior-most point.

In some implementations, the outsole includes a ground-contacting surface and an inner surface formed on an opposite side of the outsole than the ground-contact surface. The inner surface may be directly attached to the plate. Additionally or alternatively, the inner surface may be attached to the plate proximate to the curved portion. In some examples, the sole structure further includes a second cushioning layer disposed on an opposite side of the plate than the first cushioning layer to form at least a portion of the outsole.

The details of one or more implementations of the disclosure are set forth in the accompanying drawings and the description below. Other aspects, features, and advantages will be apparent from the description and drawings, and from the claims.

During running movements, an application point of footwear providing the push-off force from the ground surface is located in a forefoot portion of the footwear. The application point of the footwear opposes a metatarsophalangeal (MTP) joint of the foot. A distance between an ankle joint of the athlete and a line of action of the application point providing the push-off force defines a lever arm length about the ankle. A mechanical demand for the ankle plantarflexors (e.g., calf muscles tendon unit) can be based on a push-off moment at the ankle determined by multiplying the length of the lever arm by a magnitude of the push-off force controlled by the athlete. Stiff and flat footwear plates generally increase the mechanical demand at the ankle due to stiff, flat plate causing the application point with the ground surface to shift anteriorly. As a result, the lever arm distance and the push-off moment increases at the ankle joint. Implementations herein are directed toward shorting the length of the lever arm from the ankle joint to reduce the push-off moment at the ankle by providing a stiff footwear plate that includes a curved portion opposing the MTP joint.

Figure 1:
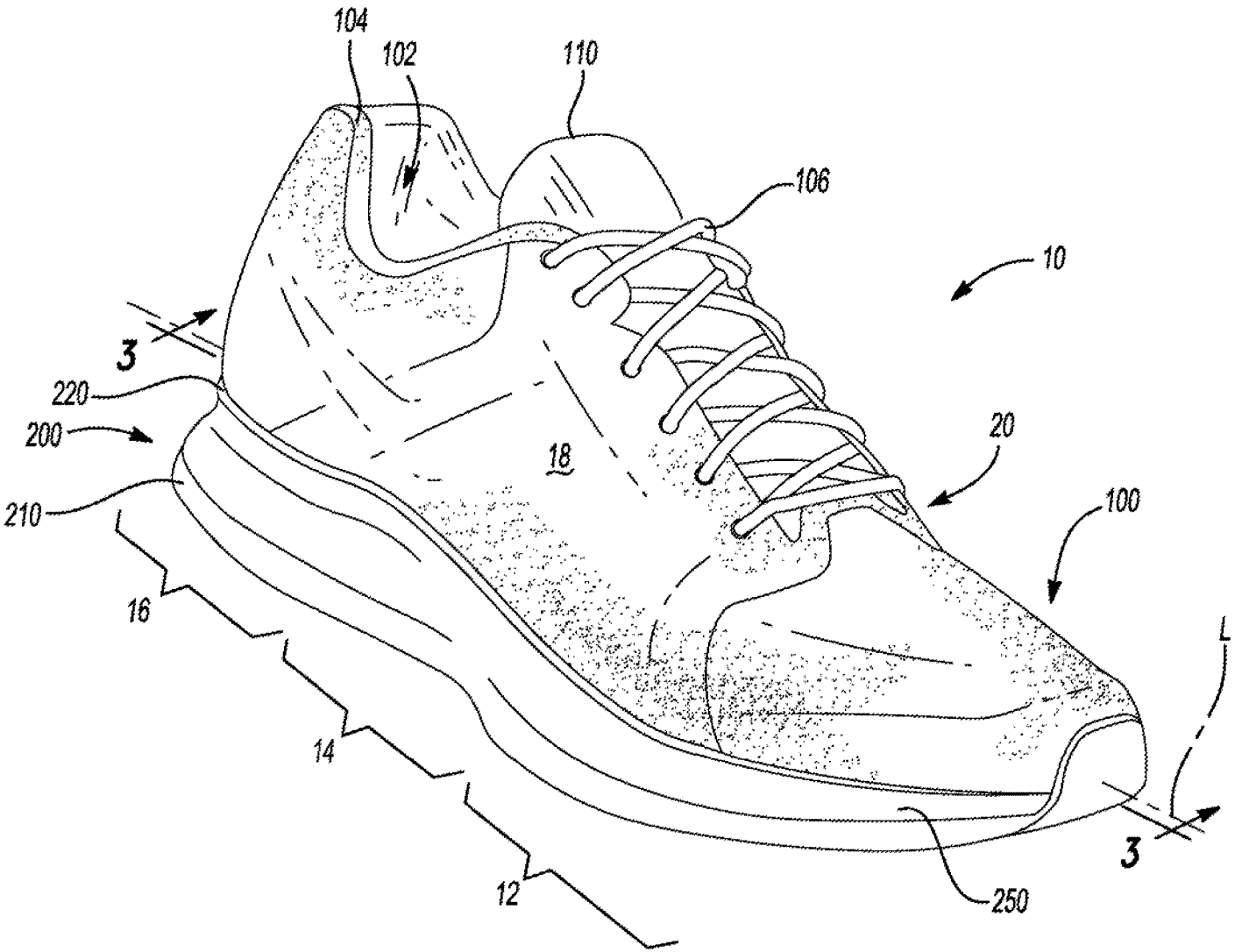
FIG. 1 is a top perspective view of an article of footwear in accordance with principles of the present disclosure.
Figure 2:
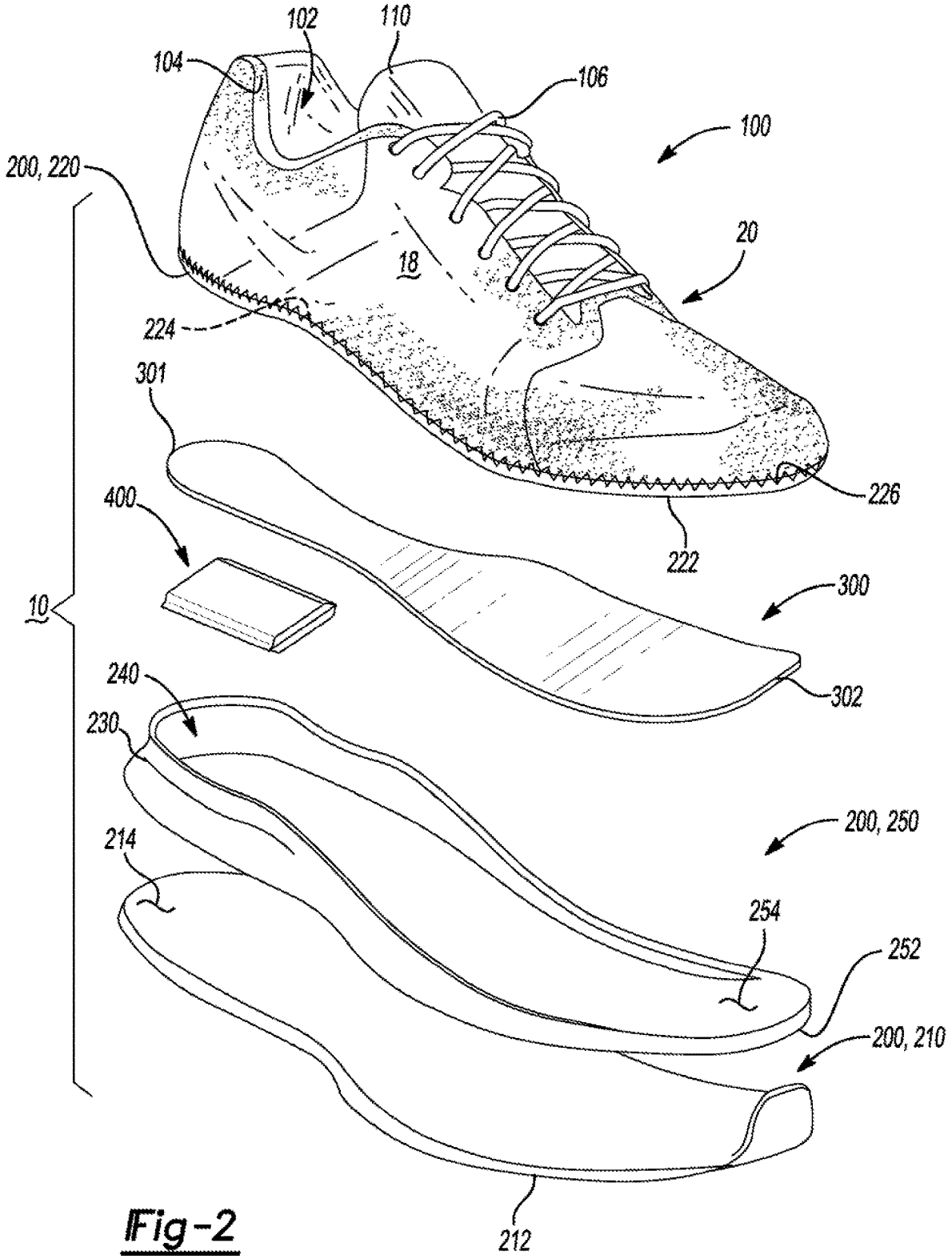
FIG. 2 is an exploded view of the article of footwear of FIG. 1 showing a footwear plate disposed upon a cushioning member within a cavity between an inner surface of an outsole and a bottom surface of a midsole.
Figure 3:
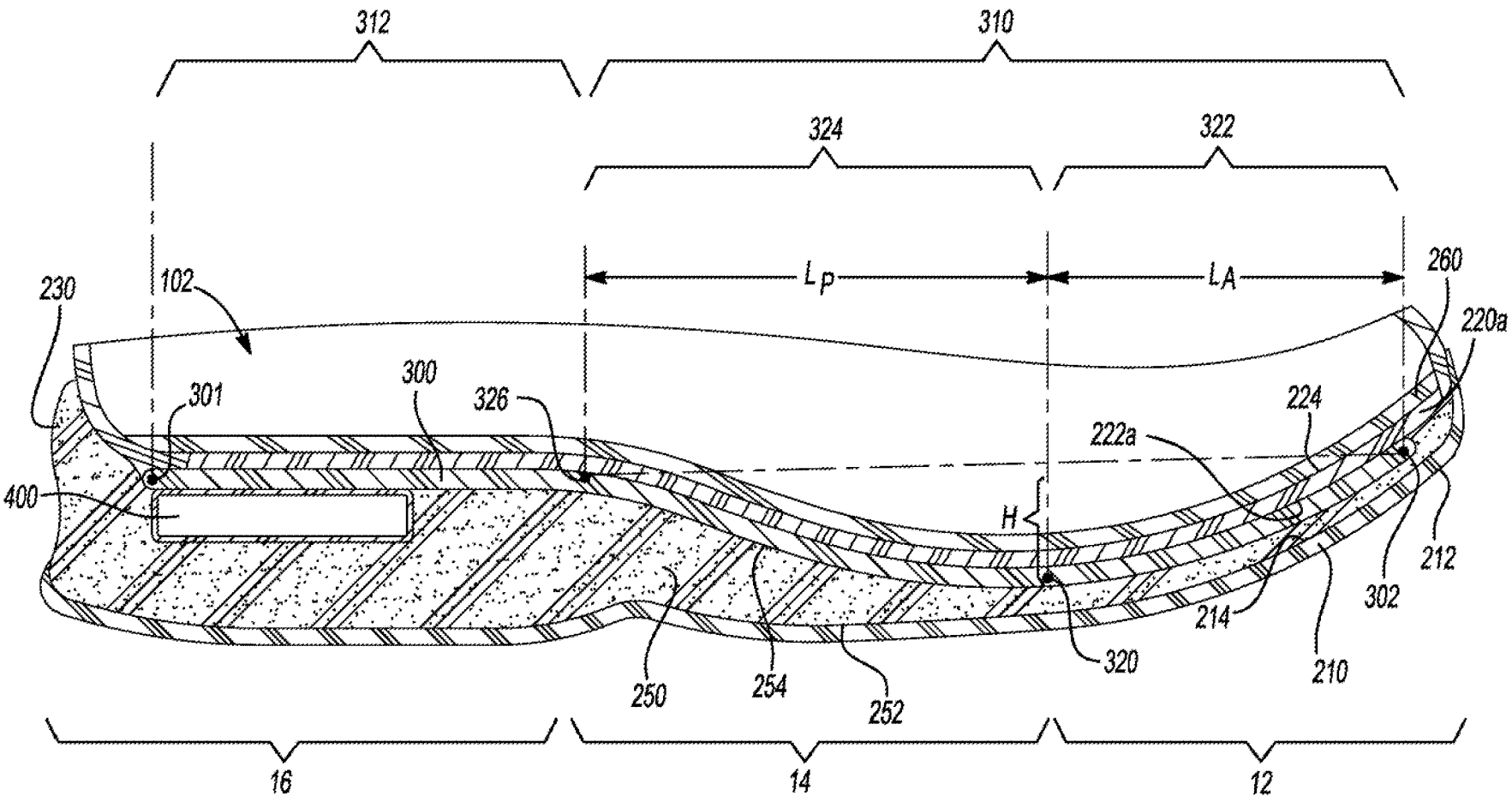
FIG. 3 is a cross-sectional view taken along line 3-3 of FIG. 1 showing a footwear plate disposed upon a cushioning member within a cavity between an inner surface of an outsole and a bottom surface of a midsole.

Referring to FIGS. 1-3, an article of footwear 10 is provided and includes an upper 100 and a sole structure 200 attached to the upper 100. The article of footwear 10 may be divided into one or more portions. The portions may include a forefoot portion 12, a mid-foot portion 14, and a heel portion 16. The forefoot portion 12 may correspond with toes and joints connecting metatarsal bones with phalanx bones of a foot during use of the footwear 10. The forefoot portion 12 may correspond with the MTP joint of the foot. The mid-foot portion 14 may correspond with an arch area of the foot, and the heel portion 16 may correspond with rear portions of the foot, including a calcaneus bone, during use of the article of footwear 10. The footwear 10 may include lateral and medial sides 18, 20, respectively, corresponding with opposite sides of the footwear 10 and extending through the portions 12, 14, 16.

The upper 100 includes interior surfaces that define an interior void 102 that receives and secures a foot for support on the sole structure 200, during use of the article of footwear 10. An ankle opening 104 in the heel portion 16 may provide access to the interior void 102. For example, the ankle opening 104 may receive a foot to secure the foot within the void 102 and facilitate entry and removal of the foot to and from the interior void 102. In some examples, one or more fasteners 106 extend along the upper 100 to adjust a fit of the interior void 102 around the foot while concurrently accommodating entry and removal of the foot therefrom. The upper 100 may include apertures such as eyelets and/or other engagement features such as fabric or mesh loops that receive the fasteners 106. The fasteners 106 may include laces, straps, cords, hook-and-loop, or any other suitable type of fastener.

The upper 100 may include a tongue portion 110 that extends between the interior void 102 and the fasteners 106. The upper 100 may be formed from one or more materials that are stitched or adhesively bonded together to form the interior void 102. Suitable materials of the upper may include, but are not limited, textiles, foam, leather, and synthetic leather. The materials may be selected and located to impart properties of durability, air-permeability, wear-resistance, flexibility, and comfort.

In some implementations, the sole structure 200 includes an outsole 210, a cushioning member 250, and a midsole 220 arranged in a layered configuration. The sole structure 200 (e.g., the outsole 210, the cushioning member 250, and the midsole 220) defines a longitudinal axis L. For example, the outsole 210 engages with a ground surface during use of the article of footwear 10, the midsole 220 attaches to the upper 100, and the cushioning member 250 is disposed therebetween to separate the midsole 220 from the outsole 210. For example, the cushioning member 250 defines a bottom surface 252 opposing the outsole 210 and a top surface 254 disposed on an opposite side of the cushioning member 250 than the bottom surface 252 and opposing the midsole 220. The top surface 254 may be contoured to conform to the profile of the bottom surface (e.g., plantar) of the foot within the interior void 102. In some examples, the sole structure 200 may also incorporate additional layers such as an insole 260 (FIGS. 2 and 3) or sockliner, which may reside within the interior void 102 of the upper 100 to receive a plantar surface of the foot to enhance the comfort of the footwear 10. In some examples, a sidewall 230 surrounds at least a portion of a perimeter of the cushioning member 250 and separates the cushioning member 250 and the midsole 220 to define a cavity 240 therebetween. For instance, the sidewall 230 and the top surface 254 of the cushioning member 250 may cooperate to retain and support the foot upon the cushioning member 250 when the interior void 102 receives the foot therein. For instance, the sidewall 230 may define a rim around at least a portion of the perimeter of the contoured top surface 254 of the cushioning member 250 to cradle the foot during use of the footwear 10 when performing walking or running movements. The rim may extend around the perimeter of the midsole 220 when the cushioning member 250 attaches to the midsole 220.

In some configurations, a footwear plate 300 is disposed upon the top surface 254 of the cushioning member 250 and underneath the midsole 220 to reduce energy loss at the MTP joint while enhancing rolling of the foot as the footwear 10 rolls for engagement with a ground surface during a running motion. The footwear plate 300 may define a length extending through at least a portion of the length of the sole structure 200. In some examples, the length of the plate 300 extends through the forefoot, mid-foot, and heel portions 12, 14, 16 of the sole structure 200. In other examples, the length of the plate 300 extends through the forefoot portion 12 and the mid-foot portion 14, and is absent from the heel portion 16.

In some examples, the footwear plate 300 includes a uniform local stiffness (e.g., tensile strength or flexural strength) throughout the entire surface area of the plate 300. The stiffness of the plate may be anisotropic where the stiffness in one direction across the plate is different from the stiffness in another direction. For instance, the plate 300 may be formed from at least two layers of fibers anisotropic to one another to impart gradient stiffness and gradient load paths across the plate 300. In one configuration, the plate 300 provides a greater longitudinal stiffness (e.g., in a direction along the longitudinal axis L) than a transverse stiffness (e.g., in a direction transverse to the longitudinal axis L). In one example, the transverse stiffness is at least ten percent (10%) lower than the longitudinal stiffness. In another example, the transverse stiffness is from about ten percent (10%) to about twenty percent (20%) of the longitudinal stiffness. In some configurations, the plate 300 is formed from one or more layers of tows of fibers and/or layers of fibers including at least one of carbon fibers, aramid fibers, boron fibers, glass fibers, and polymer fibers. In a particular configuration, the fibers include carbon fibers, or glass fibers, or a combination of both carbon fibers and glass fibers. The tows of fibers may be affixed to a substrate. The tows of fibers may be affixed by stitching or using an adhesive. Additionally or alternatively, the tows of fibers and/or layers of fibers may be consolidated with a thermoset polymer and/or a thermoplastic polymer. Accordingly, the plate 300 may have a tensile strength or flexural strength in a transverse direction substantially perpendicular to the longitudinal axis L. The stiffness of the plate 300 may be selected for a particular wearer based on the wearer's tendon flexibility, calf muscle strength, and/or MTP joint flexibility. Moreover, the stiffness of the plate 300 may also be tailored based upon a running motion of the athlete. In other configurations, the plate 300 is formed from one or more layers/plies of unidirectional tape. In some examples, each layer in the stack includes a different orientation than the layer disposed underneath. The plate may be formed from unidirectional tape including at least one of carbon fibers, aramid fibers, boron fibers, glass fibers, and polymer fibers. In some examples, the one or more materials forming the plate 300 include a Young's modulus of at least 70 gigapascals (GPa).

In some implementations, the plate 300 includes a substantially uniform thickness. In some examples, the thickness of the plate 300 ranges from about 0.6 millimeter (mm) to about 3.0 mm. In one example, the thickness of the plate is substantially equal to one 1.0 mm. In other implementations, the thickness of the plate 300 is non-uniform such that the plate 300 may define a greater thickness in the mid-foot portion 14 of the sole structure 200 than the thicknesses in the forefoot portion 12 and the heel portion 16.

The outsole 210 may include a ground-engaging surface 212 and an opposite inner surface 214. The outsole 210 may attach to the upper 100. In some examples, the bottom surface 252 of the cushioning member 250 affixes to the inner surface 214 of the outsole and the sidewall 230 extends from the perimeter of the cushioning member 250 and attaches to the midsole 220 or the upper 100. The example of FIG. 1 shows the outsole 210 attaching to the upper 100 proximate to a tip of the forefoot portion 12. The outsole 210 generally provides abrasion-resistance and traction with the ground surface during use of the article of footwear 10. The outsole 210 may be formed from one or more materials that impart durability and wear-resistance, as well as enhance traction with the ground surface. For example, rubber may form at least a portion of the outsole 210.

The midsole 220 may include a bottom surface 222 and a footbed 224 disposed on an opposite side of the midsole 220 than the bottom surface 222. Stitching 226 or adhesives may secure the midsole 220 to the upper 100. The footbed 224 may be contoured to conform to a profile of the bottom surface (e.g., plantar) of the foot. The bottom surface 222 may oppose the inner surface 214 of the outsole 210 to define a space therebetween for receiving the cushioning member 250.

FIG. 2 provides an exploded view of the article of footwear 10 showing the outsole 210, the cushioning member 250 disposed upon the inner surface 214 of the outsole 210, and the substantially rigid footwear plate 300 disposed between the top surface 254 of the cushioning member 250 and the bottom surface 222 of the midsole 220. The cushioning member 250 may be sized and shaped to occupy at least a portion of empty space between the outsole 210 and the midsole 220. Here, the cavity 240 between the cushioning member 250 and the bottom surface 222 of the midsole 220 defines a remaining portion of empty space that receives the footwear plate 300. Accordingly, the cushioning member 250 and the plate 300 may substantially occupy the entire volume of space between the bottom surface 222 of the midsole 220 and the inner surface 214 of the outsole 210. The cushioning member 250 may compress resiliently between the midsole 220 and the outsole 210. In some configurations, the cushioning member 250 corresponds to a slab of polymer foam having a surface profile configured to receive the footwear plate 300 thereon. The cushioning member 250 may be formed from any suitable materials that compress resiliently under applied loads. Examples of suitable polymer materials for the foam materials include ethylene vinyl acetate (EVA) copolymers, polyurethanes, polyethers, and olefin block copolymers. The foam can also include a single polymeric material or a blend of two or more polymeric materials including a polyether block amide (PEBA) copolymer, the EVA copolymer, a thermoplastic polyurethane (TPU), and/or the olefin block copolymer. The cushioning member 250 may include a density within a range from about 0.05 grams per cubic centimeter ($g/cm^3$) to about 0.20 $g/cm^3$. In some examples, the density of the cushioning member 250 is approximately 0.1 $g/cm^3$. Moreover, the cushioning member 250 may include a hardness within the range from about eleven (11) Shore A to about fifty (50) Shore A. The one or more materials forming the cushioning member 250 may be suitable for providing an energy return of at least 60-percent (60%).

In some examples, a fluid-filled bladder 400 is disposed between the footwear plate 300 and the cushioning member 250 in at least one portion 12, 14, 16 of the sole structure 200 to enhance cushioning characteristics of the footwear 10 responsive to ground-reaction forces. For instance, the fluid-filled bladder 400 may define an interior void that receives a pressurized fluid and provides a durable sealed barrier for retaining the pressurized fluid therein. The pressurized fluid may be air, nitrogen, helium, or dense gases such as sulfur hexafluoride. The fluid-filled bladder may additionally or alternatively contain liquids or gels. In other examples, the fluid-filled bladder 400 is disposed between the cushioning member 250 and the outsole 210, or between the plate 300 and the midsole 220. FIGS. 2 and 3 show the fluid-filled bladder 400 residing in the heel portion 16 of the sole structure 200 to assist with attenuating the initial impact with the ground surface occurring in the heel portion 16. In other configurations, one or more fluid-filled bladders 400 may additionally or alternatively extend through the mid-foot portion 14 and/or forefoot portion 12 of the sole structure 200. The cushioning member 250 and the fluid-filled bladder 400 may cooperate with enhance functionality and cushioning characteristics when the sole structure 200 is under load.

The length of the footwear plate 300 may extend between a first end 301 and a second end 302. The first end 301 may be disposed proximate to the heel portion 16 of the sole structure 200 and the second end 302 may be disposed proximate to the forefoot portion 12 of the sole structure 200. The first end 301 may also be referred to as a "posterior-most point" of the plate 300 while the second end 302 may also be referred to as an "anterior-most point" of the plate. In some examples, the length of the footwear plate 300 is less than a length of the cushioning member 250. The footwear plate 300 may also include a thickness extending substantially perpendicular to the longitudinal axis L of the sole structure 200 and a width extending between the lateral side 18 and the medial side 20. Accordingly, the length, the width, and the thickness of the plate 300 may substantially occupy the cavity 240 defined by the top surface 254 of the cushioning member 250 and the bottom surface 222 of the midsole and may extend through the forefoot, mid-foot, and heel portions 12, 14, 16, respectively, of the sole structure 200. In some examples (e.g., FIG. 37), peripheral edges of the footwear plate 300 are visible along the lateral and/or medial sides 18, 20 of the footwear 10.

Referring to FIG. 3, a partial cross-sectional view taken along line 3-3 of FIG. 1 shows the footwear plate 300 disposed between the cushioning member 250 and the midsole 220 and the cushioning member 250 disposed between the outsole 210 and the footwear plate 300. The insole 260 may be disposed upon the footbed 224 within the interior void 102 under the foot. FIG. 3 shows the cushioning member 250 defining a reduced thickness to accommodate the fluid-filled bladder 400 within the heel region 16. In some examples, the cushioning member 250 encapsulates the bladder 400, while in other examples, the cushioning member 250 merely defines a cut-out for receiving the bladder 400. In some configurations, a portion of the plate 300 is in direct contact with the fluid-filled bladder 400. The cushioning member 250 may define a greater thickness in the heel portion 16 of the sole structure 200 than in the forefoot portion 12. In other words, the gap or distance separating the outsole 210 and the midsole 220 decreases in a direction along the longitudinal axis L of the sole structure 200 from the heel portion 16 toward the forefoot portion 12. In some implementations, the top surface 254 of the cushioning member 250 is smooth and includes a surface profile contoured to match the surface profile of the footwear plate 300 such that the footwear plate 300 and the cushioning member 250 mate flush with one another. The cushioning member 250 may define a thickness in the forefoot portion 12 of the sole structure within a range from about seven (7) millimeters (mm) to about twenty (20) mm. In one example, the thickness of the cushioning member 250 in the forefoot portion 12 is about twelve (12) mm.

In some configurations, e.g., the footwear plate **10*f* of FIGS. 35 and 36, footwear having spikes for track events, i.e., "track shoes", incorporates a cushioning member 250*f* (FIG. 36) within the forefoot portion 12 between the plate 300 and outsole 210 that has a reduced thickness of about eight (8) mm. In these configurations, the cushioning member 250 may be absent between the plate 300 and outsole 210 within the forefoot portion 12. Moreover, cushioning material associated with the same cushioning member 250 or a different cushioning member may be disposed between the plate 300 and the midsole 220 and extend through the forefoot, mid-foot, and heel portions 12, 14, 16**, respectively.

The footwear plate 300 includes a curved region 310 extending through the forefoot portion 12 and the mid-foot portion 14 of the sole structure 200. The terms "curved portion", "concave portion", and "circular portion" may also be used to describe the curved region 310. The footwear plate 300 may optionally include a substantially flat region 312 extending through the heel portion 16 from the curved region 310 to the posterior-most point 301 of the plate 300. The curved region 310 is associated with a radius of curvature about an MTP point 320 to define an anterior curved portion 322 extending from one side of the MTP point 320 and a posterior curved portion 324 extending from the other side of the MTP point 320. For instance, the anterior curved portion 322 extends between the MTP point 320 and the anterior-most point (AMP) 302 (e.g., second end 302) of the plate 300, while the posterior curved portion 324 extends between the MTP point 320 and an aft point 326 disposed at a junction of the curved region 310 and the flat region 312. In some examples, the anterior curved portion 322 and the posterior curved portion 324 are associated with the same radius of curvature that is mirrored about the MTP point 320. In other examples, the anterior curved portion 322 and the posterior curved portion 324 are each associated with a different radius of curvature. In some configurations, a portion of the posterior curved portion 324 is associated with the same radius of curvature as the anterior curved portion 322. Accordingly, the curved portions 322, 324 may each include a corresponding radius of curvature that may be the same or may be different from one another. In some examples, the radius of curvatures differ from one another by at least two percent (2%). The radius of curvatures for the curved regions 322, 324 may range from 200 millimeters (mm) to about 400 mm. In some configurations, the anterior curved portion 322 includes a radius of curvature that continues the curvature of the posterior curved portion 324 such that the curved portions 322, 324 define the same radius of curvature and share a same vertex. Additionally or alternatively, the plate may define a radius of curvature that connects the posterior curved portion 324 to the substantially flat region 312 of the plate 300. As used herein, the term "substantially flat" refers to the flat region 312 within five (5) degrees horizontal, i.e., within five (5) degrees parallel to the ground surface.

The MTP point 320 is the closest point of the footwear plate 300 to the inner surface 214 of the outsole 210 while the aft point 326 and the AMP 302 of the plate 300 are disposed further from the outsole 210 than the MTP point 320. In some configurations, the posterior-most point 301 and the AMP 302 are co-planar. In some examples, the MTP point 320 of the plate 300 is disposed directly below the MTP joint of the foot when the foot is received within the interior void 102 of the upper 100. In other examples, the MTP point 320 is disposed at a location that is further from a toe end of the sole structure 200 than the MTP joint. The anterior curved and posterior curved portions 322, 324, respectively, of the curved region 310 provide the plate 300 with a longitudinal stiffness that reduces energy loss proximate to the MTP joint of the foot, as well as enhances rolling of the foot during running motions to thereby reduce a lever arm distance and alleviate strain on the ankle joint.

In some implementations, the AMP 302 and the aft point 326 are located above the MTP point 320 by a distance substantially equal to position height H. Here, the position height H extends from the MTP 320 in a direction substantially perpendicular to the longitudinal axis L of the sole structure 200. The height H ranges from about three (3) millimeters (mm) to about twenty-eight (28) mm. In other examples, the height H ranges from about three (3) mm to about seventeen (17) mm. In one example, the height H is equal to about seventeen (17) mm. Thus, the toes of the foot residing above the anterior curved portion 322 may be biased upward due to the anterior curved portion 322 extending away from the outsole 210 from the MTP point 320 toward the AMP 302. Additionally or alternatively, a length $L_A$ of the anterior curved portion 322 may be substantially equal to a length $L_P$ of the posterior curved portion 324. As used herein, the $L_A$ and $L_P$ are each measured along a line extending substantially parallel to the longitudinal axis L between the MTP point 320 and respective ones of the AMP 302 and the aft point 326. In other words, the lengths $L_A$ and $L_P$ are each associated with a distance between the MTP point 320 and a corresponding one of the AMP 302 and the aft point 326. In some configurations, the $L_A$ and the $L_P$ are each equal to about thirty percent (30%) of a total length of the plate 300 while a length of the flat region 312 accounts for the remaining forty percent (40%) of the total length of the plate 300. In other configurations, the $L_A$ is equal from about twenty-five percent (25%) to about thirty-five percent (35%) of the total length of the plate 300, $L_P$ is equal from about twenty-five percent (25%) to about thirty-five percent (35%) of the total length of the plate 300, and the length of the flat region 312 is equal to the balance. In other configurations, $L_A$, $L_P$, and the length of the flat region 312 are substantially equal. Varying the radius of curvature of the curved region 310 causes the lengths $L_A$ and $L_P$ and/or the height (H) of the anterior-most point 302 and the aft point 306 to change relative to the MTP point 320. For instance, decreasing the radius of curvature causes an angle between the MTP point 320 and the AMP 302 to increase as well as the height H of the AMP 302 above the MTP point 320 to also increase. In configurations when the curved portions 322, 324 each include a different radius of curvature, the corresponding lengths La and Lp and/or the height from the MTP point 320 may be different. Accordingly, the radius of curvature of the curved region 310 may vary for different shoe sizes, may vary depending upon an intended use of the footwear 10, and/or may vary based upon the anatomical features of the foot on a wearer-by-wear basis.

In some implementations, the MTP point 320 is located approximately thirty percent (30%) of the total length of the plate from the AMP 302. A center of the radius of curvature of the curved region 310 may be located at the MTP point 320. In some examples, the curved region 310 (e.g., concave portion) is associated with a constant radius of curvature that extends from the AMP 302 past the MTP point 320. In these examples, the constant radius of curvature may extend from the AMP 302 past the MTP point 320 at least forty percent (40%) of the total length of the plate 300 from the AMP 302.

Figure 4:
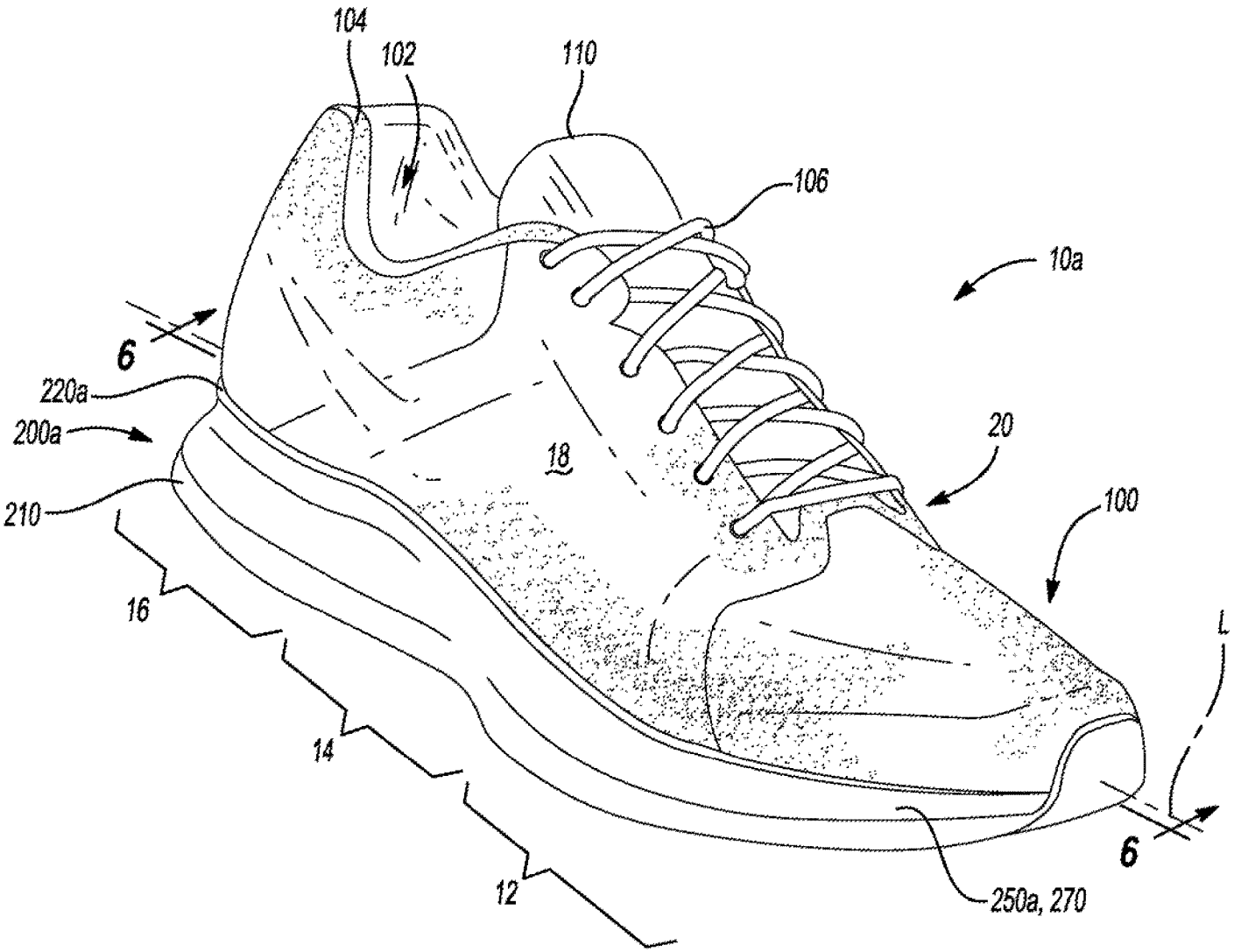
FIG. 4 is a top perspective view of an article of footwear in accordance with principles of the present disclosure.
Figure 5:
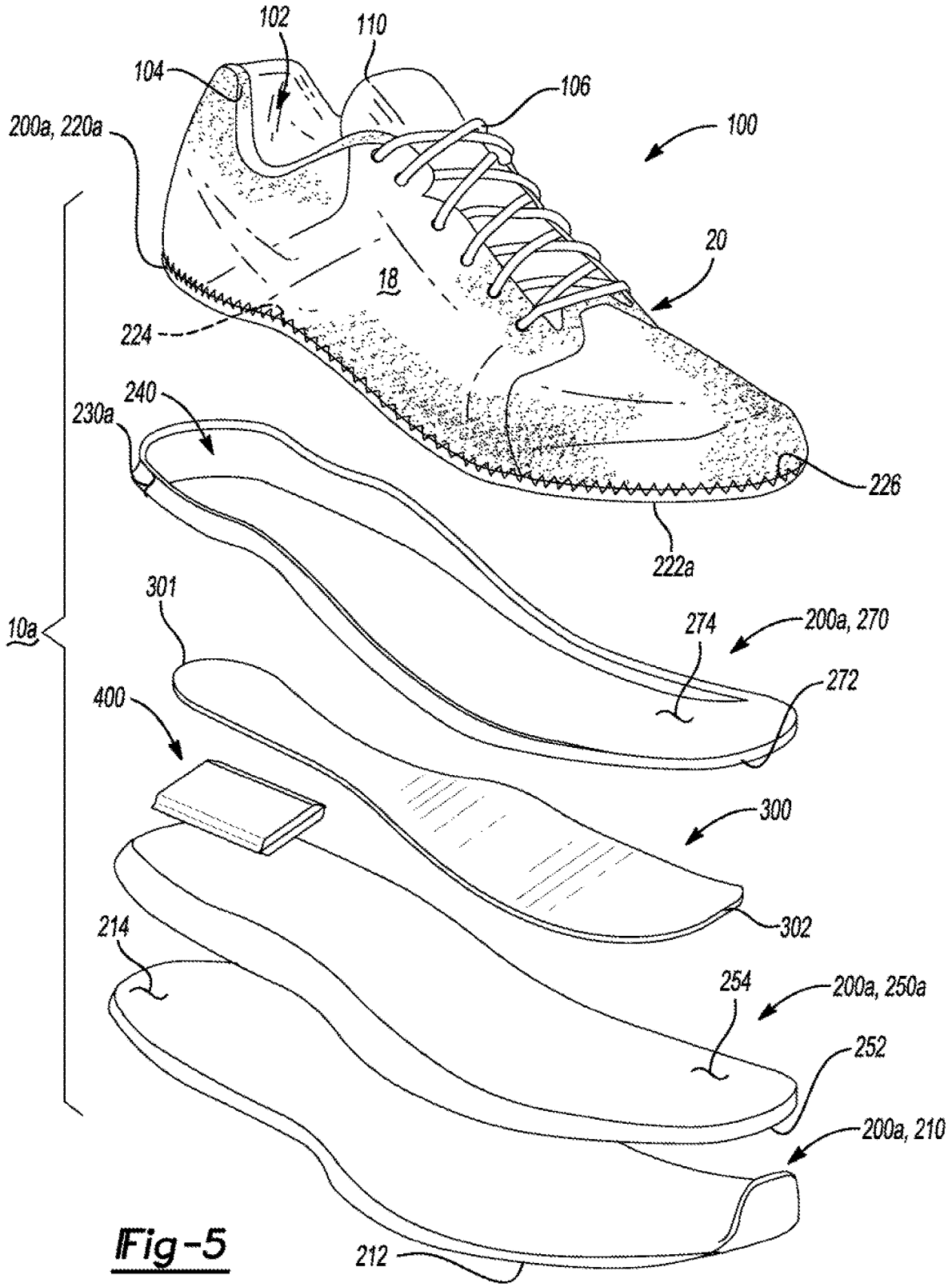
FIG. 5 is an exploded view of the article of footwear of FIG. 4 showing a footwear plate disposed between a first cushioning member and a second cushioning member within a cavity between an inner surface of an outsole and a bottom surface of a midsole.
Figure 6:
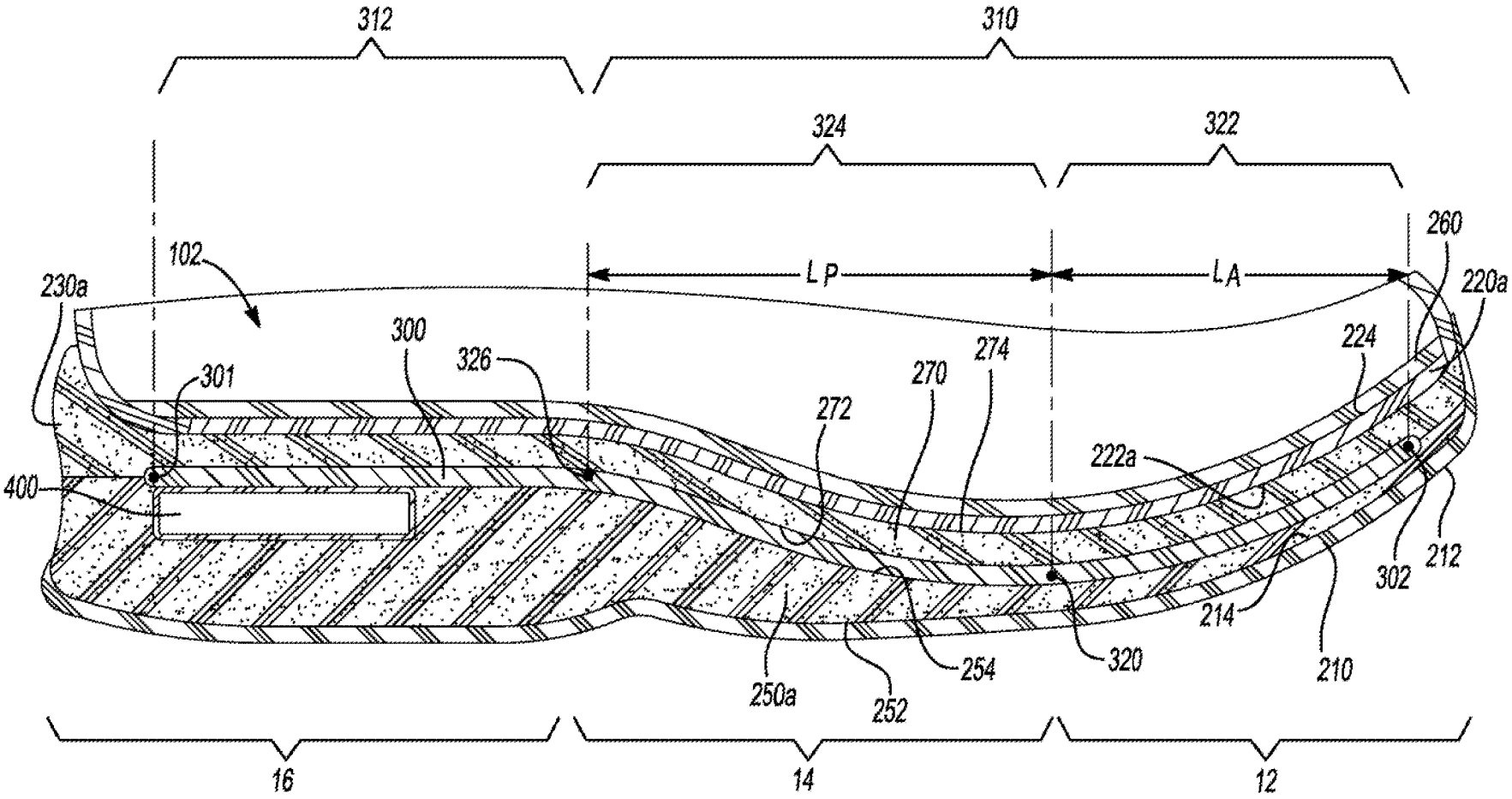
FIG. 6 is a cross-sectional view taken along line 6-6 of FIG. 4 showing a footwear plate disposed between a first cushioning member and a second cushioning member within a cavity between an inner surface of an out sole and a bottom surface of a midsole.

FIGS. 4-6 provide an article of footwear 10*a* that includes an upper 100 and a sole structure 200*a* attached to the upper 100. In view of the substantial similarity in structure and function of the components associated with the article of footwear 10 with respect to the article of footwear 10*a*, like reference numerals are used hereinafter and in the drawings to identify like components while like reference numerals containing letter extensions are used to identify those components that have been modified.

The sole structure 200*a* may include the outsole 210, a first cushioning member 250*a*, the footwear plate 300, a second cushioning member 270, and a midsole 220*a* arranged in the layered configuration. FIG. 5 provides an exploded view of the article of footwear 10*a* showing the sole structure 200*a* (e.g., the outsole 210, the cushioning members 250*a*, 270, the plate 300, and the midsole 220*a*) defining a longitudinal axis L. The outsole 210 includes the inner surface 214 disposed on an opposite side of the outsole 210 than the ground-engaging surface 212. The midsole 220*a* includes a bottom surface 222*a* disposed on an opposite side of the midsole 220*a* than the footbed 224 and opposing the inner surface 214 of the outsole 210.

The first cushioning member 250*a*, the footwear plate 300, and the second cushioning member 270 are disposed between the inner surface 214 and the bottom surface 222*a* to separate the midsole 220*a* from the outsole 210. For example, the first cushioning member 250*a* includes the bottom surface 252 received by the inner surface 214 of the outsole 210 and a top surface 254*a* disposed on an opposite side of the cushioning member 250*a* than the bottom surface 252 and opposing the midsole 220*a* to support the footwear plate 300 thereon. The second cushioning member 270 is disposed on an opposite side of the footwear plate 300 than the first cushioning member. For instance, the second cushioning member 270 includes a bottom surface 272 opposing the footwear plate 300 and a top surface 274 disposed on an opposite side of the second cushioning member 270 than the bottom surface 272 and opposing the bottom surface 222*a* of the midsole 220*a*. The top surface 274 may be contoured to conform to the profile of the bottom surface (e.g., plantar) of the foot within the interior void 102. As with the cushioning member 250 of FIGS. 1-3, the second cushioning member 270 may define a sidewall 230*a* surrounding at least a portion of a perimeter of the second cushioning member 270. The sidewall 230*a* may define a rim that extends around the perimeter of the midsole 220*a* when the second cushioning member 270 attaches to the midsole 220*a*.

In some configurations, a total thickness of the first and second cushioning members 250*a*, 270, respectively, is equal to the thickness of the cushioning member 250 of the article of footwear 10 of FIGS. 1-3. The thickness of the first cushioning member 250 may be the same or different than the thickness of the second cushioning member 270. The first and second cushioning members 250*a*, 270 are operative to embed or sandwich the footwear plate 300 therebetween such that the footwear plate 300 is spaced apart from both the inner surface 214 of the outsole 210 and the bottom surface 222*a* of the midsole 220*a*. Accordingly, the cushioning members 250*a*, 270 and the plate 300 may substantially occupy the entire volume of space between the bottom surface 222*a* of the midsole 220*a* and the inner surface 214 of the outsole 210.

The cushioning members 250*a*, 270 may compress resiliently between the midsole 220 and the outsole 210. The cushioning members 250*a*, 270 may each be formed from a slab of polymer foam which may be formed from the same one or more materials forming the cushioning member 250 of FIGS. 1-3. For instance, the cushioning members 250*a*, 270 may be formed from one or more of EVA copolymers, polyurethanes, polyethers, olefin block copolymers, PEBA copolymers, and/or TPUs. In some implementations, the cushioning members 250*a*, 270 provide different cushioning characteristics. For instance, the first cushioning member 250*a* may compress resiliently under applied loads to prevent the plate 300 from translating into contact with ground surface while the second cushioning member 270 may provide a level of soft-type cushioning for the foot to attenuate ground-reaction forces and enhance comfort for the wearer's foot. The sole structure 200*a* may also incorporate the fluid-filled bladder 400 between the footwear plate 300 and the first cushioning member 250*a* in at least one portion 12, 14, 16 of the sole structure to enhance cushioning characteristics of the footwear 10 in responsive to ground-reaction forces. For instance, the bladder 400 may be filled with a pressurized fluid such as air, nitrogen, helium, sulfur hexafluoride, or liquids/gels. Accordingly, the cushioning members 250*a*, 270 separated by the plate 300 and the fluid-filled bladder 400 may cooperate to provide gradient cushioning to the article of footwear 10*a* that changes as the applied load changes (i.e., the greater the load, the more the cushioning members 250*a*, 270 compress and, thus, the more responsive the footwear performs). The cushioning members 250*a*, 270 may include densities within a range from about 0.05 g/cm$^3$ to about 0.20 g/cm$^3$. In some examples, the density of the cushioning members 250*a*, 270 is approximately 0.1 g/cm$^3$. Moreover, the cushioning members 250*a*, 270 may include hardnesses within the range from about eleven (11) Shore A to about fifty (50) Shore A. The one or more materials forming the cushioning members 250*a*, 270 may be suitable for providing an energy return of at least 60-percent (60%).

The footwear plate 300 defines the length extending between the first end 301 and the second end 302 (e.g., AMP 302) that may be the same as or less than the lengths of the cushioning members 250*a*, 270. The length, width, and thickness of the plate 300 may substantially occupy the volume of space between the top surface 254 of the first cushioning member 250 and the bottom surface 272 of the second cushioning member 270 and may extend through the forefoot, mid-foot, and heel portions 12, 14, 16, respectively, of the sole structure 200*a*. In some examples, the plate 300 extends through the forefoot portion 12 and the mid-foot portion 14 of the sole structure 200*a* but is absent from the heel portion 16. In some examples, peripheral edges of the footwear plate 300 are visible along the lateral and/or medial sides 18, 20 of the footwear 10*a*. In some implementations, the top surface 254 of the first cushioning member 250*a* and the bottom surface 272 of the second cushioning member 270 are smooth and include surface profiles contoured to match the surface profiles of the opposing sides of the footwear plate 300 such that the footwear plate 300 mates flush with each of the cushioning members 250*a*, 270.

As described above with reference to FIGS. 1-3, the footwear plate 300 may include the uniform local stiffness that may or may not be anisotropic. For instance, the plate 300 may be formed from one or more layers and/or tows of fibers including at least one of carbon fibers, aramid fibers, boron fibers, glass fibers, and polymer fibers. Thus, the plate 300 may provide a greater thickness along the longitudinal direction of the sole structure than the stiffness in direction transverse (e.g., perpendicular) to the longitudinal axis L. For instance, the stiffness of the plate 300 in the transverse direction may be at least 10-percent less than the stiffness of the plate 300 in the longitudinal direction, or may be approximately 10-percent to 20-percent of the thickness of the plate 300 along the longitudinal direction (e.g., parallel to longitudinal axis L). Moreover, the plate 300 may include a substantially uniform thickness within the range of about 0.6 mm to about 3.0 mm across the plate 300 or a non-uniform thickness that varies across the plate, e.g., the thickness of the plate 300 in the mid-foot portion 14 is greater than the thicknesses in the forefoot portion 12 and the heel portion 16.

FIG. 6 provides a partial cross-sectional view taken along line 6-6 of FIG. 4 showing the footwear plate 300 disposed between the first and second cushioning members 250*a*, 270, respectively, the first cushioning member 250*a* disposed between the outsole 210 and the footwear plate 300, and the second cushioning member 270 disposed between the midsole 220*a* and the footwear plate 300. The insole 260 may be disposed upon the footbed 224 within the interior void 102 under the foot. The first cushioning member 250*a* may encapsulate the bladder 400 or define a cut-out for receiving the bladder 400, while a portion of the plate 300 may be in direct contact with the bladder 400. In some configurations, the first cushioning member 250*a* defines a greater thickness in the heel portion 16 of the sole structure 200*a* than in the forefoot portion 12 and the top surface 254 includes a surface profile contoured to match the surface profile of the footwear plate 300 supported thereon. The second cushioning member 270 may cooperate with the first cushioning member 250*a* to define a space for enclosing the footwear plate 300 therebetween. For instance, portions of the bottom surface 272 of the second cushioning member 270 and the top surface 254 of the first cushioning member 250*a* may be recessed to define a cavity for retaining the footwear plate 300. In some implementations, the thickness of the second cushioning member 270 is greater in the forefoot and mid-foot portions 12, 14, respectively, than the thickness of the first cushioning member 250*a*. Advantageously, the increased thickness provided by the second cushioning member 270 in the forefoot and mid-foot portions 12, 14, respectively, increases the separation distance between the MTP joint of the foot and the footwear plate 300 and, thus, enhances cushioning characteristics of the footwear 10*a* in response to ground-reaction forces when the footwear 10*a* performs running movements/motions. In some configurations, the thickness of the second cushioning member 270 is greater than the thickness of the first cushioning member 250*a* at locations opposing the MTP point 320 of the plate 300. In these configurations, the second cushioning member

270 may define a maximum thickness at a location opposing the MTP point 320 that is equal to a value within a range from about 3.0 mm to about 13.0 mm. In one example, the maximum thickness is equal to approximately 10.0 mm. The thickness of the second cushioning member 270 may taper along the direction from the MTP point 320 to the AMP 302 such that the thickness of the second cushioning member 270 proximate to the AMP 302 is approximately sixty-percent (60%) less than the maximum thickness proximate to the MTP point 320. On the other hand, the first cushioning member 250*a* may define a minimum thickness at the location opposing the MTP point 320 that is equal to a value within a range from about 0.5 mm to about 6.0 mm. In one example, the minimum thickness is equal to approximately 3.0 mm.

The footwear plate 300 includes the curved region 310 extending through the forefoot portion 12 and the mid-foot portion 14 and may optionally include the substantially flat region 312 extending through the heel portion 16 from the aft point 326 at the curved region 310 to the posterior-most point 301 of the plate 300. The radius of curvature of the curved region 310 defines the anterior curved portion 322 extending between MTP point 320 and the AMP 302 at the toe end of the sole structure 200*a*, and the posterior curved portion 322 extending between the MTP point 320 and the aft point 326. In some configurations, the anterior curved portion 322 and the posterior curved portion 324 each include the same radius of curvature mirrored about the MTP point 320. In other configurations, the curved portions 322, 324 are each associated with a different radius of curvature. Accordingly, the curved portions 322, 324 may each include a corresponding radius of curvature that may be the same or may be different from one another. In some examples, the radius of curvatures differ from one another by at least two percent (2%). The radius of curvatures for the curved regions 322, 324 may range from about 200 millimeters (mm) to about 400 mm. In some configurations, the anterior curved portion 322 includes a radius of curvature that continues the curvature of the posterior curved portion 324 such that the curved portions 322, 324 define the same radius of curvature and share a same vertex. Additionally or alternatively, the plate may define a radius of curvature that connects the posterior curved portion 324 to the substantially flat region 312 of the plate 300. As used herein, the term "substantially flat" refers to the flat region 312 within five (5) degrees horizontal, i.e., within five (5) degrees parallel to the ground surface.

The curved portions 322, 324 may each account for about 30-percent (%) of the total length of the plate 300 while the length of the flat region 312 may account for the remaining 40-percent (%) of the length of the plate 300. The anterior curved and posterior curved portions 322, 324, respectively, of the curved region 310 provide the plate 300 with a longitudinal stiffness that reduces energy loss proximate to the MTP joint of the foot, as well as enhances rolling of the foot during running motions to thereby reduce a lever arm distance and alleviate strain on the ankle joint. The AMP 302 and the aft point 326 are located above the MTP point 320 and may be located above the MTP point 320 by a distance substantially equal position height H. Moreover, the length $L_A$ of the anterior curved portion 322 and the length $L_P$ of the posterior curved portion 324 (e.g., measured along the line extending substantially parallel to the longitudinal axis L between the MTP point 320 and respective ones of the AMP 302 and the aft point 326) may be substantially equal to one another or may be different. As described above with reference to FIGS. 1-3, varying the radius of curvature of the curved region 310 causes the lengths $L_A$ and $L_P$ and/or the height (H) of the anterior most point 302 and the aft point 306 to change relative to the MTP point 320. In doing so, the stiffness of the plate 300 may vary to provide a custom footwear plate 300 tailored for the wearer's shoe size, the intended use of the footwear 10, and/or the wearer's anatomical features of the foot.

Figure 7:
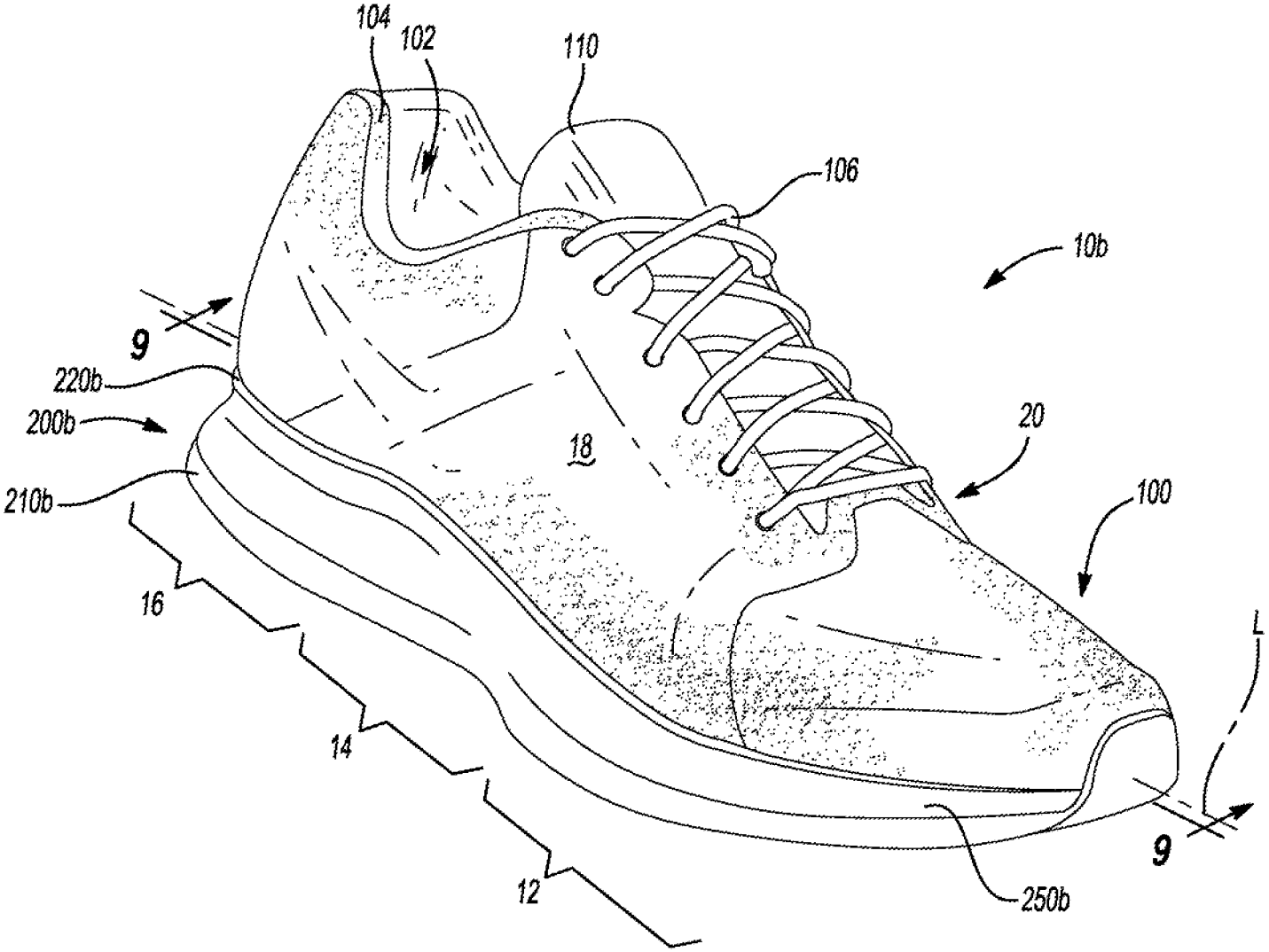
FIG. 7 is a top perspective view of an article of footwear in accordance with principles of the present disclosure.
Figure 8:
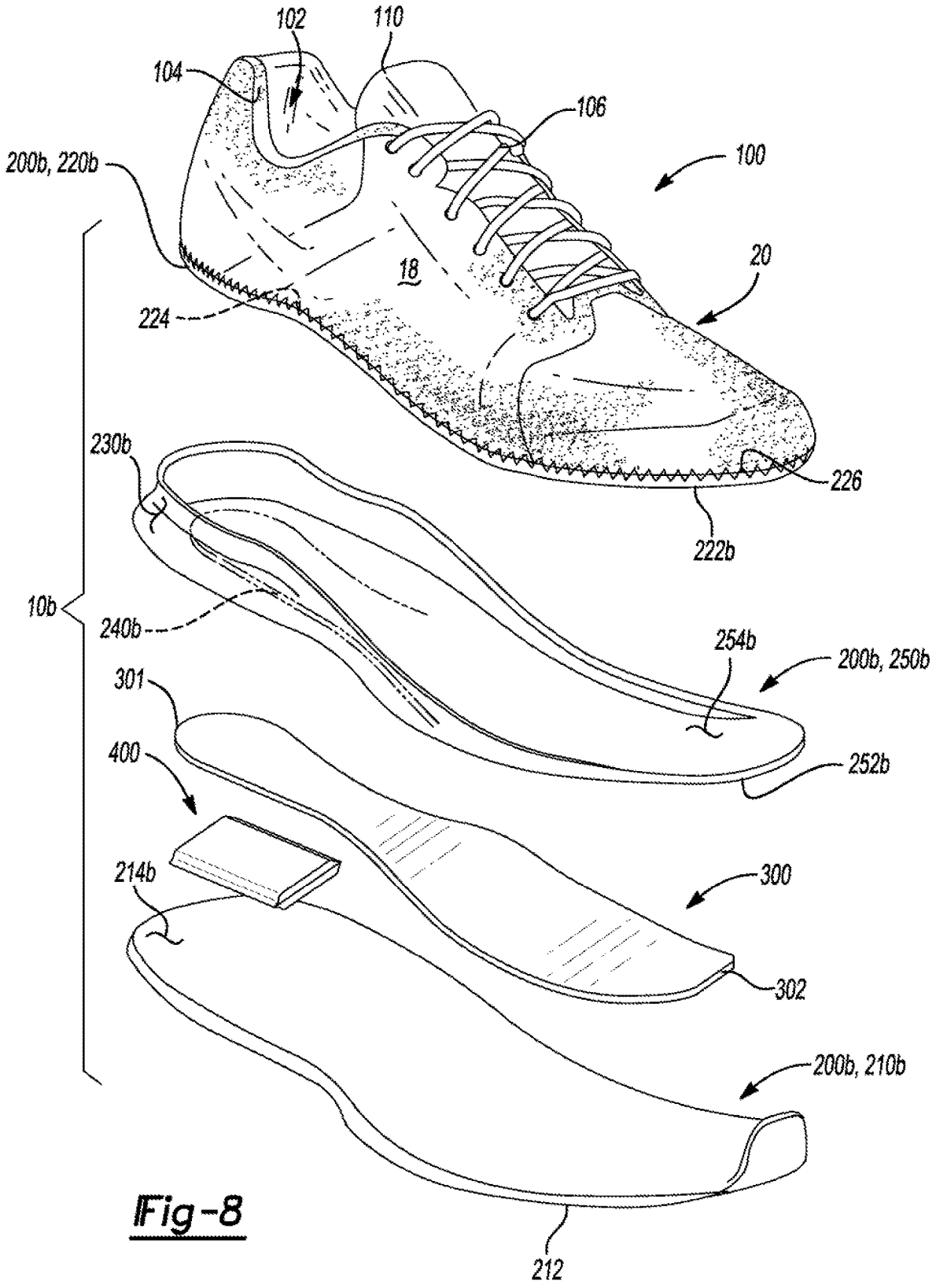
FIG. 8 is an exploded view of the article of footwear of FIG. 7 showing a cushioning member received within a cavity between an inner surface of an outsole and a bottom surface of a midsole, and a footwear plate disposed upon the inner surface in a forefoot region of the footwear and embedded within the cushioning member in a heel region of the footwear.
Figure 9:
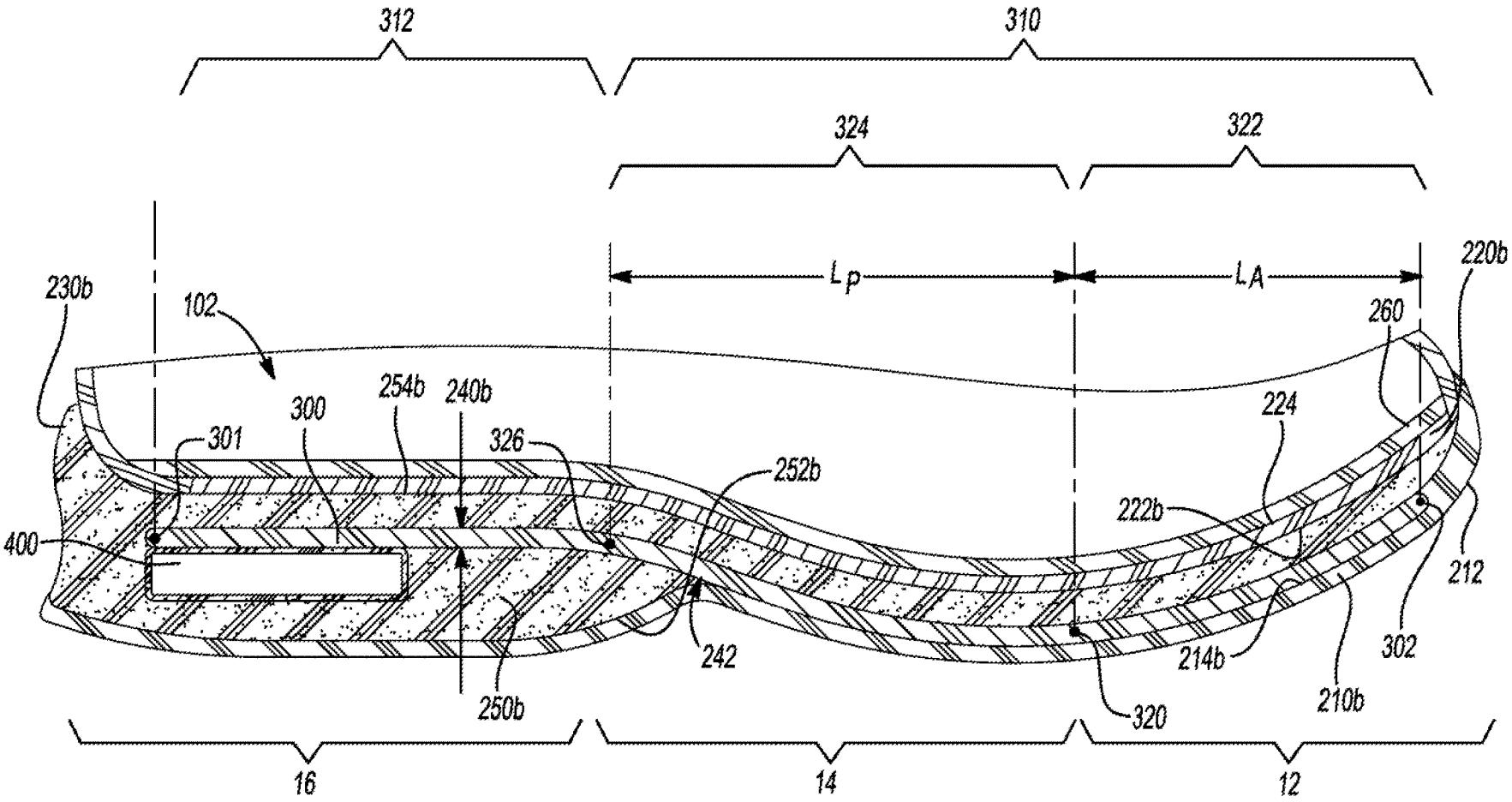
FIG. 9 is a cross-sectional view taken along line 9-9 of FIG. 7 showing a cushioning member received within a cavity between an inner surface of an outsole and a bottom surface of a midsole, and a footwear plate disposed upon the inner surface in a forefoot region of the footwear and embedded within the cushioning member in a heel region of the footwear.

FIGS. 7-9 provide an article of footwear 10*b* that includes an upper 100 and a sole structure 200*b* attached to the upper 100. In view of the substantial similarity in structure and function of the components associated with the article of footwear 10 with respect to the article of footwear 10*b*, like reference numerals are used hereinafter and in the drawings to identify like components while like reference numerals containing letter extensions are used to identify those components that have been modified.

FIG. 8 provides an exploded view of the article of footwear 10*b* showing the sole structure 200*b* include an outsole 210*b*, a cushioning member 250*b*, and a midsole 220*b* arranged in a layered configuration and defining a longitudinal axis L. The outsole 210*b* includes an inner surface 214*b* disposed on an opposite side of the outsole 210*b* than the ground-engaging surface 212. The midsole 220*b* includes a bottom surface 222*b* disposed on an opposite side of the midsole 220*b* than the footbed 224. The cushioning member 250*b* is disposed between the inner surface 214*b* and the bottom surface 222*b* to separate the midsole 220*b* from the outsole 210*b*. For example, the cushioning member 250*a* includes a bottom surface 252*b* opposing the inner surface 214*b* of the outsole 210 and a top surface 254*b* disposed on an opposite side of the cushioning member 250*b* than the bottom surface 252*b* and opposing the midsole 220*b*. The top surface 254*b* may be contoured to conform to the profile of the bottom surface (e.g., plantar of the foot) within the interior void 102. As with the cushioning member 250 of the article of FIGS. 1-3, the cushioning member 250*b* may define a sidewall 230*b* surrounding at least a portion of a perimeter of the second cushioning member 250*b*. The sidewall 230*b* may define a rim that extends around the perimeter of the midsole 220*a* when the cushioning member 250*b* attaches to the midsole 220*b*.

The cushioning member 250*b* may compress resiliently between the midsole 220*b* and the outsole 210*b* and may be formed from the same one or more materials forming the cushioning member 250 of FIGS. 1-3. For instance, the cushioning member 250*b* may be formed form one or more of EVA copolymers, polyurethanes, polyethers, olefin block copolymers, PEBA copolymers, and/or TPUs. The sole structure 200*a* may also incorporate the fluid-filled bladder 400 between the footwear plate 300 and the first cushioning member 250*a* in at least one portion 12, 14, 16 of the sole structure to enhance cushioning characteristics of the footwear 10 in responsive to ground-reaction forces. For instance, the bladder 400 may be filled with a pressurized fluid such as air, nitrogen, helium, sulfur hexafluoride, or liquids/gels.

In some configurations, the cushioning member 250*b* defines a cavity 240*b* (e.g., sleeve) within an interior portion between the top surface 254*b* and the bottom surface 252*b* in the heel portion 16 of the sole structure 200*b*. FIG. 9 provides a partial cross-sectional view taken along 9-9 of FIG. 7 showing the substantially flat region 312 of the footwear plate 300 received within the cavity 240*b* of the cushioning member 250*b* and the curved region 310 exposed from the cavity 240*b* between the bottom surface 252*b* of the cushioning member 250*b* and the inner surface 214*b* of the outsole 210*b*. FIG. 9 shows the bottom surface 252*b* of the cushioning member 250*b* defining an access opening 242 to the cavity 240*b* for receiving the substantially flat portion 312 of the plate 300. The cavity 240*b* may be contiguous with a cut-out formed within the cushioning member 250*b* for embedding the fluid-filled bladder 400. Thus, the sole structure 200*b* incorporated by the article of footwear 10*b* of FIGS. 7-9 includes the bottom surface 252*b* of the cushioning member 250*b* affixing to the inner surface 214*b* of the outsole 210*b* in the heel portion 16, while the curved region 310 of the plate 300 extending out of the cavity 240*b* of the cushioning member 250*b* at the access opening 242 is in direct contact with the inner surface 214 in the forefoot and mid-foot portions 12, 14, respectively. Accordingly, the cavity 240*b* defined by the cushioning member 250*b* is operative to embed/encapsulate at least a portion (e.g., flat region 312) of the plate 300 therein. As with the cushioning member 250 and plate 300 of FIGS. 1-3, the cushioning member 250*b* and the plate 300 may substantially occupy the entire volume of space between the bottom surface 222*b* of the midsole 220*b* and the inner surface 214*b* of the outsole 210*b*.

The insole 260 may be disposed upon the footbed 224 within the interior void 102 under the foot. The cushioning member 250*b* may encapsulate the bladder 450 or define a cut-out for receiving the bladder 400, while a portion of the plate 300 may be in direct contact with the bladder 400. The cut-out receiving the bladder 400 may be contiguous with the cavity 240*b* formed through the cushioning member 250*b*. In some configurations, the cushioning member 250*b* defines a greater thickness in the heel portion 16 of the sole structure 200*b* than in the forefoot portion 12. In some examples, the thickness of the cushioning member 250*b* separating the bottom surface 222*b* of the midsole 220*b* and the plate 300 is greater at locations proximate to the curved region 310 of the plate 300 than at the locations proximate to the substantially flat region 312 of the plate 300. In these examples, the cushioning member 250*b* is operative to increase the separation distance between the plate 300 and the midsole 220*b* such that the MTP joint of the foot is prevented from contacting the plate 300 during use of the footwear 10*b* while performing running movements/motions. The cushioning member 250*b* may define a thickness in the forefoot portion 12 of the sole structure 200*b* within a range from about seven (7) millimeters (mm) to about twenty (20) mm. In one example, the thickness of the cushioning member 250*b* in the forefoot portion 12 is about twelve (12) mm. The cushioning member 250*b* may include a density within a range from about 0.05 grams per cubic centimeter ($g/cm^3$) to about 0.20 $g/cm^3$. In some examples, the density of the cushioning member 250*b* is approximately 0.1 $g/cm^3$. Moreover, the cushioning member 250*b* may include a hardness within the range from about eleven (11) Shore A to about fifty (50) Shore A. The one or more materials forming the cushioning member 250*b* may be suitable for providing an energy return of at least 60-percent (60%).

As described above with reference to FIGS. 1-3, the footwear plate 300 may include the uniform local stiffness that may or may not be anisotropic. For instance, the plate 300 may be formed from one or more tows of fibers including at least one of carbon fibers, aramid fibers, boron fibers, glass fibers, and polymer fibers. Thus, the plate 300 may provide a greater thickness along the longitudinal direction of the sole structure than the stiffness in direction transverse (e.g., perpendicular) to the longitudinal axis L. For instance, the stiffness of the plate 300 in the transverse direction may be approximately 10-percent to 20-percent of the thickness of the plate 300 along the longitudinal direction (e.g., parallel to longitudinal axis L). Moreover, the plate 300 may include a substantially uniform thickness within the range of about 0.6 mm to about 3.0 mm across the plate 300 or a non-uniform thickness that varies across the plate, e.g., the thickness of the plate 300 in the mid-foot portion 14 is greater than the thicknesses in the forefoot portion 12 and the heel portion 16. In some examples, the plate 300 includes a thickness equal to about 1.0 mm.

The radius of curvature of the curved region 310 defines the anterior curved portion 322 extending between MTP point 320 and the AMP 302 at the toe end of the sole structure 200*b*, and the posterior curved portion 322 extending between the MTP point 320 and the aft point 326. In some configurations, the anterior curved portion 322 and the posterior curved portion 324 each include the same radius of curvature mirrored about the MTP point 320. In other configurations, the curved portions 322, 324 are each associated with a different radius of curvature. The curved portions 322, 324 may each account for about 30-percent (%) of the total length of the plate 300 while the length of the flat region 312 may account for the remaining 40-percent (%) of the length of the plate 300. The anterior curved and posterior curved portions 322, 324, respectively, of the curved region 310 provide the plate 300 with a longitudinal stiffness that reduces energy loss proximate to the MTP joint of the foot, as well as enhances rolling of the foot during running motions to thereby reduce a lever arm distance and alleviate strain on the ankle joint. The AMP 302 and the aft point 326 are located above the MTP point 320 and may be located above the MTP point 320 by a distance substantially equal position height H. Moreover, the length $L_A$ of the anterior curved portion 322 and the length $L_P$ of the posterior curved portion 324 (e.g., measured along the line extending substantially parallel to the longitudinal axis L between the MTP point 320 and respective ones of the AMP 302 and the aft point 326) may be substantially equal to one another or may be different. As described above with reference to FIGS. 1-3, varying the radius of curvature of the curved region 310 causes the lengths $L_A$ and $L_P$ and/or the height (H) of the anterior most point 302 and the aft point 306 to change relative to the MTP point 320. In doing so, the stiffness of the plate 300 may vary to provide a custom footwear plate 300 tailored for the wearer's shoe size, the intended use of the footwear 10, and/or the wearer's anatomical features of the foot.

Figure 11:
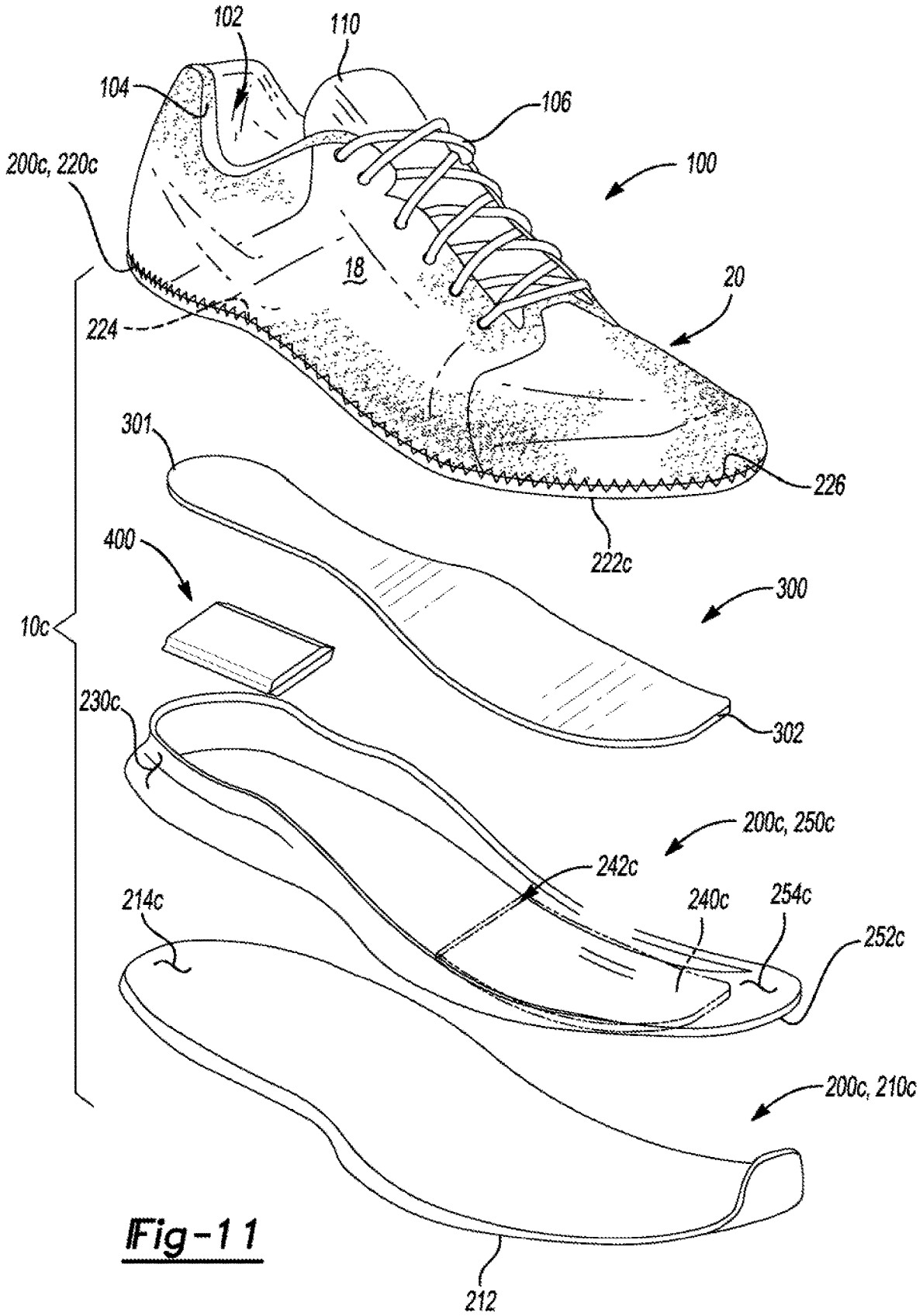
FIG. 11 is an exploded view of the article of footwear of FIG. 10 showing a cushioning member received within a cavity between an inner surface of an outsole and a bottom surface of a midsole, and a footwear plate embedded within the cushioning member in a forefoot region of the footwear and disposed between the cushioning member and the bottom surface of midsole in a heel region of the footwear.

FIGS. 10-12 provide an article of footwear 10*c* that includes an upper 100 and a sole structure 200*c* attached to the upper 100. In view of the substantial similarity in structure and function of the components associated with the article of footwear 10 with respect to the article of footwear 10*c*, like reference numerals are used hereinafter and in the drawings to identify like components while like reference numerals containing letter extensions are used to identify those components that have been modified.

FIG. 11 provides an exploded view of the article of footwear 10*c* showing the sole structure 200*c* including an outsole 210*c*, a cushioning member 250*c*, and a midsole 220*c* arranged in a layered configuration and defining a longitudinal axis L. The outsole 210*c* includes an inner surface 214*c* disposed on an opposite side of the outsole 210*c* than the ground-engaging surface 212. The midsole 220*c* includes a bottom surface 222*c* disposed on an opposite side of the midsole 220*c* than the footbed 224. The cushioning member 250*c* is disposed between the inner surface 214*c* and the bottom surface 222*c* to separate the midsole 220*c* from the outsole 210*c*. For example, the cushioning member 250*c* includes a bottom surface 252*c* opposing the inner surface 214*c* of the outsole 210*c* and a top surface 254*c* disposed on an opposite side of the cushioning member 250*c* than the bottom surface 252*c* and opposing the midsole 220*c*. The top surface 254*c* may be contoured to conform to the profile of the bottom surface (e.g., plantar) of the foot within the interior void 102. As with the cushioning member 250 of the article of FIGS. 1-3, the cushioning member 250*c* may define a sidewall 230*c* surrounding at least a portion of a perimeter of the second cushioning member 250*c*. The sidewall 230*c* may define a rim that extends around the perimeter of the midsole 220*c* when the cushioning member 250*c* attaches to the midsole 220*c*.

The cushioning member 250*c* may compress resiliently between the midsole 220*c* and the outsole 210*c* and may be formed from the same one or more materials forming the cushioning member 250 of FIGS. 1-3. For instance, the cushioning member 250*c* may be formed form one or more of EVA copolymers, polyurethanes, polyethers, olefin block copolymers, PEBA copolymers, and/or TPUs. The sole structure 200*c* may also incorporate the fluid-filled bladder 400 between the footwear plate 300 and the cushioning member 250*c* in at least one portion 12, 14, 16 of the sole structure 200*c* to enhance cushioning characteristics of the footwear 10*c* in responsive to ground-reaction forces. For instance, the bladder 400 may be filled with a pressurized fluid such as air, nitrogen, helium, sulfur hexafluoride, or liquids/gels. The cushioning member 250*c* may include a density within a range from about 0.05 grams per cubic centimeter ($g/cm^3$) to about 0.20 $g/cm^3$. In some examples, the density of the cushioning member 250*c* is approximately 0.1 $g/cm^3$. Moreover, the cushioning member 250 may include a hardness within the range from about eleven (11) Shore A to about fifty (50) Shore A. The one or more materials forming the cushioning member 250*c* may be suitable for providing an energy return of at least 60-percent (60%).

In some configurations, the cushioning member 250*c* defines a cavity 240*c* (e.g., sleeve) within an interior portion between the top surface 254*c* and the bottom surface 252*c* in the forefoot and mid-foot portions 12, 14, respectively, of the sole structure 200*c*. FIG. 12 provides a partial cross-sectional view taken along 12-12 of FIG. 10 showing the curved region 310 of the footwear plate 300 received within the cavity 240*c* of the cushioning member 250 and the substantially flat region 312 exposed from the cavity 240*c* between the top surface 254*c* of the cushioning member 250*c* and the bottom surface 222*c* of the midsole 220*c*. FIG. 12 shows the top surface 254*c* of the cushioning member 250*c* defining an access opening 242*c* to the cavity 240*c* for receiving the curved region 310 of the plate 300. Thus, the sole structure 200*c* incorporated by the article of footwear 10*c* of FIGS. 10-12 includes the top surface 254*c* of the cushioning member 250*c* affixing to the bottom surface 222*c* of the midsole 220*c* in the forefoot and mid-foot portions 12, 14, respectively, while the substantially flat region 312 of the plate 300 extending out of the cavity 240*c* of the cushioning member 250*c* at the access opening 242*c* is in direct contact with the bottom surface 222*c* in the heel portion 16. The entire bottom surface 252*c* of the cushioning member 250*c* affixes to the inner surface 214*c* of the outsole 210*c*. Accordingly, the cavity 240*c* defined by the cushioning member 250*c* is operative to embed/encapsulate at least a portion (e.g., curved region 310) of the plate 300 therein. In other words, the curved region 310 of the plate supporting the MTP joint of the foot is separated from the outsole 210*c* and the midsole 220*c* by respective portions of the cushioning member 250*c* on opposite sides of the cavity 240*c*. As with the cushioning member 250 and plate 300 of FIGS. 1-3, the cushioning member 250*c* and the plate 300 may substantially occupy the entire volume of space between the bottom surface 222*c* of the midsole 220*c* and the inner surface 214*c* of the outsole 210*c*. The insole 260 may be disposed upon the footbed 224 within the interior void 102 under the foot. The cushioning member 250*c* may encapsulate the bladder 400 or define a cut-out for receiving the bladder 400, while a portion of the plate 300 may be in direct contact with the bladder 400. In some configurations, the cushioning member 250*c* defines a greater thickness in the heel portion 16 of the sole structure 200*c* than in the forefoot portion 12. The cushioning member 250*c* may define a thickness in the forefoot portion 12 of the sole structure 200*c* within a range from about seven (7) millimeters (mm) to about twenty (20) mm. In one example, the thickness of the cushioning member 250*c* in the forefoot portion 12 is about twelve (12) mm. In some implementations, the thickness of the cushioning member 250*c* between the plate 300 and the bottom surface 222*c* of the midsole 220*c* in the forefoot portion 12 is within a range from about three (3) mm to about twenty-eight (28) mm. Additionally or alternatively, the thickness of the cushioning member 250*c* between the plate 300 and the inner surface 214*c* of the outsole 210*c* in the forefoot portion 12 is within a range from about two (2) mm to about thirteen (13) mm.

As described above with reference to FIGS. 1-3, the footwear plate 300 may include the uniform local stiffness that may or may not be anisotropic. For instance, the plate 300 may be formed from one or more tows of fibers including at least one of carbon fibers, aramid fibers, boron fibers, glass fibers, and polymer fibers. Thus, the plate 300 may provide a greater thickness along the longitudinal direction of the sole structure than the stiffness in direction transverse (e.g., perpendicular) to the longitudinal axis L. For instance, the stiffness of the plate 300 in the transverse direction may be approximately 10-percent to 20-percent of the thickness of the plate 300 along the longitudinal direction (e.g., parallel to longitudinal axis L). Moreover, the plate 300 may include a substantially uniform thickness within the range of about 0.6 mm to about 3.0 mm across the plate 300 or a non-uniform thickness that varies across the plate, e.g., the thickness of the plate 300 in the mid-foot portion 14 is greater than the thicknesses in the forefoot portion 12 and the heel portion 16.

The radius of curvature of the curved region 310 defines the anterior curved portion 322 extending between MTP point 320 and the AMP 302 at the toe end of the sole structure 200*a*, and the posterior curved portion 322 extending between the MTP point 320 and the aft point 326. In some configurations, the anterior curved portion 322 and the posterior curved portion 324 each include the same radius of curvature mirrored about the MTP point 320. In other configurations, the curved portions 322, 324 are each associated with a different radius of curvature. The curved portions 322, 324 may each account for about 30-percent (%) of the total length of the plate 300 while the length of the flat region 312 may account for the remaining 40-percent (%) of the length of the plate 300. The anterior curved and posterior curved portions 322, 324, respectively, of the curved region 310 provide the plate 300 with a longitudinal stiffness that reduces energy loss proximate to the MTP joint of the foot, as well as enhances rolling of the foot during running motions to thereby reduce a lever arm distance and alleviate strain on the ankle joint. In other configurations, the curved portions 322, 324 may each account for from about twenty-five percent (25%) to about thirty-five percent (35%) of the total length of the plate 300. The AMP 302 and the aft point 326 are located above the MTP point 320 and may be located above the MTP point 320 by a distance substantially equal position height H. Moreover, the length $L_A$ of the anterior curved portion 322 and the length $L_P$ of the posterior curved portion 324 (e.g., measured along the line extending substantially parallel to the longitudinal axis L between the MTP point 320 and respective ones of the AMP 302 and the aft point 326) may be substantially equal to one another or may be different. As described above with reference to FIGS. 1-3, varying the radius of curvature of the curved region 310 causes the lengths $L_A$ and $L_P$ and/or the height (H) of the anterior most point 302 and the aft point 306 to change relative to the MTP point 320. In doing so, the stiffness of the plate 300 may vary to provide a custom footwear plate 300 tailored for the wearer's shoe size, the intended use of the footwear 10, and/or the wearer's anatomical features of the foot.

FIGS. 13-15 provide an article of footwear 10*d* that includes an upper 100 and a sole structure 200*d* attached to the upper 100. In view of the substantial similarity in structure and function of the components associated with the article of footwear 10 with respect to the article of footwear 10*d*, like reference numerals are used hereinafter and in the drawings to identify like components while like reference numerals containing letter extensions are used to identify those components that have been modified.

FIG. 14 provides an exploded view of the article of footwear 10*d* showing the sole structure 200*d* including an outsole 210*d*, a cushioning member 250*d*, and a midsole 220*d* arranged in a layered configuration and defining a longitudinal axis L. The outsole 210*d* includes an inner surface 214*d* disposed on an opposite side of the outsole 210*d* than the ground-engaging surface 212. The midsole 220*d* includes a bottom surface 222*d* disposed on an opposite side of the midsole 220*d* than the footbed 224. The cushioning member 250*d* is disposed between the inner surface 214*d* and the bottom surface 222*d* to separate the midsole 220*d* from the outsole 210*d*. For example, the cushioning member 250*d* includes a bottom surface 252*d* opposing the inner surface 214*d* of the outsole 210*d* and a top surface 254*d* disposed on an opposite side of the cushioning member 250*d* than the bottom surface 252*d* and opposing the midsole 220*d*. The top surface 254*d* may be contoured to conform to the profile of the bottom surface (e.g., plantar) of the foot within the interior void 102. As with the cushioning member 250 of the article of FIGS. 1-3, the cushioning member 250*d* may define a sidewall 230*d* surrounding at least a portion of a perimeter of the second cushioning member 250*d*. The sidewall 230*d* may define a rim that extends around the perimeter of the midsole 220*d* when the cushioning member 250*d* attaches to the midsole 220*d*. The cushioning member 250*d* may compress resiliently between the midsole 220*d* and the outsole 210*d* and may be formed from the same one or more materials forming the cushioning member 250 of FIGS. 1-3. For instance, the cushioning member 250*d* may be formed form one or more of EVA copolymers, polyurethanes, polyethers, olefin block copolymers, PEBA copolymers, and/or TPUs. The cushioning member 250*d* may include a density within a range from about 0.05 grams per cubic centimeter ($g/cm^3$) to about 0.20 $g/cm^3$. In some examples, the density of the cushioning member 250*d* is approximately 0.1 $g/cm^3$. Moreover, the cushioning member 250*d* may include a hardness within the range from about eleven (11) Shore A to about fifty (50) Shore A. The one or more materials forming the cushioning member 250*d* may be suitable for providing an energy return of at least 60-percent (60%).

In some configurations, the cushioning member 250*d* defines a cavity 240*d* (e.g., sleeve) within an interior portion between the top surface 254*d* and the bottom surface 252*d* in the forefoot and mid-foot portions 12, 14, respectively, of the sole structure 200*d*. In these configurations, the bottom surface 252*d* of the cushioning member 250*d* tapers toward the top surface 254*d* to define a reduced thickness for the cushioning member 250*d* in the heel portion 16 compared to the thickness in the forefoot and mid-foot portion 12, 14, respectively.

FIG. 15 provides a partial cross-sectional view taken along 15-15 of FIG. 13 showing the curved region 310 of the footwear plate 300 received within the cavity 240*d* of the cushioning member 250 and the substantially flat region 312 exposed from the cavity 240*d* between the bottom surface 254*d* of the cushioning member 250*d* and the inner surface 214*d* of the midsole 220*d*. Whereas the top surface 254*c* of the cushioning member 250*c* of FIGS. 10-12 defines the access opening 242*c* to the cavity 240*c*, the bottom surface 252*d* of the cushioning member 250*d* defines an access opening 242*d* to the cavity 240*d* for receiving the curved region 310 of the plate 300. Thus, bottom surface 252*d* of the cushioning member 250*d* affixes to the inner surface 214*d* of the outsole 210*d* in the forefoot and mid-foot portions 12, 14, respectively, while the substantially flat region 312 of the plate 300 extending out of the cavity 240*d* of the cushioning member 250*d* at the access opening 242*d* formed through the bottom surface 252*d* is in direct contact with the inner surface 214*d* in the heel portion 16. In some examples, the aft point 326 of the plate 300 is disposed within a blend portion disposed between and connecting the curved region 310 to the substantially flat region 312 and the bottom surface 252*d* of the cushioning member 250*d* tapers upward toward the top surface 254*d* at a location proximate to the blend portion of the plate 300. FIG. 15 also shows the outsole 210*d* tapering into contact with the plate 300 as the bottom surface 252*d* of the cushioning member 250*d* tapers toward the top surface 252*d*. For instance, the outsole 210*d* tapers into contact with the substantially flat region 312 of the plate 300 at a location proximate to where the plate 300 extends through the access opening 242*d*. Accordingly, the cavity 240*d* defined by the cushioning member 250*d* is operative to embed/encapsulate at least a portion (e.g., curved region 310) of the plate 300 therein. In other words, the curved region 310 of the plate supporting the MTP joint of the foot is separated from the outsole 210*d* and the midsole 220*d* by respective portions of the cushioning member 250*d* on opposite sides of the cavity 240*d*. As with the cushioning member 250 and plate 300 of FIGS. 1-3, the cushioning member 250*d* and the plate 300 may substantially occupy the entire volume of space between the bottom surface 222*d* of the midsole 220*d* and the inner surface 214*d* of the outsole 210*d*. The insole 260 may be disposed upon the footbed 224 within the interior void 102 under the foot. The cushioning member 250*d* may define a thickness in the forefoot portion 12 of the sole structure 200*d* within a range from about seven (7) millimeters (mm) to about twenty (20) mm. In one example, the thickness of the cushioning member 250*d* in the forefoot portion 12 is about twelve (12) mm. In some implementations, the thickness of the cushioning member 250*d* between the plate 300 and the bottom surface 222*d* of the midsole 220*d* in the forefoot portion 12 is within a range from about three (3) mm to about twenty-eight (28) mm. Additionally or alternatively, the thickness of the cushioning member 250*d* between the plate 300 and the inner surface 214*d* of the outsole 210*d* in the forefoot portion 12 is within a range from about two (2) mm to about thirteen (13) mm.

FIGS. 16-18 provide a footwear plate 300*a* that may be incorporated into any one of the articles of footwear 10, 10*a*, 10*b*, 10*c*, and 10*d* of FIGS. 1-15 in place of the footwear plate 300. In view of the substantial similarity in structure and function of the components associated with the footwear plate 300 with respect to the footwear plate 300*a*, like reference numerals are used hereinafter and in the drawings to identify like components while like reference numerals containing letter extensions are used to identify those components that have been modified.

FIG. 16 provides a top perspective view of the footwear plate 300*a* defining a length that extends between the first end 301 corresponding to a posterior-most point and the second end 302 corresponding to the anterior most point (AMP) of the plate 300*a*. The terms "first end" and "posterior-most point" will be used interchangeably herein. The terms "second end" and "AMP" of the plate 300 will be used interchangeably herein. The footwear plate 300*a* may be segmented across the length to define a toe segment 362, a MTP segment 364, a bridge segment 366, and a heel segment 368. The toe segment 362 corresponds to the toes of the foot while the MTP segment corresponds to the MTP joint connecting the metatarsal bones with the phalanx bones of the foot. The toe segment 362 and the MTP segment 364 of the plate 300*a* may correspond to the forefoot portion 12 of the sole structure 200-200*d* of FIGS. 1-15. The bridge segment 366 corresponds with the arch area of the foot and connects the MTP segment 364 to the heel segment 368. The bridge segment 366 may correspond to the mid-foot portion 14 and the heel segment 358 may correspond to the heel portion 16 when the plate 300*a* is incorporated into the sole structure 200-200*d* of FIGS. 1-15. FIG. 16 shows the footwear plate 300*a* including the curved region 310 (including segments 362, 364, 366) and the substantially flat region 312 (including segment 368).

FIG. 17 provides a side view of the footwear plate 300*a* of FIG. 16 showing the MTP point 320 as a closest point of the footwear plate 300*a* to a horizontal reference plane RP extending substantially parallel to a ground surface (not shown). For instance, the MTP point 320 is tangent to the horizontal reference plane RP and may be disposed directly beneath the MTP joint of the foot when the foot is received by the interior void 102 of the footwear 10-10*d*. In other configurations, the MTP point 320 is disposed beneath and slightly behind the MTP joint of the foot such that anterior curved portion 322 is underneath the MPT joint of the foot. The anterior curved portion 322 of the curved region 310 may define a corresponding radius of curvature and a length $L_A$ between the MTP point 320 and the AMP 302, while the posterior curved portion 324 of the curved region 310 may define a corresponding radius of curvature and a length $L_P$ between the MTP point 320 and the aft point 326. As used herein, the $L_A$ and $L_P$ are each measured along the horizontal reference plane RP between the MTP point 320 and respective ones of the AMP 302 and the aft point 326. In some examples, the $L_A$ of the anterior curved portion 322 (including the toe segment 362 and the MTP segment 364) accounts for approximately thirty percent (30%) of the length of the sole structure 200-200*d*, the $L_P$ of the posterior curved portion 324 (including the bridge segment 366) accounts for approximately thirty percent (30%) of the length of the sole structure 200-200*d*, and the substantially flat portion 312 (including the heel segment 368) accounts for approximately forty percent (40%) of the length of the sole structure 200-200*d*. In other examples, the $L_A$ of the anterior curved portion 322 is within the range from about twenty-five percent (25%) to about thirty-five percent (35%) of the length of the sole structure 200-200*d*, the $L_P$ of the posterior curved portion 324 is within the range from about twenty-five percent (25%) to about thirty-five percent (35%) of the length of the sole structure 200-200*d*, and the substantially flat region 312 includes the remainder of the length of the sole structure 200-200*d*.

The radius of curvature associated with the anterior curved portion 322 results in the AMP 302 extending from the MTP point 320 at an angle $\alpha 1$ relative to the horizontal reference plane RP. Accordingly, the anterior curved portion 322 allows the toe segment 362 of the plate 300*a* to bias the toes of the foot in a direction away from the ground surface. The angle $\alpha 1$ may include a value within a range from about 12-degrees to about 35-degrees. In one example, angle $\alpha 1$ includes a value approximately equal to 24-degrees. Similarly, the radius of curvature associated with the posterior curved portion 324 results in the aft point 326 extending from the MTP point 320 at an angle $\beta 1$ relative to the horizontal reference plane RP. The angle $\beta 1$ may include a value within a range from about 12-degrees to about 35-degrees. In one example, angle $\beta 1$ includes a value approximately equal to 24-degrees. In some configurations, angles $\alpha 1$ and $\beta 1$ are substantially equal to one another such that the radii of curvature are equal to one another and share the same vertex.

In some implementations, the aft point 326 is disposed along a blend portion 328 along the curved region 310 of the plate 300 that includes a radius of curvature configured to join the curved region 310 at the posterior curved portion 324 to the substantially flat region 312. Thus, the blend portion 328 is disposed between and connecting the constant radius of curvature of the curved region 310 and the substantially flat region 312. In some examples, the blend portion includes a substantially constant radius of curvature. The blend portion 328 may allow the substantially flat region 312 of the plate to extend between the first end 301 (posterior-most point) and the aft point 326 in a direction substantially parallel to the horizontal reference plane RP (as well as the ground surface). As a result of the radius of curvature of the posterior curved portion 324 and the radius of curvature of the blend portion 328, the aft point 326 may include a position height $H_1$ above the MTP point 320. As used herein, the position height $H_1$ of the aft point 326 corresponds to a separation distance extending in a direction substantially perpendicular to the horizontal reference plane RP between the aft point 326 and the reference plane RP. The position height $H_1$ may include a value within the range from about 3 mm to about 28 mm in some examples, while in other examples the position height $H_1$ may include a value within the range from about 3 mm to about 17 mm. In one example, the position height $H_1$ is equal to about 17 mm. In some implementations, the posterior-most point 301 and the AMP 302 are co-planer at a junction of the blend portion 328 and the substantially flat region 312.

FIG. 18 provides a top view of the footwear plate 300*a* of FIG. 16 showing the toe segment 362, the MTP segment 364, the bridge segment 366, and the heel segment 368 defined across the length of the plate 300*a*. The MTP point 320 may reside within the MTP segment 364 joining the toe segment 362 to the bridge segment 366. The aft point 326 may be disposed within the bridge segment 366 at a location proximate to where the bridge segment 366 joins with the heel segment 368. For instance, the radius of curvature of the blend portion 328 (FIG. 17) may seamlessly join the bridge segment 366 associated with the posterior curved portion 324 to the heel segment 368 associated with the flat region 312 of the plate 300.

FIGS. 19-21 provide a footwear plate 300*b* that may be incorporated into any one of the articles of footwear 10, 10*a*, 10*b*, 10*c*, and 10*d* of FIGS. 1-15 in place of the footwear plate 300. In view of the substantial similarity in structure and function of the components associated with the footwear plate 300 with respect to the footwear plate 300*b*, like reference numerals are used hereinafter and in the drawings to identify like components while like reference numerals containing letter extensions are used to identify those components that have been modified.

FIG. 19 provides a top perspective view of the footwear plate 300*b* defining a length that extends between the first end 301 and an AMP 302*b* of the plate 300*b*. The plate 300*b* may be segmented across the length to define the toe segment 362, the MTP segment 364, the bridge segment 366, and the heel segment 368. FIG. 19 shows the footwear plate 300*b* including a curved region 310*b* (including segments 362, 364, 366) and the substantially flat region 312 (including segment 368).

FIG. 20 provides a side view of the footwear plate 300*b* of FIG. 19 showing an MTP point 320*b* of the curved region 310*b* of the footwear plate 300*b* tangent to the horizontal reference plane RP and disposed underneath the MTP joint of the foot when the foot is received by the interior void 102 of the footwear 10-10*d*. An anterior curved portion 322*b* extending between the MTP point 320*b* and the AMP 302*b* includes a radius of curvature that is smaller than the radius of curvature of the anterior curved portion 322 of FIGS. 16-18. Thus, the radius of curvature associated with the anterior curved portion 322*b* results in the AMP 302*b* extending from the MTP point 320*b* at an angle $\alpha 2$ relative to the horizontal reference plane RP that is greater than the angle $\alpha 1$ associated with the anterior curved portion 322 of FIGS. 16-18. Accordingly, the anterior curved portion 322*b* is associated with a steeper slope than that of the anterior curved portion 322 of FIGS. 16-18 such that the toe segment 362 of the plate 300*b* biases the toes of the foot further away from the ground surface compared to the plate 300*a* of FIGS. 16-18. In other examples, the $L_A$ of the anterior curved portion 322*b* is within the range from about twenty-five percent (25%) to about thirty-five percent (35%) of the length of the sole structure 200-200*d*, the $L_P$ of the posterior curved portion 324*b* is within the range from about twenty-five percent (25%) to about thirty-five percent (35%) of the length of the sole structure 200-200*d*, and the substantially flat region 312 includes the remainder of the length of the sole structure 200-200*d*.

Similarly, a posterior curved portion 324*b* extending between the MTP point 320*b* and an aft point 326*b* includes a radius of curvature that is smaller than the radius of curvature of the posterior curved portion 324 of FIGS. 16-18. Thus, the radius of curvature associated with the posterior curved portion 324*b* results in the aft point 326*b* extending from the MTP point 320*b* at an angle $\beta 2$ relative to the horizontal reference plane RP that is greater than the angle $\beta 1$ associated with the posterior curved portion 324 of FIGS. 16-18. Accordingly, the posterior curved portion 324*b* is associated with a steeper slope than that of the posterior curved portion 324 of FIGS. 16-18 such that the bridge segment 366 of the plate 300*b* biases the MTP joint of the foot toward the ground surface further away from the heel of the foot compared to the plate 300*a* of FIGS. 16-18. The angle $\alpha 2$ may include a value within a range from about 12-degrees to about 35-degrees. In one example, angle $\alpha 2$ includes a value approximately equal to 24-degrees. Similarly, the radius of curvature associated with the posterior curved portion 324*b* results in the aft point 326*b* extending from the MTP point 320*b* at an angle $\beta 2$ relative to the horizontal reference plane RP. The angle $\beta 2$ may include a value within a range from about 12-degrees to about 35-degrees. In one example, angle $\beta 1$ includes a value approximately equal to 24-degrees. In some configurations, angles $\alpha 2$ and $\beta 2$ are substantially equal to one another such that the radii of curvature are equal to one another and share the same vertex.

The curved portions 322*b*, 324*b* may each include a corresponding radius of curvature that may be the same or may be different from one another. In some examples, the radius of curvatures differ from one another by at least two percent (2%). The radius of curvatures for the curved regions 322*b*, 324*b* may range from about 200 millimeters (mm) to about 400 mm. In some configurations, the anterior curved portion 322*b* includes a radius of curvature that continues the curvature of the posterior curved portion 324*b* such that the curved portions 322*b*, 324*b* define the same radius of curvature and share a same vertex. Additionally or alternatively, the plate may define a radius of curvature that connects the posterior curved portion 324*b* to the substantially flat region 312 of the plate 300*b*. As used herein, the term "substantially flat" refers to the flat region 312 within five (5) degrees horizontal, i.e., within five (5) degrees parallel to the ground surface.

In some implementations, the aft point 326 is disposed along a blend portion 328*b* along the curved region 310*b* of the plate 300*b* that includes a radius of curvature configured to join the curved region 310*b* at the posterior curved portion 324*b* to the substantially flat region 312*b*. Thus, the blend portion 328*b* is disposed between and connecting the constant radius of curvature of the curved region 310 and the substantially flat region 312. In some examples, the blend portion includes a substantially constant radius of curvature. As with the blend portion 328 of the curved region 310 of FIGS. 16-18, the blend portion 328*b* may allow the substantially flat region 312 of the plate 300*b* to extend between the first end 301 (posterior-most point) and the aft point 326*b* in a direction substantially parallel to the horizontal reference plane RP (as well as the ground surface). As a result of the radius of curvature of the posterior curved portion 324*b* and the radius of curvature of the blend portion 328*b*, the aft point 326*b* may include a position height $H_2$ above the MTP point 320 that is greater than the position height $H_1$ of the aft point 326 above the MTP point 320 of FIGS. 16-18. The position height $H_2$ may include a value within the range from about 3 mm to about 28 mm in some examples, while in other examples the position height $H_2$ may include a value within the range from about 3 mm to about 17 mm. In one example, the position height $H_2$ is equal to about 17 mm. In some implementations, the posterior-most point 301 and the AMP 302*b* are co-planer at a junction of the blend portion 328*b* and the substantially flat region 312.

FIG. 21 provides a top view of the footwear plate 300*b* of FIG. 19 showing the toe segment 362, the MTP segment 364, the bridge segment 366, and the heel segment 368 segmented across the length of the plate 300*b*. The MTP point 320*b* may reside within the MTP segment 364 joining the toe segment 362 to the bridge segment 366. The aft point 326*b* may be disposed within the bridge segment 366 at a location proximate to where the bridge segment 366 joins with the heel segment 368. For instance, the radius of curvature of the blend portion 328*b* (FIG. 20) may seamlessly join the bridge segment 366 associated with the posterior curved portion 324*b* to the heel segment 368 associated with the flat region 312 of the plate 300*b*.

FIGS. 22-24 provide a footwear plate 300*d* that may be incorporated into any one of the articles of footwear 10, 10*a*, 10*b*, 10*c*, and 10*d* of FIGS. 1-15 in place of the footwear plate 300. In view of the substantial similarity in structure and function of the components associated with the footwear plate 300 with respect to the footwear plate 300*c*, like reference numerals are used hereinafter and in the drawings to identify like components while like reference numerals containing letter extensions are used to identify those components that have been modified.

FIG. 22 provides a top perspective view of the footwear plate 300*c* defining a length that extends between the first end 301 and an AMP 302*c* of the plate 300*c*. The plate 300*c* may be segmented across the length to define the toe segment 362, the MTP segment 364, the bridge segment 366, and the heel segment 368. FIG. 22 shows the footwear plate 300*c* including a curved region 310*c* (including segments 362, 364, 366) and the substantially flat region 312 (including segment 368).

FIG. 23 provides a side view of the footwear plate 300*c* of FIG. 22 showing the curved region 310*c* being semicircular such that an anterior curved portion 322*c* and a posterior curved portion 324*c* are associated with a same radius of curvature R and share a common vertex V such that the curved portions 322*c*, 324*c* are mirrored about an MTP point 320*c*. In some configurations, the radius R includes a value within a range from about 86 mm to about 202 mm. In other configurations, the radius R includes a value within a range from about 140 mm to about 160 mm. Example values for the radius R may include about 87 mm, 117 mm, 151 mm, or 201 mm. The MTP point 320*c* is tangent to the horizontal reference plane RP and disposed underneath the MTP joint of the foot when the foot is received by the interior void 102 of the footwear 10-10*d*. Accordingly, the MTP point 320*c* corresponds to a center of the curved region 310*c* including the curved portions 322*c*, 324*c*. The anterior curved portion 322*c* extends between the MTP point 320*c* and an AMP 302*b* while the posterior curved portion 324*c* extends between the MTP point 320*c* and an aft point 326*c*.

The anterior curved portion 322*c* may define a length $L_A$ between the MTP point 320*c* and the AMP 302*c* that is substantially equal to a length $L_P$ of the posterior curved portion 324*c* between the MTP point 320*c* and the aft point 326*c*. As used herein, the $L_A$ and $L_P$ are each measured along the horizontal reference plane RP between the MTP point 320*c* and respective ones of the AMP 302*c* and the aft point 326*c*. In some configurations, the $L_A$ and $L_P$ are each equal to about 81 mm when the footwear plate 300*c* is incorporated by an article of footwear 10-10*d* associated with a men's size 10. In some examples, the $L_A$ of the anterior curved portion 322*c* (including the toe segment 362 and the MTP segment 364) accounts for approximately thirty percent (30%) of the length of the sole structure 200-200*d*, the $L_P$ of the posterior curved portion 324 (including the bridge segment 366) accounts for approximately thirty percent (30%) of the length of the sole structure 200-200*d*, and the substantially flat portion 312 (including the heel segment 368) accounts for approximately forty percent (40%) of the length of the sole structure 200-200*d*. In other examples, the $L_A$ of the anterior curved portion 322*c* is within the range from about twenty-five percent (25%) to about thirty-five percent (35%) of the length of the sole structure 200-200*d*, the $L_P$ of the posterior curved portion 324*c* is within the range from about twenty-five percent (25%) to about thirty-five percent (35%) of the length of the sole structure 200-200*d*, and the substantially flat region 312 includes the remainder of the length of the sole structure 200-200*d*.

The AMP 302*c* extends from the MTP point 320*c* at an angle α3 relative to the horizontal reference plane RP while the aft point 326*c* extends from the MTP point 320*c* at an angle β3 relative to the horizontal reference plane RP. As the curved portions 322*c*, 324*c* are associated with the same radius of curvature R and share the common vertex V, the angles α3 and β3 are substantially equal to one another. The value of the angles α3 and β3 ranges from about 11 degrees to about 35 degrees in some examples and from about 20 degrees to about 25 degrees in other examples. Example values for the angles α3 and β3 include about 12 degrees, 16 degrees, 22 degrees, or 57 degrees. The angle α3 corresponds to the angle by which the toe segment 362 of the plate 300*c* biases the toes of the foot upward and away from the ground surface when the foot is received by the interior void 102 of the footwear 10-10*d*.

Moreover, the aft point 326*c* and the AMP 302*c* may each include a same position height $H_3$ above the MTP point 320*c*. As with the plates 300*a* and 300*b* of FIGS. 16-18 and 19-21, respectively, the position height $H_3$ of the aft point 326*c* and the MTP point 320*c* corresponds to a separation distance extending in a direction substantially perpendicular to the horizontal reference plane RP between the MTP point 320*c* and respective ones of the aft point 326*c* and the AMP 302*c*. In some configurations, the position height $H_3$ includes a value within a range from about 17 mm to about 57 mm. Example values for the position height $H_3$ may include about 17 mm, 24 mm, 33 mm, or 57 mm.

In some implementations, the aft point 326*c* is disposed along a blend portion 328*c* along the curved region 310*c* of the plate 300 that includes a radius of curvature configured to join the curved region 310*c* at the posterior curved portion 324*c* to the substantially flat region 312. Thus, the blend portion 328*c* is disposed between and connecting the constant radius of curvature of the curved region 310*c* and the substantially flat region 312. In some examples, the blend portion includes a substantially constant radius of curvature. The blend portion 328*c* may allow the substantially flat region 312 of the plate 300*c* to extend between the first end 301 (posterior-most point) and the aft point 326*c* in a direction substantially parallel to the horizontal reference plane RP (as well as the ground surface). Accordingly, the AMP 302*c* and the aft point 326*c* may be substantially co-planar with the junction between the blend portion 328*c* and the substantially flat region 312. As such, the heel segment 368 and a portion of the bridge segment 366 extending between the first end 301 and the aft point 326*c* of the plate 300*c* can be substantially flat. The blend portion 328*c* may include a radius of curvature of about 133.5 mm when the footwear plate 300*c* is incorporated by an article of footwear 10-10*d* associated with a men's size 10. In some implementations, the posterior-most point 301 and the AMP 302*c* are co-planer at a junction of the blend portion 328*c* and the substantially flat region 312.

FIG. 24 provides a top view of the footwear plate 300*c* of FIG. 22 showing the toe segment 362, the MTP segment 364, the bridge segment 366, and the heel segment 368 segmented across the length of the plate 300*c*. The MTP point 320*c* may reside within the MTP segment 364 joining the toe segment 362 to the bridge segment 366. The aft point 326*b* may be disposed within the bridge segment 366 at a location proximate to where the bridge segment 366 joins with the heel segment 368. For instance, the radius of curvature of the blend portion 328*c* (FIG. 23) may seamlessly join the bridge segment 366 associated with the posterior curved portion 324*c* to the heel segment 368 associated with the flat region 312 of the plate 300*c*. In view of the foregoing, the footwear plate 300*c* of FIGS. 22-24, the following parameters may be designated for a size 10 men's shoe:

1. R=201 mm, α3=12 degrees, $H_3$=17 mm, $L_A$=81 mm, and radius of curvature of blend portion 328*c* equal to 134 mm;
2. R=151 mm, α3=16 degrees, $H_3$=24 mm, $L_A$=81 mm, and radius of curvature of blend portion 328*c* equal to 134 mm;
3. R=117 mm, α3=22 degrees, $H_3$=33 mm, $L_A$=81 mm, and radius of curvature of blend portion 328*c* equal to 134 mm; and
4. R=87 mm, α3=35 degrees, $H_3$=57 mm, $L_A$=81 mm, and radius of curvature of blend portion 328*c* equal to 134 mm.

With reference to the footwear plates 300-300*c* of FIGS. 1-24, the curved region 322-322*c* allows the overall longitudinal stiffness of the plate 300-300*c* to reduce energy loss at the MTP joint of the wearer's foot while facilitating rolling of the foot during walking/running motions to thereby reduce a lever arm distance and alleviate strain at the ankle joint of the wearer. The radius of curvature associated with the anterior curved portion 322-322*c* particularly influences the longitudinal stiffness of the plate 300-300*c* as well as how the foot will roll during walking/running motions. In some examples, the plate 300-300*c* omits the substantially flat region 312 to define a length extending between the aft point 326-326*c* and the AMP 302-302*c*. The MTP point 320-320*c* corresponds to the closest (e.g., lowest) point of the plate 300-300*c* to the ground surface and may located at, or just behind, the MTP joint of the foot when received by the interior void 102 of the footwear 10-10*d* on top of the sole structure 200-200*d*. One or more cushioning members 250-250*c*, 270 may be incorporated by the sole structure 200-200*d*. The cushioning member(s) 250-250*c*, 270 may define a greatest thickness over top the MTP point 320-320*c* of the footwear plate 300-300*c* for maximizing the distance between the MTP joint of the foot and the MTP point 320-320*c*. The cushioning member(s) 250-250*c*, 270 may include high performance (soft and low energy loss) foam materials having a resiliency of at least 60-percent when compressed under an applied load to assist in returning energy during use of the footwear 10-10*d* while performing walking/running movements. The different geometries of the footwear plates 300-300*c* impart different mechanical advantages to athletes, such as runners having different running styles, e.g., forefoot strikers vs. heel strikers. The radii of curvature of the curved portions 322-322*c*, 324-324*c* produce different angles α1-α3, such that position heights H-$H_3$ differ for different shoe sizes.

FIG. 25 provides a top view of a footwear plate 300*d* that may be incorporated into any one of the articles of footwear 10, 10*a*, 10*b*, 10*c*, and 10*d* of FIGS. 1-15 in place of the footwear plate 300. In view of the substantial similarity in structure and function of the components associated with the footwear plate 300 with respect to the footwear plate 300*d*, like reference numerals are used hereinafter and in the drawings to identify like components while like reference numerals containing letter extensions are used to identify those components that have been modified.

The footwear plate 300*d* defines a length that extends between the first end 301 and the second end 302 and is segmented across the length to define the toe segment 362, the MTP segment 364, a bridge segment 366*d*, and the heel segment 368. The bridge segment 366*d* of the plate 300*d* defines a reduced width at a location proximate to the heel segment 368 compared to the widths of the bridge segment 366 of the plates 300*a*, 300*b*, 300*c*. The narrow bridge segment 366*d* reduces the weight of the footwear plate 300*d* while increasing flexibility thereof. The MTP segment 364 is associated with a widest part of the plate 300*d* while the toe segment 362 is slightly narrow to support the toes of the foot.

Referring to FIG. 26, a top view of a footwear plate 300*e* that may be incorporated into any one of the articles of footwear 10, 10*a*, 10*b*, 10*c*, and 10*d* of FIGS. 1-15 in place of the footwear plate 300. In view of the substantial similarity in structure and function of the components associated with the footwear plate 300 with respect to the footwear plate 300*e*, like reference numerals are used hereinafter and in the drawings to identify like components while like reference numerals containing letter extensions are used to identify those components that have been modified.

FIG. 26 shows the footwear plate 300*e* without the heel segment 368 associated with the substantially flat region 312. The plate 300*e* defines a reduced length extending between a first end 301*e* and the second end 302 and is segmented across the length to define the toe segment 362, the MTP segment 364, and a truncated bridge segment 366*e*. Here, the first end 301*e* of the plate 300*e* is associated with the aft point 326-326*d* of the plates 300-300*d*.

In some examples, the truncated bridge segment 366*e* is associated with a reduced length sufficient for supporting a Tarsometatarsal joint of the foot. As such, the plate 300*e* may define only the curved region 310 including the truncated bridge segment 366*e*, the MTP segment 364, and the toe segment 362. Moreover, the plate 300*e* may be formed from one contiguous sheet of material.

FIG. 27 provides a top view of a footwear plate 300*f* that may be incorporated into any one of the articles of footwear 10, 10*a*, 10*b*, 10*c*, and 10*d* of FIGS. 1-15 in place of the footwear plate 300. In view of the substantial similarity in structure and function of the components associated with the footwear plate 300 with respect to the footwear plate 300*f*, like reference numerals are used hereinafter and in the drawings to identify like components while like reference numerals containing letter extensions are used to identify those components that have been modified.

The footwear plate 300*f* defines a length extending between the first end 301 and the second end 302 and through a split forefoot portion 12*f*, the mid-foot portion 14, and the heel portion 16 thereof. The plate 300*f* includes the curved region 310 extending through the split forefoot portion 12*f* and the mid-foot portion 14. The plate 300*f* may also include the substantially flat region 312 extending through the heel portion 16 from the curved region 310 to the first end 301 of the plate 300*f*.

The split forefoot portion 12*f* of the plate 300*f* includes a lateral segment 371 and a medial segment 372. In some examples, the lateral and medial segments 371, 372, respectively, extend from the MTP point 320 of the plate 300*f*. Splitting the forefoot portion 12*f* into the lateral segment 371 and the medial segment 372 may provide greater flexibility of the plate 300*f* In some examples, the medial segment 372 is wider than the lateral segment 371. In one example, the medial segment 372 is associated with a width suitable for supporting a first MTP bone (e.g., big toe) and a hallux of the foot. The plate 300*f* may be formed from one contiguous sheet of material.

FIG. 28 provides a top view of a footwear plate 300*g* that may be incorporated into any one of the articles of footwear 10, 10*a*, 10*b*, 10*c*, and 10*d* of FIGS. 1-15 in place of the footwear plate 300. In view of the substantial similarity in structure and function of the components associated with the footwear plate 300 with respect to the footwear plate 300*g*, like reference numerals are used hereinafter and in the drawings to identify like components while like reference numerals containing letter extensions are used to identify those components that have been modified.

The footwear plate 300*g* defines a length extending between the first end 301 and the second end 302 and through a finger-shaped forefoot portion 12*g*, the mid-foot portion 14, and the heel portion 16 thereof. The plate 300*g* includes the curved region 310 extending through the finger-shaped forefoot portion 12*g* and the mid-foot portion 14. The plate 300*g* may also include the substantially flat region 312 extending through the heel portion 16 from the curved region 310 to the first end 301 of the plate 300*g*.

The finger-shaped forefoot portion 12*g* of the plate 300*g* includes a medial segment 372*g* having a lateral curvature 374. In some examples, the medial segment 372*g* extends from the MTP point 320 of the plate 300*g* and is associated with a width suitable for supporting the first MTP bone (e.g., big toe) of the foot. The lateral curvature 374 removes a portion of the plate 300*f* that would otherwise support the second through fifth MTP bones. The plate 300*g* may be formed from one contiguous sheet of material.

FIG. 29 provides a top view of a footwear plate 300*h* that may be incorporated into any one of the articles of footwear 10, 10*a*, 10*b*, 10*c*, and 10*d* of FIGS. 1-15 in place of the footwear plate 300. In view of the substantial similarity in structure and function of the components associated with the footwear plate 300 with respect to the footwear plate 300*h*, like reference numerals are used hereinafter and in the drawings to identify like components while like reference numerals containing letter extensions are used to identify those components that have been modified.

The footwear plate 300*h* defines a length extending between the first end 301 and the second end 302 and through a halo-shaped forefoot portion 12*h*, the mid-foot portion 14, and the heel portion 16 thereof. The plate 300*h* includes the curved region 310 extending through the halo-shaped forefoot portion 12*h* and the mid-foot portion 14. The plate 300*h* may also include the substantially flat region 312 extending through the heel portion 16 from the curved region 310 to the first end 301 of the plate 300*h*.

The halo-shaped forefoot portion 12*h* of the plate 300*h* includes an interior cut-out region 380 formed through the forefoot portion 12*h* of the plate 300*h*. The cut-out region 380 is surrounded by a rim 382 bounded by an outer periphery of the plate 300*h*. In some examples, the rim 382 extends from the MTP point 320 of the plate 300*h* and is configured to support the foot underneath while the interior cut-out region 380 is associated with an open area to reduce weight of the plate 300*h*. The plate 300*h* may be formed from one contiguous sheet of material.

FIG. 30 provides a top view of a footwear plate 300*i* that may be incorporated into any one of the articles of footwear 10, 10*a*, 10*b*, 10*c*, and 10*d* of FIGS. 1-15 in place of the footwear plate 300. In view of the substantial similarity in structure and function of the components associated with the footwear plate 300 with respect to the footwear plate 300*i*, like reference numerals are used hereinafter and in the drawings to identify like components while like reference numerals containing letter extensions are used to identify those components that have been modified.

The footwear plate 300*i* defines a length extending between the first end 301 and the second end 302 and through a claw-shaped forefoot portion 12*i*, the mid-foot portion 14, and the heel portion 16 thereof. The plate 300*i* includes the curved region 310 extending through the claw-shaped forefoot portion 12*i* and the mid-foot portion 14. The plate 300*i* may also include the substantially flat region 312 extending through the heel portion 16 from the curved region 310 to the first end 301 of the plate 300*i*.

The claw-shaped forefoot portion 12*i* of the plate 300*i* includes a lateral segment 371*i* and a medial segment 372*i*. In some examples, the lateral and medial segments 371*i*, 372*i*, respectively, extend from the MTP point 320 of the plate 300*f* The segments 371*i*, 372*i* may cooperate to define an interior cut-out region 380*i* similar to the cut-out region of the plate 300*h* of FIG. 29 except an opening 384 separates the segments 371*i*, 372*i* to allow the segments 371*i*, 372*i* to flex independently from one another. Thus, the claw-shaped forefoot portion 12*i* provides lateral and medial segments 371*i*, 372*i*, respectively, capable of flexing independently of one another similar to the segments 371, 372 of the split-forefoot portion 12*f* of FIG. 27 except interior cut-out region 380*i* provides the plate 300*i* with a reduced weight compared to the weight of the plate 300*f* incorporating the split forefoot portion 12*f*. The plate 300*i* may be formed from one contiguous sheet of material.

FIGS. 31 and 32 provide an article of footwear 10*e* that includes an upper 100 and a sole structure 200*e* attached to the upper 100. In view of the substantial similarity in structure and function of the components associated with the article of footwear 10 with respect to the article of footwear 10*e*, like reference numerals are used hereinafter and in the drawings to identify like components while like reference numerals containing letter extensions are used to identify those components that have been modified.

The sole structure 200*e* may include an outsole 210*e*, a cushioning member 200*e*, the footwear plate 300, and a midsole 200*e* arranged in a layered configuration. FIG. 32 provides a partial cross-sectional view taken along line 32-32 of FIG. 31 showing the footwear plate 300 disposed between the cushioning member 250*e* and the midsole 220*e* in the mid-foot and heel portions 14, 16, respectively, and between the outsole 210*e* and the midsole 220*e* in the forefoot portion 12. The cushioning member 250*e* includes a bottom surface 252*e* opposing a ground surface 2 and a top surface 254*e* disposed on an opposite side of the cushioning member 250*e* than the bottom surface 252*e* and affixed to the plate 300. The outsole 210*e* may correspond to one or more ground-contacting segments that may affix to the bottom surface 252*e* of the cushioning member 250*e* and the plate 300. In some configurations, the outsole 210*e* is omitted so that the bottom surface 252*e* of the cushioning member 250*e* contacts the ground surface 2 in the mid-foot and heel portions 14, 16, respectively, of the sole structure 200*e*, while the plate 300 contacts the ground surface 2 in the forefoot portion 12 of the sole structure 200*e*, i.e., the curved region 310 of the plate 300.

In some implementations, one or more protrusions 800 (e.g., track spikes) extend away from the plate 300 and the outsole 210*e* in a direction toward the ground surface 2 to provide traction therewith. The protrusions 800 may attach directly to the plate 300 or the outsole 210*e*. FIG. 32 shows no cushioning material is disposed above the MTP point 320 (e.g., between the plate 300 and the midsole 220*e*) or below the MTP point 320 (e.g., between the plate 300 and the outsole 210*e*). Accordingly, the cushioning material 250*e* is provided in the mid-foot and heel portions 14, 16, respectively, to attenuate an initial impact of ground-reaction forces during running motions while no cushioning material

250*e* is provided in the forefoot portion 12 where cushioning is less essential to reduce the weight of the sole structure 200*e*. The exemplary footwear 10*e* incorporating the sole structure 200*e* may be associated with a track shoe for shorter distance track events. Moreover, the insole 260 may be disposed upon the footbed 224 of the midsole 220*e* within the interior void 102 underneath the foot.

FIGS. 33 and 34 provide an article of footwear 10*e* that includes an upper 100 and a sole structure 200*f* attached to the upper 100. In view of the substantial similarity in structure and function of the components associated with the article of footwear 10 with respect to the article of footwear 10*f*, like reference numerals are used hereinafter and in the drawings to identify like components while like reference numerals containing letter extensions are used to identify those components that have been modified.

The sole structure 200*f* may include an outsole 210*f*, a cushioning member 200*f*, the footwear plate 300, and a midsole 200*f* arranged in a layered configuration. FIG. 34 provides a partial cross-sectional view taken along line 34-34 of FIG. 33 showing the footwear plate 300 disposed between the cushioning member 250*f* and the midsole 220*f*, and the cushioning member 250*f* disposed between the plate 300 and the outsole 210*f* and/or the ground-surface 2. The cushioning member 250*f* includes a bottom surface 252*f* opposing a ground surface 2 and a top surface 254*f* disposed on an opposite side of the cushioning member 250*f* than the bottom surface 252*f* and affixed to the plate 300. The outsole 210*f* may correspond to one or more ground-contacting segments that may affix to the bottom surface 252*f* of the cushioning member 250*f*. In some configurations, the outsole 210*f* is omitted so that the bottom surface 252*f* of the cushioning member 250*f* contacts the ground surface 2. Moreover, the insole 260 may be disposed upon the footbed 224 of the midsole 220*f* within the interior void 102 underneath the foot.

The cushioning member 250*f* may define a greater thickness in the heel portion 16 of the sole structure 200*f* than in the forefoot portion 12. In other words, a gap or distance separating outsole 210*f* and the midsole 220*f* decreases in a direction along the longitudinal axis L of the sole structure 200 from the heel portion 16 toward the forefoot portion 12. In some implementations, the top surface 254*f* of the cushioning member 250*f* is smooth and includes a surface profile contoured to match the surface profile of the footwear plate 300 such that the footwear plate 300 and the cushioning member 250*f* mate flush with one another. The cushioning member 250*f* may define a thickness in the forefoot portion 12 of the sole structure within a range from and including eight (8) mm to about and including nine (9) mm. Accordingly, the thickness of the cushioning member 250*f* opposing the curved region 310 of the plate 300 may be only thick enough to prevent the plate 300 from directly contacting the ground surface 2 during running motions.

In some implementations, the one or more protrusions 800 (e.g., track spikes) extend away from the plate 300 and the outsole 210*f* in a direction toward the ground surface 2 to provide traction therewith. The protrusions 800 may attach directly to the plate 300, the cushioning member 250*f*, or the outsole 210*f*.

FIGS. 35 and 36 provide an article of footwear 10*g* that includes an upper and a sole structure 200*g* attached to the upper 100. In view of the substantial similarity in structure and function of the components associated with the article of footwear 10 with respect to the article of footwear 10*g*, like reference numerals are used hereinafter and in the drawings to identify like components while like reference numerals containing letter extensions are used to identify those components that have been modified.

FIG. 35 provides a top perspective view of the article of footwear 10*g* showing the sole structure 200*g* including an outsole 210*g*, a cushioning member 250*g*, the footwear plate 300, and the midsole 220 arranged in a layered configuration and defining a longitudinal axis L. In some configurations, a peripheral edge of the footwear plate 300 is visible from the exterior of the footwear 10*g* along the lateral and medial sides 18, 20, respectively. In these configurations, the footwear 10*g* may be designed with an intended use for walking.

FIG. 36 provides a partial cross-sectional view taken along line 36-36 of FIG. 35 showing the footwear plate 300 disposed between the cushioning member 250*g* and the midsole 220, and the cushioning member 250*g* disposed between the plate 300 and the outsole 210*g*. The insole 260 may be disposed upon the footbed 224 within the interior void 102 under the foot. While not included in the configuration of FIG. 36, the fluid-filled bladder 400 of FIGS. 1-3 could be incorporated by the sole structure 200*g* to provide additional cushioning. The outsole 210*g* includes a ground-engaging surface 212*g* and an inner surface 214*g* disposed on an opposite side of the outsole 210*g* than the ground-engaging surface 212*g* and opposing a bottom surface 252*g* of the cushioning member 250*g*. The cushioning member 250*g* includes the bottom surface 252*g* and a top surface 254*g* disposed on an opposite side of the cushioning member 250*g* than the bottom surface 252*g*.

The configuration of the sole structure 200*g* is substantially identical to the sole structure 200 of FIGS. 1-3 except that the sole structure 200*g* includes a plurality of apertures 255 formed through the outsole 210*g* and the cushioning member 250*g* to expose portions of the plate 300 when viewed from the bottom of the footwear 10*g*. FIG. 36 shows the plurality of apertures 255 located in the heel portion 16 and the forefoot portion 12. Other configurations may include more/less apertures 255 in the heel portion 16 and/or forefoot portion 12 as well as apertures in the mid-foot portion 14. In some implementations, only one of the portions 12, 14, 16 includes apertures 255. Each aperture 255 may be formed through the outsole 210*g* and the cushioning member 250*g* and extend in a direction substantially perpendicular to the longitudinal axis L. Advantageously, the apertures 255 are operative to reduce the overall weight of the sole structure 200*g* to provide a lighter article of footwear 10*g*. Apertures 255 may similarly be formed through any of the sole structures 200-200*f* of FIGS. 1-15 and 33-36.

FIGS. 37-39 provide an article of footwear 10*h* that includes an upper 100 and a sole structure 200*h* attached to the upper 100. In view of the substantial similarity in structure and function of the components associated with the article of footwear 10 with respect to the article of footwear 10*h*, like reference numerals are used hereinafter and in the drawings to identify like components while like reference numerals containing letter extensions are used to identify those components that have been modified.

The sole structure 200*h* may include the outsole 210, a first cushioning member 250*h*, a plate formed from a fluid-filled bladder 400*h*, and a midsole 220*a* arranged in the layered configuration. FIG. 38 provides an exploded view of the article of footwear 10*h* showing the sole structure 200*h* (e.g., the outsole 210*h*, the cushioning member 250*h*, and the midsole 220*h*) defining a longitudinal axis L. The outsole 210*h* includes an inner surface 214*h* disposed on an opposite side of the outsole 210 than the ground-engaging surface 212. The midsole 220*h* includes a bottom surface 222*h* disposed on an opposite side of the midsole 220*h* than the footbed 224 and opposing the inner surface 214*h* of the outsole 210*h*.

The cushioning member 250*h* and the fluid-filled bladder 400*h* are disposed between the inner surface 214*h* and the bottom surface 222*h* to separate the midsole 220*h* from the outsole 210*h*. For example, the cushioning member 250*h* includes the bottom surface 252 received by the inner surface 214*h* of the outsole 210*h* and a top surface 254*h* disposed on an opposite side of the cushioning member 250*h* than the bottom surface 252 and opposing the midsole 220*h* to support the bladder 400*h* thereon. In some examples, a sidewall 230*h* surrounds at least a portion of a perimeter of the cushioning member 250*h* and separates the cushioning member 250*h* and the midsole 220*h* to define a cavity 240*h* therebetween. For instance, the sidewall 230*h* may define a rim around at least a portion of the perimeter of the contoured top surface 254*h* of the cushioning member 250 to cradle the foot during use of the footwear 10 when performing walking or running movements. The rim may extend around the perimeter of the midsole 220 when the cushioning member 250 attaches to the midsole 220.

In some configurations, the fluid-filled bladder 400*h* is disposed upon the top surface 254*h* of the cushioning member 250*h* and underneath the midsole 220*h* to reduce energy loss at the MTP joint while enhancing rolling of the foot as the footwear 10*h* rolls for engagement with a ground surface during a running motion. As with the footwear plate 300 of FIGS. 1-3, the fluid-filled bladder 400*h* includes a greater stiffness than the stiffness of the cushioning member 250*h* and the outsole 210*h*. The fluid-filled bladder 400*h* may define a length extending through at least a portion of the length of the sole structure 200*h*. In some examples, the length of the bladder 400*h* extends through the forefoot, mid-foot, and heel portions 12, 14, 16 of the sole structure 200*h*. In other examples, the length of the bladder 400*h* extends through the forefoot portion 12 and the mid-foot portion 14, and is absent from the heel portion 16.

The cushioning member 250*h* may compress resiliently between the midsole 220*h* and the outsole 210*h*. The cushioning member 250*h* may be formed from a slab of polymer foam which may be formed from the same one or more materials forming the cushioning member 250 of FIGS. 1-3. For instance, the cushioning member 250*h* may be formed from one or more of EVA copolymers, polyurethanes, polyethers, olefin block copolymers, PEBA copolymers, and/or TPUs. The fluid-filled bladder 400*h* may also enhance cushioning characteristics of the footwear 10*h* in response to ground-reaction forces. For example, the bladder 400*h* may be filled with a pressurized fluid such as air, nitrogen, helium, sulfur, hexafluoride, or liquids/gels.

The length of the fluid-filled bladder 400*h* may be the same as or less than the length of the cushioning member 250*h*. The length, width, and thickness of the bladder 400*h* may substantially occupy the volume of space (e.g., cavity 240*h*) between the top surface 254*h* of the cushioning member 250*h* and the bottom surface 222*h* of the midsole 220*h* and may extend through the forefoot, mid-foot, and heel portions 12, 14, 16, respectively, of the sole structure 200*h*. In some examples, the bladder 400*h* extends through the forefoot portion 12 and the mid-foot portion 14 of the sole structure 200*h* but is absent from the heel portion 16. In some examples, a sidewall 403 of the bladder 400*h* is visible along the lateral and/or medial sides 18, 20 of the footwear 10*h*. In some implementations, the top surface 254*h* of the cushioning member 250*h* and the bottom surface 222*h* of the midsole 220*h* are smooth and include surface profiles contoured to match the surface profiles of the opposing sides of the bladder 400*h* such that the bladder 400*h* mates flush with cushioning member 250*h* and the midsole 220*h*.

The fluid-filled bladder 400*h* defines an interior cavity that receives the pressurized fluid while providing a durable sealed barrier for retaining the pressurized fluid therein. The bladder 400*h* may include an upper barrier portion 401 that opposes the bottom surface 222*h* of the midsole 220*h* and a lower barrier portion 402 disposed on an opposite side of the bladder 400*h* than the upper barrier portion 401 and opposing the top surface 254*h* of the cushioning member 250*h*. The sidewall 403 extends around the periphery of the bladder 400*h* and connects the upper barrier portion 401 to the lower barrier portion 402.

In some configurations, the interior cavity of the fluid-filled bladder 400*h* also receives a tether element 500 having an upper plate that attaches to upper barrier portion 401, a lower plate that attaches to the lower barrier portion 402, and a plurality of tethers 530 that extend between the upper and lower plates of the tether element 500. Adhesive bonding or thermobonding may be used to secure the tether element 500 to the bladder 400*h*. The tether element 500 is operative to prevent the bladder 400*h* from expanding outward or otherwise distending due to the pressure of the fluid within the internal cavity of the bladder 400*h*. Namely, the tether element 500 may limit expansion of the bladder 400*h* when under pressure to retain an intended shape of surfaces of the barrier portions 401 and 402.

FIG. 39 provides a partial cross-sectional view taken along line 39-39 of FIG. 37 showing the fluid-filled bladder 400*h* disposed between the cushioning member 250*h* and the midsole 220*h*, and the cushioning member 250*h* disposed between the outsole 210*h* and the bladder 400*h*. The insole 260 may be disposed upon the footbed 224 within the interior void 102 under the foot. In some configurations, the cushioning member 250*h* defines a greater thickness in the heel portion of the sole structure 200*h* than in the forefoot portion 12 and the top surface 254*h* includes a surface profile contoured to match the surface profile of lower barrier portion 402 of the bladder 400*h* thereon. The cushioning member 250*h* may cooperate with the midsole 220*h* for to define a space for enclosing the bladder 400*h* therebetween.

As with the footwear plates 300-300*i*, the bladder 400*h* includes a curved region 410 extending through the forefoot portion 12 and the mid-foot portion 14 and may optionally include a substantially flat region 412 extending through the heel portion 16 from an aft point at the curved region 410 to an AMP of the bladder 400*h* disposed proximate to the toe end of the sole structure 200*h*. The curved region may have a radius of curvature defining an anterior curved portion 422 and a posterior curved portion 424 similar to respective ones of the anterior and posterior curved portions 322, 324, respectively, of the footwear plate 300 of FIGS. 1-3. In some configurations, the curved portions 422, 424 each include the same radius of curvature that is mirrored about an MTP point 420 associated with the point of the bladder 400*h* disposed closest to the outsole 210*h*. In other configurations, the curved portions 422, 424 are each associated with a different radius of curvature. The curved portions 422, 424 may each account for about 30-percent (%) of the total length of the bladder 400*h* while the length of the flat region 412 may account for the remaining 40-percent (%) of the length of the bladder 400*h*. The anterior curved and posterior curved portions 422, 424, respectively, of the curved region 410 provide the bladder 400 with a longitudinal stiffness that reduces energy loss proximate to the MTP joint of the foot, as well as enhances rolling of the foot during running motions to thereby reduce a lever arm distance and alleviate strain on the ankle joint. While the example footwear 10*h* of FIGS. 37-39 incorporates the curved fluid-filled bladder 400*h* in place of the footwear plate 300 between the cushioning member 250*h* and the midsole 220*h*, the curved fluid-filled bladder 400*h* may replace the plate 300 in any of the articles of footwear 10-10*g* described above.

The footwear plates 300-300*i* described above may be manufactured using fiber sheets or textiles, including pre-impregnated (i.e., "prepreg") fiber sheets or textiles. Alternatively or additionally, the footwear plates 300-300*i* may be manufactured by strands formed from multiple filaments of one or more types of fiber (e.g., fiber tows) by affixing the fiber tows to a substrate or to each other to produce a plate having the strands of fibers arranged predominately at predetermined angles or in predetermined positions. When using strands of fibers, the types of fibers included in the strand can include synthetic polymer fibers which can be melted and re-solidified to consolidate the other fibers present in the strand and, optionally, other components such as stitching thread or a substrate or both. Alternatively or additionally, the fibers of the strand and, optionally the other components such as stitching thread or a substrate or both, can be consolidated by applying a resin after affixing the strands of fibers to the substrate and/or to each other. The above processes are described below.

With reference to FIGS. 40A-40E and 41, the footwear plates 300-300*i* are shown as being formed by using a series of stacked, prepreg fiber sheets 600*a*-600*e*. The prepreg fiber sheets 600*a*-600*e* may be formed from the same or different materials. For example, each of the sheets 600*a*-600*e* may be a unidirectional tape or a multi-axial fabric having a series of fibers 602 that are impregnated with resin. The fibers 602 may include at least one of carbon fibers, aramid fibers, boron fibers, glass fibers, and other polymer fibers that form the unidirectional sheet or multi-axial fabric. Fibers such as carbon fibers, aramid fibers, and boron fibers may provide a high Young's modulus while glass fibers (e.g., fiberglass) and other polymer fibers (e.g., synthetic fibers such as polyamides other than aramid, polyesters, and polyolefins) provide a medium modulus. Alternatively, some of the sheets 600*a*-600*e* may be a unidirectional tape while others of the sheets 600*a*-600*e* are a multi-axial fabric. Further, each of the sheets 600*a*-600*e* may be include fibers 602 formed from the same material or, alternatively, one or more of the sheets 600*a*-600*e* includes fibers 602 formed from a different material than the fibers 602 of the other sheets 600*a*-600*e*.

During manufacturing of the plates 300-300*i*, unidirectional tape or multi-axial fabric is provided and is cut into fiber plies. The plies are cut out and angled with respect to one another and the shapes of the various sheets 600*a*-600*e* are cut from the stacked plies into the shapes shown in FIGS. 40A-40E. In so doing, the sheets 600*a*-600*e* include fibers 602 formed at different angles relative to one another such that a longitudinal axis of the fibers 602 of the unidirectional tape or multi-axial fabric is positioned at an angle (Φ) relative to a longitudinal axis (L) of each sheet 600*a*-600*e* once cut. Accordingly, when the sheets 600*a*-600*e* are stacked on one another, the longitudinal axes of the fibers 602 are positioned at different angles relative to the longitudinal axis of the plate 300-300*i*.

Figure 40C:
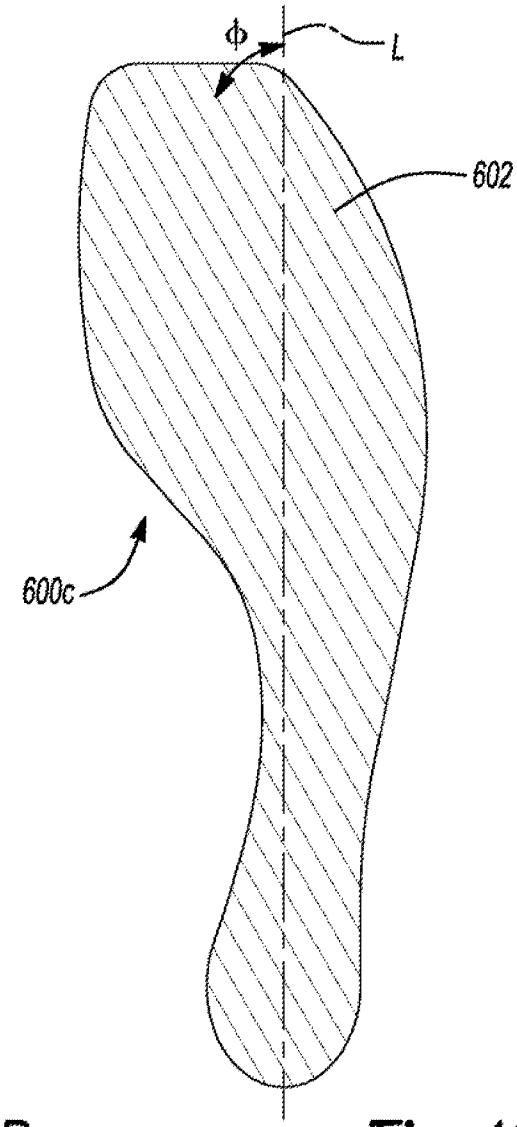
Figure 40B:
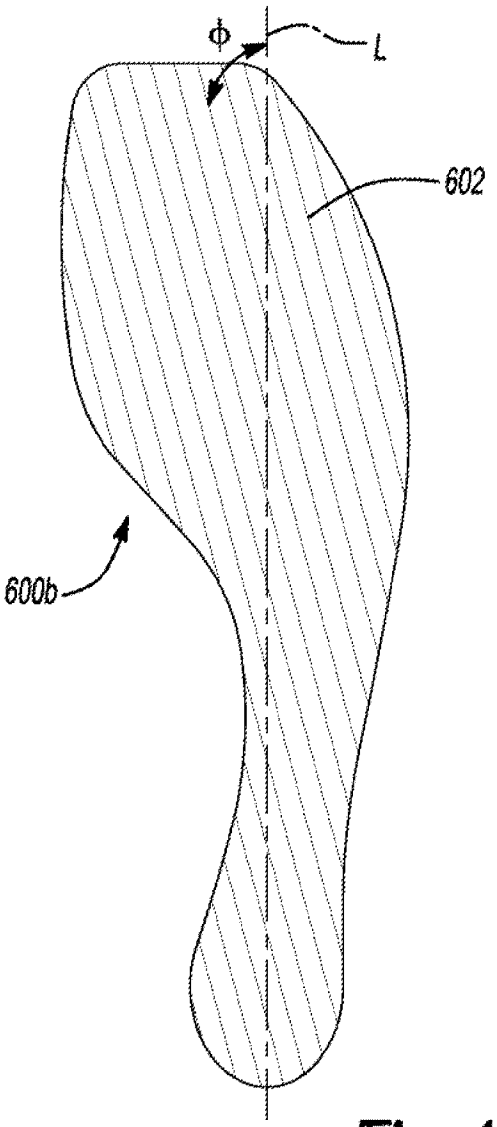
Figure 40A:
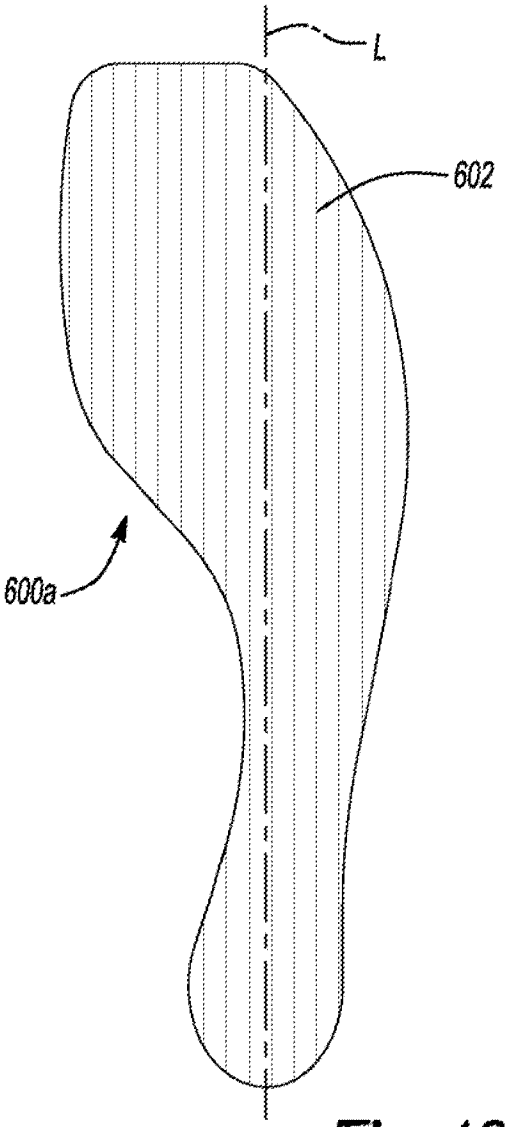
Figure 40E:
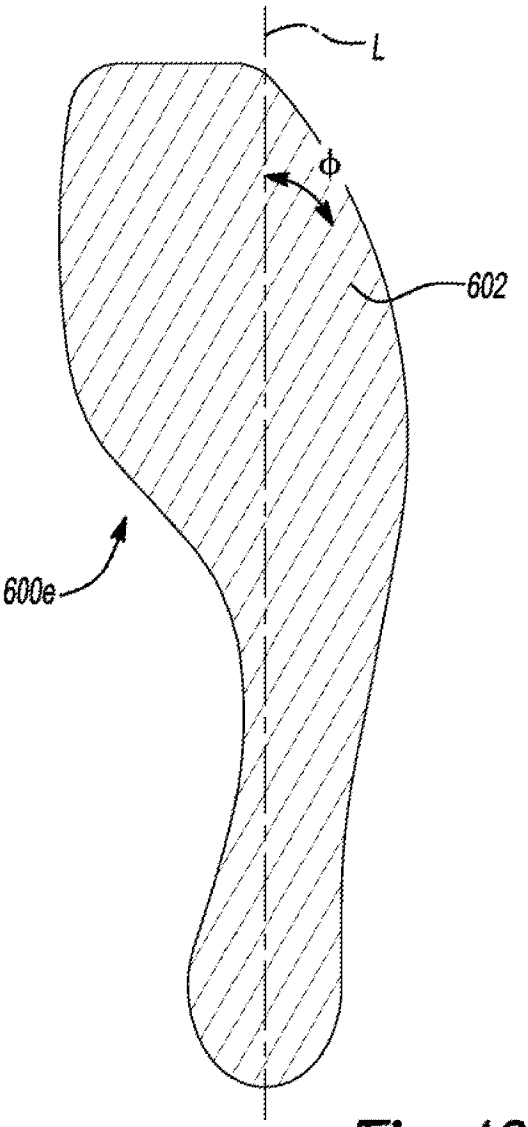
Figure 40D:
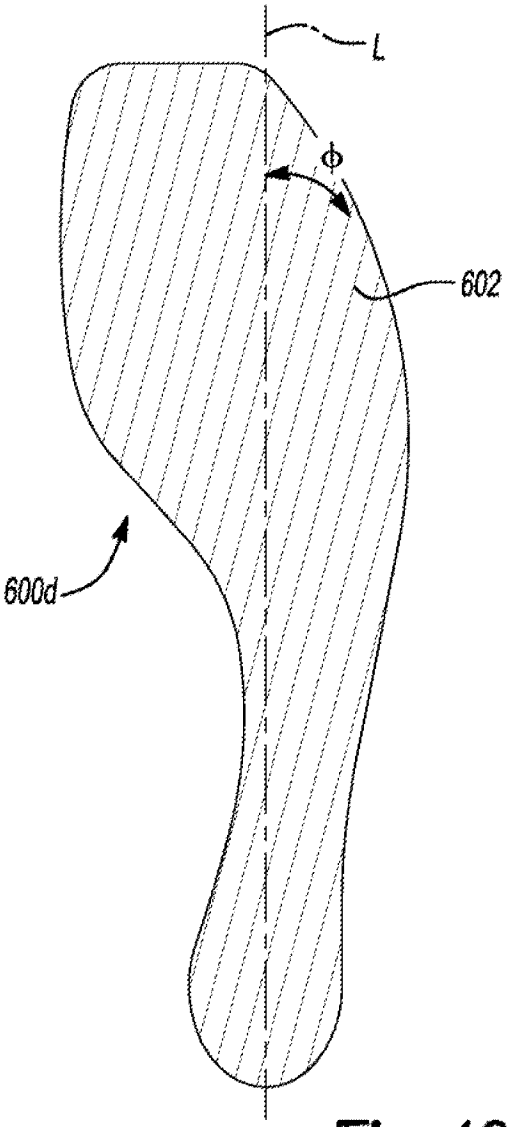

In one configuration, the angle (Φ) shown in FIG. 40A is zero degrees (0°), the angle (Φ) shown in FIG. 40B is −15 degrees (−15°), the angle (Φ) shown in FIG. 40C is −30 degrees (−30°), the angle (Φ) shown in FIG. 40D is 15 degrees (15°), and the angle (Φ) shown in FIG. 40E is 30 degrees (30°). When manufacturing the plates 300-300*i*, the plies are stacked such that when the sheets 600*a*-600*e* are cut from the stacked plies, the sheets 600*a*-600*e* have the shapes shown in FIGS. 40A-40E and are stacked in the order shown in FIG. 41. Namely, the bottom sheet 600*c* includes fibers 602 positioned at −30° relative to the longitudinal axis (L), the next sheet 600*d* includes fibers positioned at 15° relative to the longitudinal axis (L), the next two sheets 600*a* include fibers positioned at 0° relative to the longitudinal axis (L), the next sheet 600*b* includes fibers positioned at −15° relative to the longitudinal axis (L), and top and final sheet 600*e* includes fibers 602 positioned at 30° relative to the longitudinal axis (L). While the bottom sheet 600*c* is described as being positioned at an angle (Φ) of −30° relative to the longitudinal axis (L) and the top sheet 600*e* is described as being positioned at an angle (Φ) of 30° relative to the longitudinal axis (L), the bottom sheet 600*c* could alternative be positioned at an angle (Φ) of −15° relative to the longitudinal axis (L) and the top sheet 600*e* could alternatively be positioned at an angle (Φ) of 15° relative to the longitudinal axis (L). Further, while two (2) sheets 600*a* are described as being provided at an angle (Φ) of 0° relative to the longitudinal axis (L), more than two sheets 600*a* at an angle (Φ) of 0° could be provided. For example, eight (8) sheets 600*a* could be provided.

Once the plies are stacked and cut into the sheets 600*a*-600*e*, the stack is subjected to heat and pressure to impart the specific shape of the plates 300-300*i* to the staked sheets 600*a*-600*e*, as will be described in detail below. Additionally, when fibers which are pre-impregnated with resin are used, subjecting the stack to heat and pressure can melt or soften the pre-impregnated resin and affix the plies together and hold them in the specific shape. Alternatively or additionally, a liquid resin can be applied to the plies to affix the plates together and in some cases to consolidate the fibers, thereby increasing the tensile strength of the plate once the resin has solidified.

With reference to FIGS. 42A-42E and 43, the footwear plates 300-300*i* are shown as being formed by using a process of affixing strands of fibers to a substrate. Namely, the footwear plates 300-300*i* are formed from one or more strands 702 of fibers arranged in selected patterns to impart anisotropic stiffness and gradient load paths throughout the plates 300-300*i*. The strands 702 of fibers may be affixed to the same or separate substrates 704 and embroidered in a layered configuration. If the strands 702 of fibers are applied to separate substrates 704, the individual substrates 704 are stacked on top of one another once each substrate 704 is supplied with a strand 702 of fibers. If, on the other hand, only one substrate 704 is utilized in forming the plate 300-300*i*, a first strand 702 of fibers is applied to the substrate 704 with additional strands 702 of fibers (i.e., layers) being applied on top of the first strand 702. Finally, a single, continuous strand 702 of fibers may be used to form the plate 300-300*i*, whereby the strand 702 is initially applied and affixed to the substrate 704 and is subsequently layered on top of itself to form the layered construction shown in FIG. 43. While each of the foregoing processes may be used to form the plates 300-300*i*, the following process will be described as employing a single substrate 704 with individual strands 702 of fiber applied to form the construction shown in FIG. 43, whereby individual strands 702*a*-702*e* respectively form layers 700*a*-700*e* of a preformed plate.

Each strand 702 may refer to a tow of a plurality of fibers, a monofilament, yarn, or polymer pre-impregnated tows. For example, the strand 702 may include a plurality of carbon fibers and a plurality of resin fibers that, when activated, solidify and hold the carbon fibers in a desired shape and position relative to one another. As used herein, the term "tow" refers to a bundle (i.e., plurality of filaments (e.g., fibers) that may be twisted or untwisted and each tow may be designated a size associated with a number of fibers the corresponding tow contains. For instance, a single strand 702 may range in size from about 1,000 fibers per bundle to about 48,000 fibers per bundle. As used herein, the substrate 704 refers to any one of a veil, carrier, or backer to which at least one strand 702 of fibers is attached. The substrate 704 may be formed from a thermoset polymeric material or a thermoplastic polymeric material and can be a textile (e.g., knit, woven, or non-woven), an injection molded article, or a thermoformed article. In some configurations, the fibers associated with each strand 702 include at least one of carbon fibers, aramid fibers, boron fibers, glass fibers, and polymer fibers. Fibers such as carbon fibers, aramid fibers, and boron fibers may provide a high Young's modulus while glass fibers (e.g., fiberglass) and polymer fibers (e.g., synthetic fibers) provide a medium modulus.

When forming the plates 300-300*i*, a first strand 702*c* may be applied to the substrate 704. Namely, the first strand 702*c* may be applied directly to the substrate 704 and may be stitched to the substrate 704 to hold the first strand 702*c* in a desired location. In one configuration, the first strand 702*c* is applied to the substrate 704 such that the strand 702*c* is positioned at an angle (Φ) shown in FIG. 42C as being −30 degrees (−30°) relative to a longitudinal axis (L) of the substrate 704. Another or second strand 702*d* may be applied to the first strand 702*c* via stitching, for example, and may be formed at an angle (Φ) shown in FIG. 42B as being 15 degrees (−15°) relative to a longitudinal axis (L) of the substrate 704. A third strand 702*a* may be applied to the second strand at an angle (Φ) shown in FIG. 42A as being zero degrees (0°) relative to a longitudinal axis (L) of the substrate 704. A fourth strand 702*b* may be applied to the third strand at an angle (Φ) shown in FIG. 42D as being −15 degrees (15°) relative to a longitudinal axis (L) of the substrate 704. A fifth and final strand 702*e* may be applied to the second strand at an angle (Φ) shown in FIG. 42E as being 30 degrees (30°) relative to a longitudinal axis (L) of the substrate 704. While the first strand 702*c* is shown and described as being applied at an angle (Φ) shown in FIG. 42C as being −30 degrees (−30°) relative to a longitudinal axis (L) of the substrate 704 and the fifth strand 702*e* is shown and described as being applied at an angle (Φ) shown in FIG. 42E as being 30 degrees (30°) relative to a longitudinal axis (L) of the substrate 704, these angles (Φ) could alternatively be −15 degrees (−15°) and 15 degrees (15°), respectively.

The strands 702*a*-702*e* form the various layers 700*a*-700*e* of a pre-formed plate 300-300*i*. Once the layers 700*a*-700*e* are formed, the layers 70*oa*-700*e* are subjected to heat and pressure to activate the impregnated resin of the various strands 702*a*-702*e* and, further, to impart the specific shape of the plates 300-300*i* to the layers 700*a*-700*e*, as will be described in detail below.

As set forth above, the plates 300-300*i* formed using the layered process (FIG. 43) include one fewer layer than the plates 300-300*i* formed via a prepreg fiber sheet (FIG. 41). Namely, the layered process may only utilize a single layer 700*a* having an angle (Φ) shown in FIG. 42A as being zero degrees (0°) relative to a longitudinal axis (L) of the substrate 704. While the layered process uses one less layer in forming the plates 300-300*i*, the resulting plates 300-300*i* have substantially the same properties (i.e., stiffness, thickness, etc.) as the plates 300-300*i* formed using a prepreg fiber sheet.

With particular reference to FIGS. 44 and 45, formation of a plate 300-300*i* is described in conjunction with a mold 800. The mold 800 includes a first mold half 802 and a second mold half 804. The mold halves 802, 804 include a mold cavity 806 having the shape of one of the various plates 300-300*i* to allow the mold 800 to impart the desired shape of the particular plate 300-300*i* to either the stacked sheets 600*a*-600*e* or to the layers 700*a*-700*e*.

After forming the stacked sheets 600*a*-600*e* or the layers 700*a*-700*e*, the sheets 600*a*-600*e* or layers 700*a*-700*e* are inserted between the mold halves 802, 804 within the mold cavity 806. At this point, the mold 800 is closed by moving the mold halves 802, 804 toward one another or by moving one of the mold halves 802, 804 toward the other mold half 802, 804. Once closed, the mold 800 applies heat and pressure to the stacked sheets 600*a*-600*e* or the layers 700*a*-700*e* disposed within the mold cavity 806 to activate the resin associated with the stacked sheets 600*a*-600*e* or the layers 700*a*-700*e*. The heat and pressure applied to the stacked sheets 600*a*-600*e* or the layers 700*a*-700*e* causes the particular shape of the mold cavity 806 to be applied to the stacked sheets 600*a*-600*e* or the layers 700*a*-700*e* and, once cured, the resin associated with the stacked sheets 600*a*-600*e* or the layers 700*a*-700*e* causes the stacked sheets 600*a*-600*e* or the layers 700*a*-700*e* to harden and retain the desired shape.

It should be noted that while the sheets 600*a*-600*e* and the layers 700*a*-700*e* are described as including a resin material, the sheets 600*a*-600*e* and the layers 700*a*-700*e* could additionally be supplied with resin that is infused within the mold 800. The infused resin could be in addition to the impregnated resin of the sheets 600*a*-600*e* and layers 700*a*-700*e* or, alternatively, could be used in place of the impregnated resin.

The forgoing processes may be used to form footwear plates and cushioning elements that may be used to manufacture custom-made footwear. For instance, various measurements of the foot may be recorded to determine suitable dimensions of the footwear plate and the cushioning member(s) incorporated into the article of footwear. Additionally, data associated with the gate of the foot may be obtained to determine if the foot is indicative of toe striking or heel striking. The foot measurements and obtained data may be used to determine optimal angles and radii of curvature of the footwear plate, as well as the thickness of the one or more cushioning members positioned above, below, or encapsulating the footwear plate. Moreover, the length and width of the footwear plate may be determined based on the collected data and foot measurements. In some examples, the foot measurements and collected data are used to select the footwear plate and/or cushioning member(s) from a plurality of pre-fabricated footwear plates and/or cushioning member(s) of various sizes and dimensions that closely match the foot of the wearer.

Custom footwear plates may further allow for tailoring of the stiffness of the plate for a particular wearer of the footwear. For instance, the tendon stiffness and calf muscle strength of an athlete may be measured to determine a suitable stiffness of the plate for use by the athlete. Here, the stiffness of the footwear plate can vary with the strength of the athlete or for the size/condition of the athlete's tendons. Additionally or alternatively, the stiffness of the plate may be tailored based on biomechanics and running mechanics of a particular athlete, such as how the angles of the athlete's joints change during running movements. In some examples, force and motion measurements of the athlete are obtained before manufacturing a custom plate for the athlete. In other examples, plates are manufactured in particular ranges or increments of stiffness to provide semi-custom footwear such that individual athletes may select a suitable stiffness.

In some examples, a method of manufacturing the footwear plate 300 includes the steps of providing a plurality of stacked plies (or tows), fusing the plurality of stacked plies to form a monolithic layer, and thermally forming the monolithic layer to form the plate 300. The method may also include providing an upper 100 defining an interior void 102 and inserting the plate into the interior void 102. The method may also include providing a midsole 220 extending from a forefoot portion 12 to a heel portion 16, positioning the plate 300 on a superior portion of the midsole 220, securing the upper 100 to the midsole 220, and securing an outsole 210 to the midsole 220 to form an article of footwear.

The following Clauses provide an exemplary configuration for a plate for an article of footwear described above.

Clause 1: A sole structure for an article of footwear having an upper, the sole structure comprising an outsole and a plate disposed between the outsole and the upper. The plate comprising an anterior-most point disposed in a forefoot region of the sole structure, a posterior-most point disposed closer to a heel region of the sole structure than the anterior-most point, and a concave portion extending between the anterior-most point and the posterior-most point and including a constant radius of curvature from the anterior-most point to a metatarsophalangeal (MTP) point of the sole structure, the MTP point opposing the MTP joint of a foot during use. A first cushioning layer may be disposed between the concave portion and the upper.

Clause 2: The sole structure according to Clause 1, wherein the anterior-most point and the posterior-most point are co-planar.

Clause 3: The sole structure according to Clause 2, wherein the plate includes a substantially flat portion disposed within the heel region of the sole structure, the posterior-most point being located within the substantially flat portion.

Clause 4: The sole structure according to Clause 1, wherein the plate includes a substantially flat portion disposed within the heel region of the sole structure, the posterior-most point being located within the substantially flat portion.

Clause 5: The sole structure according to Clause 4, further comprising a blend portion disposed between and connecting the concave portion and the substantially flat portion.

Clause 6: The sole structure according to Clause 5, wherein the blend portion includes a substantially constant curvature.

Clause 7: The sole structure according to Clause 5, wherein the blend portion includes a radius of curvature equal to about 134 millimeters (mm) for a men's size ten (10) article of footwear.

Clause 8: The sole structure according to Clause 5, wherein the anterior-most point and the posterior-most point are co-planar at a junction of the blend portion and the substantially flat portion.

Clause 9: The sole structure according to any of Clauses 3-8, further comprising a second cushioning layer disposed between the substantially flat portion and the upper.

Clause 10: The sole structure according to Clause 9, further comprising a third cushioning layer disposed between the outsole and the plate.

Clause 11: The sole structure according to Clause 10, wherein the third cushioning layer is disposed within the heel region.

Clause 12: The sole structure according to Clause 10, wherein the third cushioning layer extends from the heel region to the forefoot region.

Clause 13: The sole structure according to Clause 12, wherein the second cushioning member includes a thickness from about 3.0 millimeters (mm) to about 13.0 mm at a location opposing the MTP point and the third cushioning member includes a thickness from about 0.5 mm to about 6.0 mm at the location opposing the MTP point.

Clause 14: The sole structure according to any of Clauses 9-12, wherein at least one of the first cushioning member, the second cushioning member, and the third cushioning member includes a density from about 0.05 grams per cubic centimeter ($g/cm^3$) to about 0.20 $g/cm^3$, a hardness from about eleven (11) Shore A to about fifty (50) Shore A, and an energy return of at least sixty percent (60%).

Clause 15: The sole structure according to any of Clauses 9-12, further comprising at least one fluid-filled chamber disposed between the plate and the upper and/or between the outsole and the plate.

Clause 16: The sole structure according to Clause 15, wherein the at least one fluid-filled chamber is disposed within at least one of the second cushioning layer and the third cushioning layer.

Clause 17: The sole structure according to any of the preceding clauses, wherein the MTP point is located approximately thirty percent (30%) of the total length of the plate from the anterior-most point and the posterior-most point is located approximately thirty percent (30%) of the total length of the plate from the MTP point.

Clause 18: The sole structure according to any of the preceding clauses, wherein the MTP point is located approximately 81 millimeters (mm) of the total length of the plate from the anterior-most point and the posterior-most point is located approximately 81 millimeters (mm) of the total length of the plate from the anterior-most point.

Clause 19: The sole structure according to any of the preceding clauses, wherein the MTP point is located from about twenty-five percent (25%) to about thirty-five percent (35%) of the total length of the plate from the anterior-most point and the posterior-most point is located from about twenty-five percent (25%) to about thirty-five percent (35%) of the total length of the plate from the MTP point.

Clause 20: The sole structure according to any of the preceding clauses, wherein a center of the radius of curvature is located at the MTP point.

Clause 21: The sole structure according to any of the preceding clauses, wherein the constant radius of curvature extends from the anterior-most point past the MTP point.

Clause 22: The sole structure according to Clause 1, wherein the constant radius of curvature extends from the anterior-most point past the MTP point at least forty percent (40%) of the total length of the plate from the anterior-most point.

Clause 23: The sole structure according to any of the preceding clauses, wherein the outsole includes a ground-contacting surface and an inner surface formed on an opposite side of the outsole than the ground-contact surface, the inner surface being directly attached to the plate.

Clause 24: The sole structure according to Clause 23, wherein the inner surface is attached to the plate proximate to the concave portion.

Clause 25: The sole structure according to any of the preceding clauses, wherein the plate includes a thickness from about 0.6 millimeters (mm) to about 3.0 mm.

Clause 26: The sole structure according to any of the preceding clauses, wherein the plate includes a Young's modulus equal to at least seventy (70) gigapascals (GPa).

Clause 27: The sole structure according to any of the preceding clauses, wherein the anterior-most point and the posterior-most point of the plate each include a position height from the MTP equal from about three (3) millimeters (mm) to about twenty-eight (28) mm.

Clause 28: The sole structure according to any of the preceding clauses, wherein the anterior-most point and the posterior-most point of the plate each include a position height from the MTP equal from about seventeen (17) millimeters (mm) to about fifty-seven (57) mm.

Clause 29: The sole structure according to any of the preceding clauses, wherein the anterior-most point extends from the MTP point at an angle from about twelve (12) degrees to about thirty-five (35) degrees relative to a horizontal reference plane.

Clause 30: The sole structure according to any of the preceding clauses wherein the posterior-most point extends from the MTP point at an angle from about twelve (12) degrees to about thirty-five (35) degrees relative to a horizontal reference plane.

Clause 31: A sole structure for an article of footwear having an upper, the sole structure comprising an outsole and a plate disposed between the outsole and the upper. The plate comprising an anterior-most point disposed in a forefoot region of the sole structure, a posterior-most point disposed closer to a heel region of the sole structure than the anterior-most point, and a curved portion extending between and connecting the anterior-most point and the posterior-most point and including a constant radius of curvature from the anterior-most point to a metatarsophalangeal (MTP) point of the sole structure, the MTP point opposing the MTP joint of a foot during use. A first cushioning layer may be disposed between the curved portion and the upper.

Clause 32: The sole structure according to Clause 31, wherein the anterior-most point and the posterior-most point are co-planar.

Clause 33: The sole structure according to Clause 32, wherein the plate includes a substantially flat portion disposed within the heel region of the sole structure, the posterior-most point being located within the substantially flat portion.

Clause 34: The sole structure according to Clause 31, wherein the plate includes a substantially flat portion disposed within the heel region of the sole structure, the posterior-most point being located within the substantially flat portion.

Clause 35: The sole structure according to Clause 34, further comprising a blend portion disposed between and connecting the curved portion and the substantially flat portion.

Clause 36: The sole structure according to Clause 35, wherein the blend portion includes a substantially constant curvature.

Clause 37: The sole structure according to Clause 24, wherein the blend portion includes a radius of curvature equal to about 134 millimeters (mm) for a men's size ten (10) article of footwear.

Clause 38: The sole structure according to Clause 35, wherein the anterior-most point and the posterior-most point are co-planar at a junction of the blend portion and the substantially flat portion.

Clause 39: The sole structure according to any of Clauses 33-38, further comprising a second cushioning layer disposed between the substantially flat portion and the upper.

Clause 40: The sole structure according to Clause 39, further comprising a third cushioning layer disposed between the outsole and the plate.

Clause 41: The sole structure according to Clause 40, wherein the third cushioning layer is disposed within the heel region.

Clause 42: The sole structure according to Clause 40, wherein the third cushioning layer extends from the heel region to the forefoot region.

Clause 43: The sole structure according to Clause 42, wherein the second cushioning member includes a thickness from about 3.0 millimeters (mm) to about 13.0 mm at a location opposing the MTP point and the third cushioning member includes a thickness from about 0.5 mm to about 6.0 mm at the location opposing the MTP point.

Clause 44: The sole structure according to any of Clauses 39-43, wherein at least one of the first cushioning member, the second cushioning member, and the third cushioning member includes a density from about 0.05 grams per cubic centimeter ($g/cm^3$) to about 0.20 $g/cm^3$, a hardness from about eleven (11) Shore A to about fifty (50) Shore A, and an energy return of at least sixty percent (60%).

Clause 45: The sole structure according to any of Clauses 39-42, further comprising at least one fluid-filled chamber disposed between the plate and the upper and/or between the outsole and the plate.

Clause 46: The sole structure according to Clause 45, wherein the at least one fluid-filled chamber is disposed within at least one of the second cushioning layer and the third cushioning layer.

Clause 47: The sole structure according to any of the preceding clauses, wherein the MTP point is located approximately thirty percent (30%) of the total length of the plate from the anterior-most point and the posterior-most point is located approximately thirty percent (30%) of the total length of the plate from the MTP point.

Clause 48: The sole structure according to any of the preceding clauses, wherein the MTP point is located approximately 81 millimeters (mm) of the total length of the plate from the anterior-most point and the posterior-most point is located approximately 81 millimeters (mm) of the total length of the plate from the anterior-most point.

Clause 49: The sole structure according to any of the preceding clauses, wherein the MTP point is located from about twenty-five percent (25%) to about thirty-five percent (35%) of the total length of the plate from the anterior-most point and the posterior-most point is located from about twenty-five percent (25%) to about thirty-five percent (35%) of the total length of the plate from the MTP point.

Clause 50: The sole structure according to any of the preceding clauses, wherein a center of the radius of curvature is located at the MTP point.

Clause 51: The sole structure according to any of the preceding clauses, wherein the constant radius of curvature extends from the anterior-most point past the MTP point.

Clause 52: The sole structure according to Clause 31, wherein the constant radius of curvature extends from the anterior-most point past the MTP point at least forty percent (40%) of the total length of the plate from the anterior-most point.

Clause 53: The sole structure according to any of the preceding clauses, wherein the outsole includes a ground-contacting surface and an inner surface formed on an opposite side of the outsole than the ground-contact surface, the inner surface being directly attached to the plate.

Clause 54: The sole structure according to Clause 53, wherein the inner surface is attached to the plate proximate to the curved portion.

Clause 55: The sole structure according to any of the preceding clauses, wherein the plate includes a thickness from about 0.6 millimeters (mm) to about 3.0 mm.

Clause 56: The sole structure according to any of the preceding clauses, wherein the plate includes a Young's modulus equal to at least seventy (70) gigapascals (GPa).

Clause 57: The sole structure according to any of the preceding clauses, wherein the anterior-most point and the posterior-most point of the plate each include a position height from the MTP equal from about three (3) millimeters (mm) to about twenty-eight (28) mm.

Clause 58: The sole structure according to any of the preceding clauses, wherein the anterior-most point and the posterior-most point of the plate each include a position height from the MTP equal from about seventeen (17) millimeters (mm) to about fifty-seven (57) mm.

Clause 59: The sole structure according to any of the preceding clauses, wherein the anterior-most point extends from the MTP point at an angle from about twelve (12) degrees to about thirty-five (35) degrees relative to a horizontal reference plane.

Clause 60: The sole structure according to any of the preceding clauses wherein the posterior-most point extends from the MTP point at an angle from about twelve (12) degrees to about thirty-five (35) degrees relative to a horizontal reference plane.

Clause 61: A sole structure for an article of footwear having an upper, the sole structure comprising an outsole, a plate disposed between the outsole and the upper. The plate comprising an anterior-most point disposed in a forefoot region of the sole structure, a posterior-most point disposed closer to a heel region of the sole structure than the anterior-most point, and a curved portion extending between and connecting the anterior-most point and the posterior-most point and including a circular curvature from the anterior-most point to a metatarsophalangeal (MTP) point of the sole structure, the MTP point opposing the MTP joint of a foot during use. A first cushioning layer may be disposed between the curved portion and the upper.

Clause 62: The sole structure according to Clause 61, wherein the anterior-most point and the posterior-most point are co-planar.

Clause 63: The sole structure according to Clause 62, wherein the plate includes a substantially flat portion disposed within the heel region of the sole structure, the posterior-most point being located within the substantially flat portion.

Clause 64: The sole structure according to Clause 61, wherein the plate includes a substantially flat portion disposed within the heel region of the sole structure, the posterior-most point being located within the substantially flat portion.

Clause 65: The sole structure according to Clause 64, further comprising a blend portion disposed between and connecting the curved portion and the substantially flat portion.

Clause 66: The sole structure according to Clause 65, wherein the blend portion includes a substantially constant curvature.

Clause 67: The sole structure according to Clause 65, wherein the blend portion includes a radius of curvature equal to about 134 millimeters (mm) for a men's size ten (10) article of footwear.

Clause 68: The sole structure according to Clause 65, wherein the anterior-most point and the posterior-most point are co-planar at a junction of the blend portion and the substantially flat portion.

Clause 69: The sole structure according to any of Clauses 63-68, further comprising a second cushioning layer disposed between the substantially flat portion and the upper.

Clause 70: The sole structure according to Clause 69, further comprising a third cushioning layer disposed between the outsole and the plate.

Clause 71: The sole structure according to Clause 70, wherein the third cushioning layer is disposed within the heel region.

Clause 72: The sole structure according to Clause 70, wherein the third cushioning layer extends from the heel region to the forefoot region.

Clause 73: The sole structure according to Clause 72, wherein the second cushioning member includes a thickness from about 3.0 millimeters (mm) to about 13.0 mm at a location opposing the MTP point and the third cushioning member includes a thickness from about 0.5 mm to about 6.0 mm at the location opposing the MTP point.

Clause 74: The sole structure according to any of Clauses 69-73, wherein at least one of the first cushioning member, the second cushioning member, and the third cushioning member includes a density from about 0.05 grams per cubic centimeter ($g/cm^3$) to about 0.20 $g/cm^3$, a hardness from about eleven (11) Shore A to about fifty (50) Shore A, and an energy return of at least sixty percent (60%).

Clause 75: The sole structure according to any of Clauses 69-72, further comprising at least one fluid-filled chamber disposed between the plate and the upper and/or between the outsole and the plate.

Clause 76: The sole structure according to Clause 75, wherein the at least one fluid-filled chamber is disposed within at least one of the second cushioning layer and the third cushioning layer.

Clause 77: The sole structure according to any of the preceding clauses, wherein the MTP point is located approximately thirty percent (30%) of the total length of the plate from the anterior-most point and the posterior-most point is located approximately thirty percent (30%) of the total length of the plate from the MTP point.

Clause 78: The sole structure according to any of the preceding clauses, wherein the MTP point is located approximately 81 millimeters (mm) of the total length of the plate from the anterior-most point and the posterior-most point is located approximately 81 millimeters (mm) of the total length of the plate from the anterior-most point.

Clause 79: The sole structure according to any of the preceding clauses, wherein the MTP point is located from about twenty-five percent (25%) to about thirty-five percent (35%) of the total length of the plate from the anterior-most point and the posterior-most point is located from about twenty-five percent (25%) to about thirty-five percent (35%) of the total length of the plate from the MTP point.

Clause 80: The sole structure according to any of the preceding clauses, wherein a center of the circular curvature is located at the MTP point.

Clause 81: The sole structure according to any of the preceding clauses, wherein the circular curvature extends from the anterior-most point past the MTP point.

Clause 82: The sole structure according to Clause 61, wherein the circular curvature extends from the anterior-most point past the MTP point at least forty percent (40%) of the total length of the plate from the anterior-most point.

Clause 83: The sole structure according to any of the preceding clauses, wherein the outsole includes a ground-contacting surface and an inner surface formed on an opposite side of the outsole than the ground-contact surface, the inner surface being directly attached to the plate.

Clause 84: The sole structure according to Clause 83, wherein the inner surface is attached to the plate proximate to the curved portion.

Clause 85: The sole structure according to Clause 83, further comprising a second cushioning layer disposed on an opposite side of the plate than the first cushioning layer, the second cushioning layer forming at least a portion of the outsole.

Clause 86: The sole structure according to any of the preceding clauses, wherein the plate includes a thickness from about 0.6 millimeters (mm) to about 3.0 mm.

Clause 87: The sole structure according to any of the preceding clauses, wherein the plate includes a Young's modulus equal to at least seventy (70) gigapascals (GPa).

Clause 88: The sole structure according to any of the preceding clauses, wherein the anterior-most point and the posterior-most point of the plate each include a position height from the MTP equal from about three (3) millimeters (mm) to about twenty-eight (28) mm.

Clause 89: The sole structure according to any of the preceding clauses, wherein the anterior-most point and the posterior-most point of the plate each include a position height from the MTP equal from about seventeen (17) millimeters (mm) to about fifty-seven (57) mm.

Clause 90: The sole structure according to any of the preceding clauses, wherein the anterior-most point extends from the MTP point at an angle from about twelve (12) degrees to about thirty-five (35) degrees relative to a horizontal reference plane.

Clause 91: The sole structure according to any of the preceding clauses wherein the posterior-most point extends from the MTP point at an angle from about twelve (12) degrees to about thirty-five (35) degrees relative to a horizontal reference plane.

Clause 92: A method of manufacturing an article of footwear comprising receiving a sole structure in accordance with any of Clauses 1-91, receiving an upper for the article of footwear, and affixing the sole structure and the upper to each other.

Clause 93: A method of manufacturing any of the sole structures of Clauses 1-91 comprising stacking fiber sheets to form the plate of any of the sole structures of Clauses 1-91.

Clause 94: The method of Clause 93, further comprising applying heat and pressure to the stacked fiber sheets to activate a resin associated with the fiber sheets.

Clause 95: The method of Clause 94, wherein applying heat and pressure includes applying heat and pressure within a mold.

Clause 96: A method of manufacturing any of the sole structures of Clauses 1-91 comprising applying a first tow of fibers to a first substrate to form the plate of any of the sole structures of Clauses 1-91.

Clause 97: The method of Clause 96, further comprising applying a second tow of fibers to the first tow of fibers to form the plate.

Clause 98: The method of Clause 96, further comprising applying a second tow of fibers to a second substrate and stacking the first substrate and the second substrate along with the first tow of fibers and the second tow of fibers to form the plate.

Clause 99: The method of Clause 96, further comprising applying heat and pressure to the fibers to activate a resin associated with the fiber sheets.

Clause 100: The method of Claim 99, wherein applying heat and pressure includes applying heat and pressure within a mold.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear having an upper, the sole structure comprising:

a plate including (i) a curved portion having a constant radius of curvature extending from an anterior-most point in a forefoot region of the sole structure to an aft point in a heel region of the sole structure and (ii) a substantially flat portion extending from the aft point and into the heel region of the sole structure; and a midsole including a first portion disposed between a first surface of the plate and the upper and a second portion disposed between an opposite second surface of the plate and a ground-contacting surface of the sole structure, the first portion including a constant first thickness from the anterior-most point to the aft point of the curved portion and the second portion including a second thickness less than the first thickness below the curved portion.

2. The sole structure of claim 1, wherein the curved portion is disposed in the forefoot region of the sole structure.

3. The sole structure of claim 1, wherein the first portion of the midsole includes a first segment disposed between the curved portion and the upper in the forefoot region of the sole structure and a second segment disposed between the substantially flat portion and the upper in the heel region of the sole structure.

4. The sole structure of claim 3, wherein the first segment and the second segment include the same thickness.

5. The sole structure of claim 3, wherein the second portion includes a third segment disposed between the curved portion and the ground-contacting surface in the forefoot region and a fourth segment disposed between the substantially flat portion and the ground-contacting surface in the heel region.

6. The sole structure of claim 5, wherein the fourth segment includes a greater thickness than the third segment.

7. The sole structure of claim 5, wherein the fourth segment includes a greater thickness than the first segment.

8. The sole structure of claim 1, wherein the plate is embedded in the midsole.

9. The sole structure of claim 1, wherein the midsole is formed from a foam material and the plate has a greater rigidity than the midsole.

10. An article of footwear incorporating the sole structure of claim 1.

11. A sole structure for an article of footwear having an upper, the sole structure comprising:

a plate including (i) a curved portion having a constant radius of curvature extending from an anterior-most point in a forefoot region of the sole structure to an aft point in a heel region of the sole structure and (ii) a substantially flat portion extending from the aft point and into the heel region of the sole structure; and a midsole including (i) a first portion disposed between the plate and the upper and including a constant first thickness from the anterior-most point to the aft point of the curved portion and (ii) a second portion disposed between the plate and a ground-contacting surface of the sole structure, the first portion including a first segment disposed between the curved portion and the upper and a second segment disposed between the substantially flat portion and the upper and the second portion including a third segment disposed between the curved portion and the ground-contacting surface and a fourth segment disposed between the substantially flat portion and the ground-contacting surface, a thickness of the first segment being less than a thickness of the fourth segment.

12. The sole structure of claim 11, wherein the plate extends substantially along an entire length of the sole structure from an anterior end of the sole structure to a posterior end of the sole structure.

13. The sole structure of claim 11, wherein the first segment and the second segment include the same thickness.

14. The sole structure of claim 11, wherein the fourth segment includes a greater thickness than the third segment.

15. The sole structure of claim 11, wherein the fourth segment includes a greater thickness than the second segment.

16. The sole structure of claim 11, wherein the plate is embedded in the midsole.

17. The sole structure of claim 11, wherein the midsole is formed from a foam material and the plate has a greater rigidity than the midsole.

* * * * *